US011697930B2

(12) United States Patent
Chung

(10) Patent No.: US 11,697,930 B2
(45) Date of Patent: Jul. 11, 2023

(54) HANDWASHING STATION

(71) Applicant: Kohler Co., Kohler, WI (US)

(72) Inventor: Chanseol Chung, Shanghai (CN)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 17/960,396

(22) Filed: Oct. 5, 2022

(65) Prior Publication Data

US 2023/0023596 A1 Jan. 26, 2023

Related U.S. Application Data

(63) Continuation of application No. 16/894,488, filed on Jun. 5, 2020, now Pat. No. 11,492,788, which is a continuation of application No. 15/909,641, filed on Mar. 1, 2018, now Pat. No. 10,718,105.

(60) Provisional application No. 62/487,098, filed on Apr. 19, 2017, provisional application No. 62/473,542, filed on Mar. 20, 2017, provisional application No. 62/465,960, filed on Mar. 2, 2017.

(51) Int. Cl.

| | |
|---|---|
| ***E03C 1/05*** | (2006.01) |
| ***A47K 10/48*** | (2006.01) |
| ***E03C 1/14*** | (2006.01) |
| ***E03C 1/046*** | (2006.01) |
| ***E03C 1/04*** | (2006.01) |

(52) U.S. Cl.

CPC ..... *E03C 1/057* (2013.01); *A47K 10/48* (2013.01); *E03C 1/0404* (2013.01); *E03C 1/0465* (2013.01); *E03C 1/14* (2013.01); *A47K 2210/00* (2013.01)

(58) Field of Classification Search

CPC ..... E03C 1/057; E03C 1/0404; E03C 1/0465; E03C 1/14; A47K 10/48; A47K 2210/00

See application file for complete search history.

(56) References Cited

U.S. PATENT DOCUMENTS

| | | | |
|---|---|---|---|
| 4,295,233 | A | 10/1981 | Hinkel |
| 4,823,409 | A | 4/1989 | Gaffney et al. |
| 5,727,579 | A | 3/1998 | Chardack |
| 5,813,087 | A | 9/1998 | Huffman |
| 5,868,311 | A | 2/1999 | Cretu-petra |
| 6,131,587 | A | 10/2000 | Chardack |

(Continued)

FOREIGN PATENT DOCUMENTS

| | | | |
|---|---|---|---|
| CN | 1931579 | A | 3/2007 |
| CN | 1953690 | A | 4/2007 |

(Continued)

OTHER PUBLICATIONS

Chinese Office Action for Chinese Application No. 201880015159.7 dated Dec. 17, 2020.

(Continued)

*Primary Examiner* — Janie M Loeppke

(74) *Attorney, Agent, or Firm* — Lempia Summerfield Katz LLC

(57) ABSTRACT

A handwashing station that includes a basin, a liquid dispensing system, and an air dispensing system. The liquid dispensing system is configured to dispense a liquid into the basin to wash a user's hands. The air dispensing system configured to dispense air into the basin to dry the user's hands. The user can wet, wash, rinse, and dry their hands from within the basin.

20 Claims, 46 Drawing Sheets

(56) References Cited

U.S. PATENT DOCUMENTS

| | | | |
|---|---|---|---|
| 6,250,601 | B1 | 6/2001 | Kolar |
| D669,222 | S | 10/2012 | Dyson |
| 8,350,508 | B2 | 1/2013 | Celik |
| D678,613 | S | 3/2013 | Dyson |
| 8,395,340 | B2 | 3/2013 | Marvelly |
| 8,432,114 | B2 | 4/2013 | Clothier |
| 8,474,095 | B2 | 7/2013 | Clothier |
| 8,476,852 | B2 | 7/2013 | Hawker |
| 8,487,565 | B2 | 7/2013 | Dai |
| 8,561,253 | B2 | 10/2013 | Clothier |
| 8,643,319 | B2 | 2/2014 | Celik |
| 8,648,558 | B2 | 2/2014 | Clothier |
| 8,674,634 | B2 | 3/2014 | Dai |
| 8,736,410 | B2 | 5/2014 | Jones |
| 8,741,088 | B2 | 6/2014 | Jones |
| 8,742,707 | B2 | 6/2014 | Chen |
| 8,756,794 | B2 | 6/2014 | Ions |
| 8,836,254 | B2 | 9/2014 | Dai |
| 8,841,876 | B2 | 9/2014 | Leaver |
| 8,864,460 | B2 | 10/2014 | Childe |
| 8,933,604 | B2 | 1/2015 | Ions |
| 8,933,654 | B2 | 1/2015 | Chen |
| 8,937,446 | B2 | 1/2015 | Clothier |
| 9,124,200 | B2 | 9/2015 | Dai |
| 9,130,493 | B2 | 9/2015 | Chen |
| 9,157,219 | B2 | 10/2015 | Gibson |
| 9,169,843 | B2 | 10/2015 | Clothier |
| 9,410,442 | B2 | 8/2016 | Clothier |
| 9,410,553 | B2 | 8/2016 | Ions |
| 9,486,118 | B2 | 11/2016 | Courtney |
| 9,492,039 | B2 | 11/2016 | Courtney |
| 9,518,681 | B2 | 12/2016 | Williamson |
| 9,534,364 | B2 | 1/2017 | Hartley |
| 9,565,979 | B2 | 2/2017 | Maclaine |
| 9,624,940 | B2 | 4/2017 | Jones |
| 9,624,941 | B2 | 4/2017 | Dymond |
| 9,705,435 | B2 | 7/2017 | Dai |
| 9,742,318 | B2 | 8/2017 | Clothier |
| 9,742,319 | B2 | 8/2017 | Marvelly |
| 9,743,812 | B2 | 8/2017 | Courtney |
| 10,292,536 | B2 | 5/2019 | Hartdorn |
| 2004/0083546 | A1* | 5/2004 | Tahara ..... E03C 1/18 4/619 |
| 2008/0099046 | A1 | 5/2008 | Barnhill |
| 2010/0148971 | A1 | 6/2010 | Wawrla et al. |
| 2012/0186011 | A1 | 7/2012 | Wright |
| 2012/0291195 | A1 | 11/2012 | Courtney |
| 2012/0291303 | A1 | 11/2012 | Courtney |
| 2013/0340272 | A1 | 12/2013 | Courtney |
| 2014/0154966 | A1 | 6/2014 | Joynt |
| 2014/0366264 | A1 | 12/2014 | Ciavarella et al. |
| 2015/0052678 | A1 | 2/2015 | Bayley |
| 2015/0059085 | A1 | 3/2015 | Seibt |
| 2015/0376881 | A1 | 12/2015 | Moe |

FOREIGN PATENT DOCUMENTS

| | | | |
|---|---|---|---|
| CN | 102469896 | A | 5/2012 |
| CN | 203138266 | U | 8/2013 |
| CN | 103908183 | A | 7/2014 |
| CN | 205276391 | U | 6/2016 |
| CN | 205447915 | U | 8/2016 |
| CN | 205885360 | U | 1/2017 |
| EP | 2737836 | A2 | 6/2014 |
| EP | 2086696 | B1 | 10/2018 |
| TW | 201121483 | A | 7/2011 |
| WO | 9310311 | A1 | 5/1993 |

OTHER PUBLICATIONS

Chinese Office Action for Chinese Application No. 201880015159.7 dated Sep. 14, 2021.

Chinese Office Action from Chinese Patent Application No. 201880015159.7, dated Mar. 4, 2022, 14 pages. (including English Summary).

India Examination Report for India Patent Application No. 201927034500 dated Jan. 12, 2020.

International Search Report and Written Opinion re Application No. PCT/US18/20533; 8 pgs.

Chinese Office Action from Chinese Patent Application No. 201880015159.7, dated Jul. 4, 2022, 15 pages (including English Summary).

* cited by examiner

HANDWASHING STATION

CROSS-REFERENCE TO RELATED PATENT APPLICATIONS

This application is a continuation under 35 U.S.C. § 120 and 37 C.F.R. § 1.53(b) of U.S. patent application Ser. No. 16/894,488 filed Jun. 5, 2020, which is a continuation of U.S. patent application Ser. No. 15/909,641 filed Mar. 1, 2018, which claims the benefit of and priority to U.S. Provisional Patent Application No. 62/465,960, filed Mar. 2, 2017, U.S. Provisional Patent Application No. 62/473,542, filed Mar. 20, 2017, and U.S. Provisional Patent Application No. 62/487,098, filed Apr. 19, 2017, the entire disclosures of which are incorporated herein by reference.

BACKGROUND

The present invention relates generally to the field of handwashing stations for washing and drying hands. More specifically, the present application relates to handwashing stations intended for use within a bathroom or other environments where handwashing is commonly performed, including but not limited to a factory or a kitchen. Typically, bathrooms include a sink with a water faucet, a soap dispenser near the sink, and a hand drying device (e.g., an air blower or paper towel holder). Accordingly, the user uses three separate devices to wet their hands, apply soap to the hands, and dry their hands. Having three separate devices within the bathroom for washing and drying hands requires a relatively large amount of space. Furthermore, as the user moves between the three separate devices to wet, soap, wash, rinse, and dry their hands, water typically drips onto the surrounding countertop and/or floor. Additionally, users often do not wash their hands with soap and/or do not wash their hands for a long enough time for an adequate washing.

It would be advantageous to provide an improved system for facilitating the handwashing process that simplifies the process, consolidates certain functionality, and which is less space-intensive. These and other advantages of the system described herein will become apparent to those reviewing the present disclosure.

Additionally, the present application relates to a liquid dispenser (e.g., for use in plumbing applications such as faucets and sinks) that is intended to create laminar flow of a liquid. Typically, conventional liquid dispensers that create laminar flow are limited in how wide the liquid can flow out from the liquid dispenser. Furthermore, conventional liquid dispensers may rely on an aerator to create laminar flow. Additionally, the conventional liquid dispensers may create a certain amount of splash and the liquid flow may relatively opaque, which may be due to air within the liquid flow (which may be induced, for example, by the structure of the aerator through which the liquid flows).

It would be advantageous to provide an improved liquid dispenser that creates laminar flow that can flow more widely from the liquid dispenser, that reduces the amount of splash from the liquid, and that creates laminar flow that is relatively less opaque. These and other advantages of the liquid dispenser described herein will become apparent to those reviewing the present disclosure.

SUMMARY

An embodiment relates to a handwashing station that includes a basin, a liquid dispensing system, and an air dispensing system. The liquid dispensing system is configured to dispense a liquid into the basin to wash a user's hands. The air dispensing system configured to dispense air into the basin to dry the user's hands. The user can wet, wash, rinse, and dry their hands from within the basin.

Another embodiment relates to a method of handwashing a user's hands in a handwashing station. The method includes activating a liquid dispensing system, dispensing liquid into a basin with the liquid dispensing system to wash the user's hands, deactivating the liquid dispensing system, activating an air dispensing system, dispensing air into the basin with the air dispensing system to dry the user's hands, and deactivating the air dispensing system.

The foregoing summary is illustrative only and is not intended to be in any way limiting. In addition to the illustrative aspects, embodiments, and features described above, further aspects, embodiments, and features will become apparent by reference to the drawings and the following description.

BRIEF DESCRIPTION OF THE DRAWINGS

The accompanying drawings, which are included to provide further understanding of the concepts discussed herein, are incorporated in and constitute a part of this specification, and illustrate embodiments of the present disclosure and together with the detailed description serve to explain the principles of the present disclosure. No attempt is made to show structural details of the present disclosure in more detail than may be necessary for a fundamental understanding of the present disclosure and the various ways in which the concepts discussed herein may be practiced.

FIG. 65 is a cross-sectional view of the liquid dispensing assembly of FIG. 60 with side walls with liquid flowing through.

DETAILED DESCRIPTION

Before turning to the figures, which illustrate the various exemplary embodiments in detail, it should be understood that the present disclosure is not limited to the details or methodology set forth in the description or illustrated in the figures. It should also be understood that the terminology is for the purpose of description only and should not be regarded as limiting. An effort has been made to use the same or like reference numbers throughout the drawings to refer to the same or like parts.

Referring generally to the figures, disclosed herein are handwashing stations (as shown in FIGS. 1-43) and liquid dispensers (as shown in FIGS. 44-50), as shown according to various exemplary embodiments.

Handwashing Station

Figure 1:
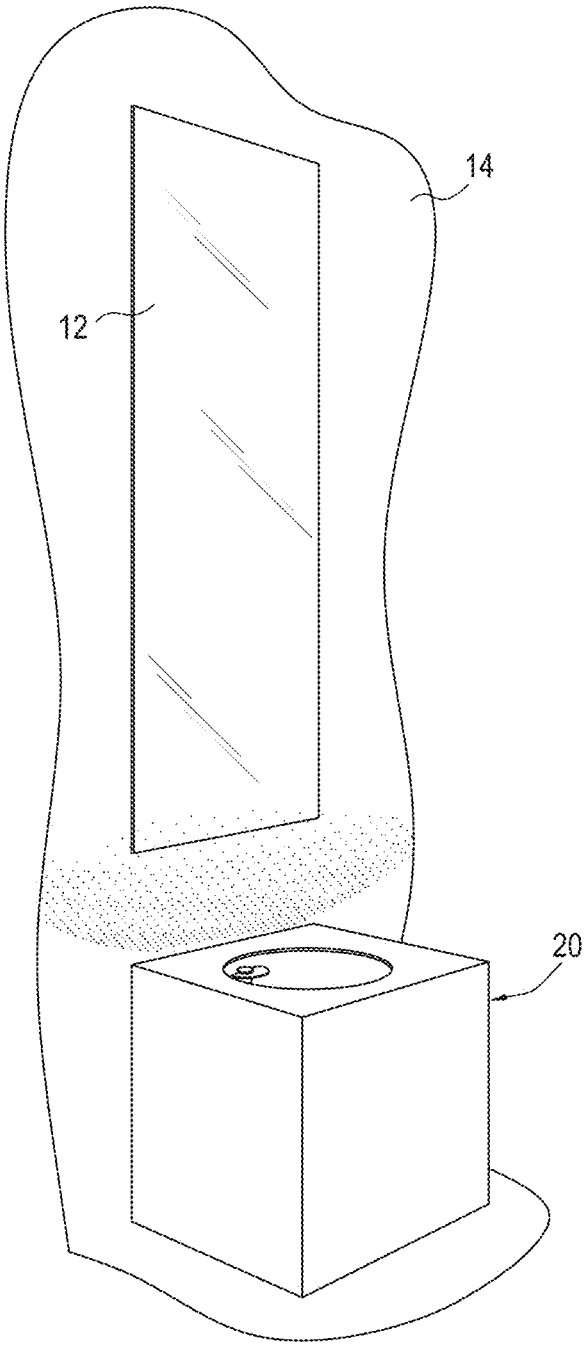
FIG. 1 is a perspective view of a handwashing station within a bathroom, according to one embodiment.
Figure 2:
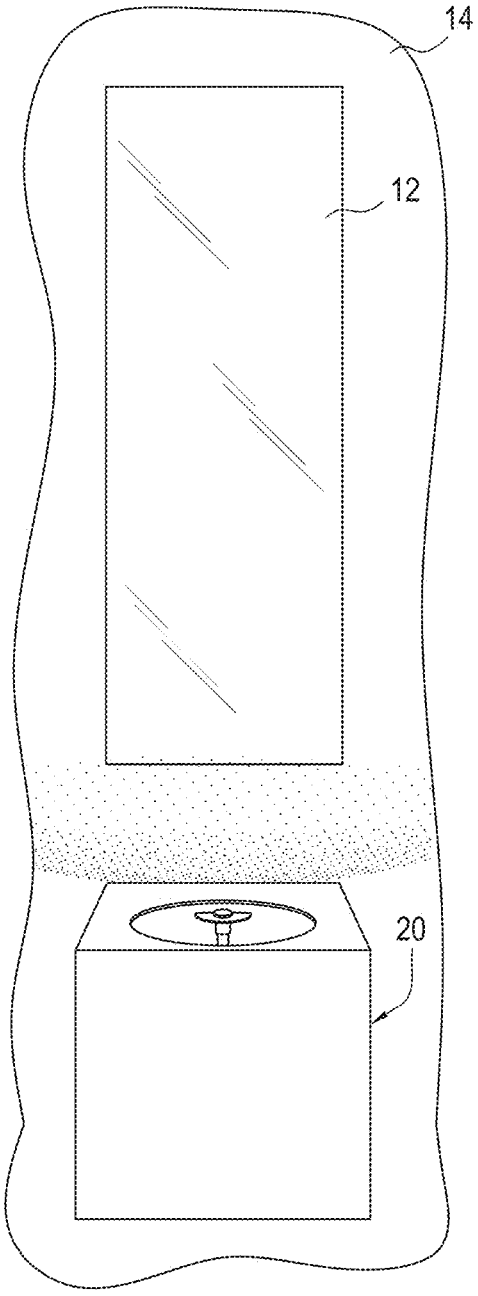
FIG. 2 is a front view of the handwashing station of FIG. 1.
Figure 3:
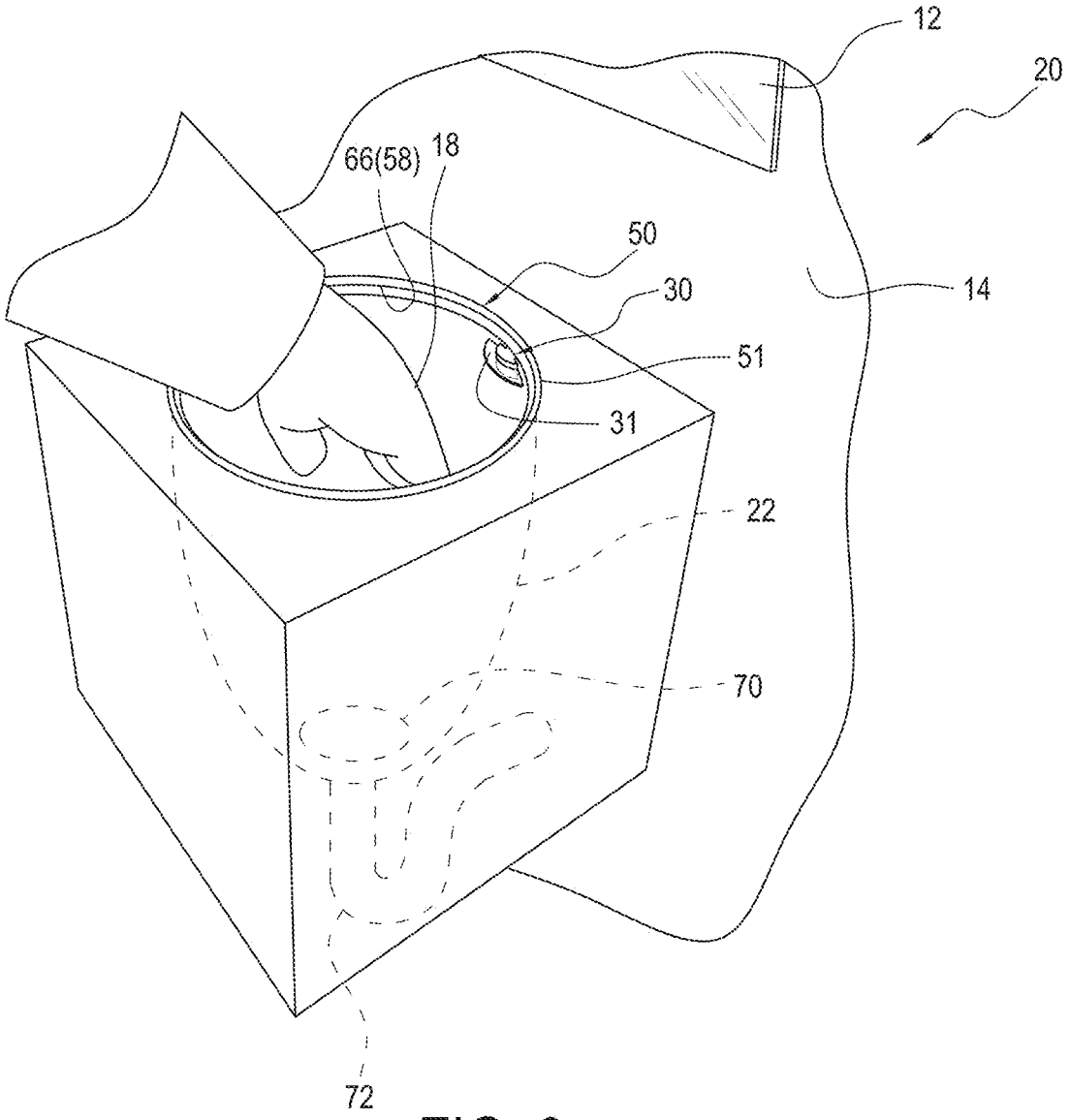
FIG. 3 is a perspective view of user using the a handwashing station of FIG. 1.

FIGS. 1-3 show a handwashing station 20 positioned within a bathroom along a wall 14 and beneath a mirror 12. The handwashing station 20 provides an area for the user to both wash and dry their hands by incorporating the entire handwashing process into the handwashing station 20 and automatically wets, cleans, and dries the user's hands 18 (as described further herein). As shown in FIG. 3, the handwashing station 20 provides an area for a user to wash (which may include wetting, soaping, and rinsing steps) and dry their hands 18 without leaving the handwashing station 20. Accordingly, the handwashing station 20 reduces the likelihood of water being dripped outside of the handwashing station 20 as the user washes and dries their hands 18. Additionally, the handwashing station 20 ensures that the user washes their hands 18 with soap 36 or a sanitizing liquid 38 (as shown and described further herein) and for a sufficient amount of time. Further, by consolidating washing and drying hands into an all-in-one single unit or device, the handwashing station 20 reduces the amount of required room for washing and drying hands 18 within a bathroom compared to the room required for conventional sinks, soap dispensers, and hand dryers, thereby freeing space within the bathroom.

Figure 4:
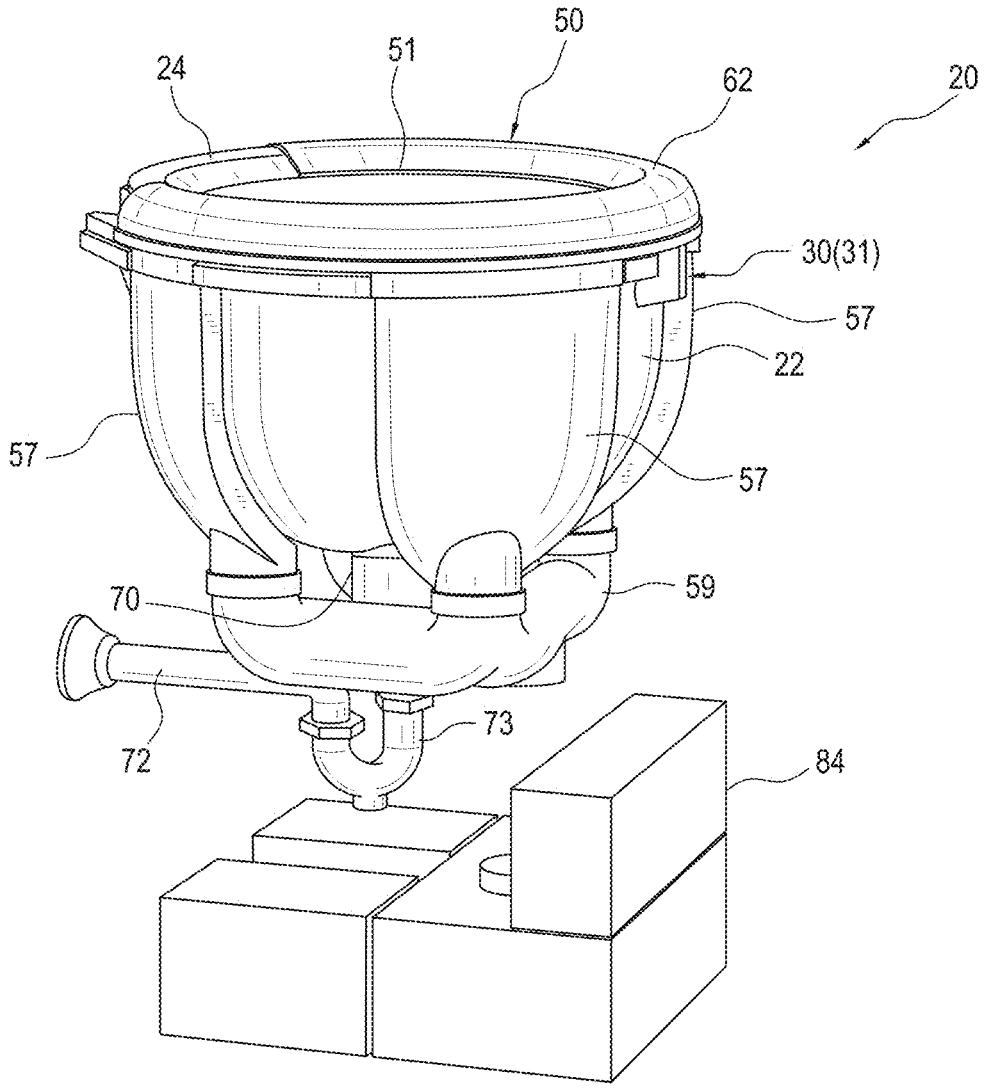
FIG. 4 is a cutaway, perspective view of a handwashing station according to one embodiment.
Figure 5:
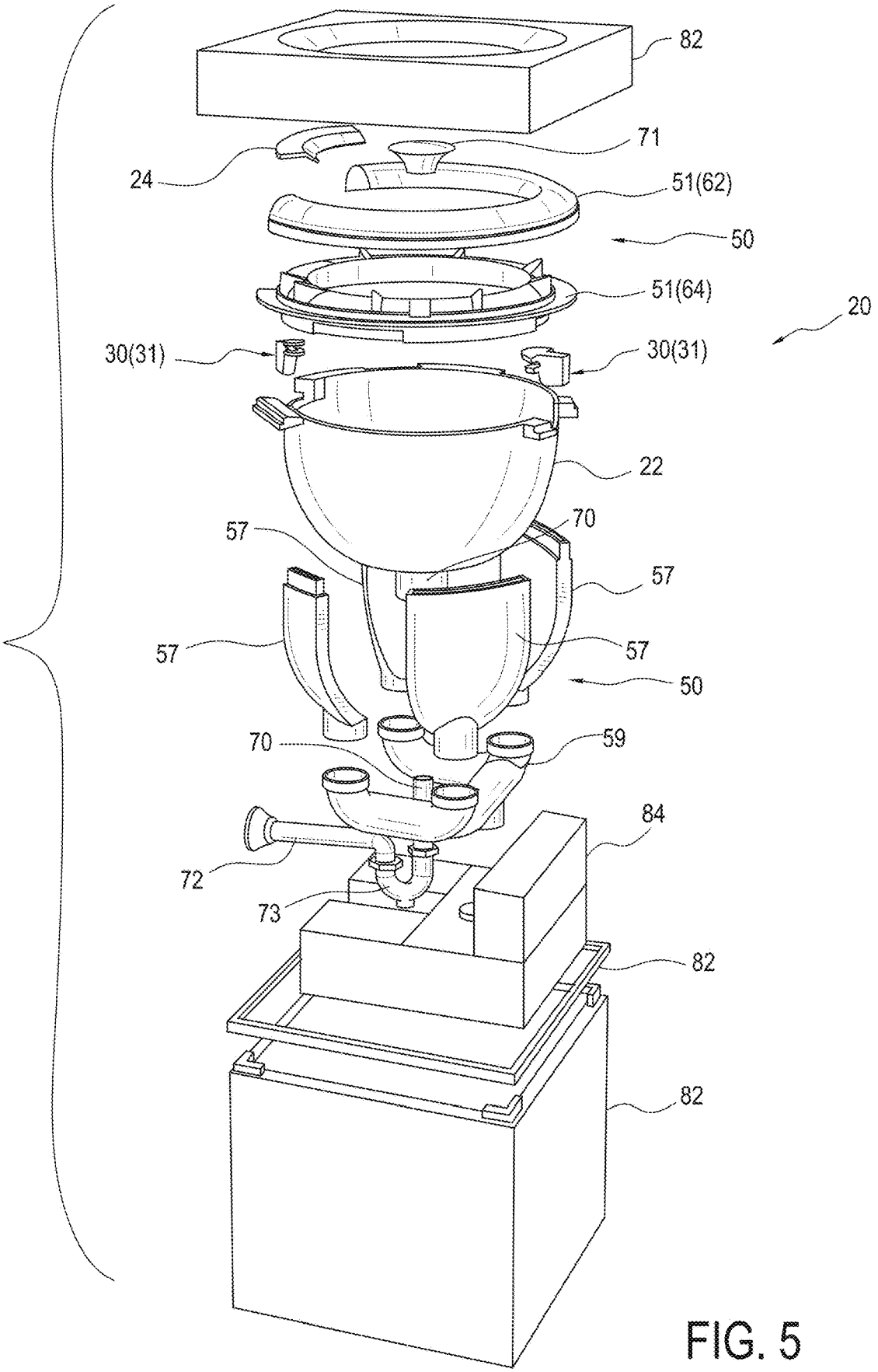
FIG. 5 is an exploded view of the handwashing station of FIG. 4.

As shown in FIGS. 4-5, the handwashing station 20 includes a variety of different components. For example, as described further herein, the handwashing station 20 includes a basin 22 for the user to wash and dry their hands 18 within (as shown in FIG. 3), a liquid dispensing system 30 configured to deliver and dispense liquid 32 (shown, for example, in FIG. 7) into the basin 22 to wash the user's hands, and an air dispensing system 50 configured to deliver and dispense air 52 (shown, for example, in FIG. 10) into the basin 22 to dry the user's hands such that the user can wet, wash, rinse, and dry their hands 18 from within the basin 22. Furthermore, since the liquid dispensing system 30 directs the liquid 32 toward a middle portion of the basin 22 and the air dispensing system 50 also directs the air 52 toward the middle portion of the basin 22, the user does not have to move their hands out of the middle portion of the basin 22 in order to wet, wash, rinse, and dry their hands 18.

According to one embodiment (as described further herein), the handwashing station 20 automatically wets the user's hands 18, soaps, cleans, or washes the user's hands 18 with soap, rinses the soap from the user's hands 18, and dries the user's hands 18. According to another embodiment (as described further herein), the handwashing station 20 automatically washes the user's hands 18 with a sanitizing liquid 38 and then dries the user's hands 18. By providing an automated method for washing and drying hands 18, the handwashing station 20 ensures that the user washes their hands 18 with soap or a sanitizing liquid and washes their hands 18 for a sufficient amount of time. Since the handwashing sequence (120) (as described further herein) of the handwashing station 20 is automated, the user does not need to touch any controls or portions of the handwashing station 20 during the process of washing and drying their hands.

The handwashing station 20 may optionally include any of the various features and configurations of the handwashing station 220 or 320, (as described below), according to the desired configuration.

Basin

As shown in FIG. 3, the handwashing station 20 includes a lavatory bowl, sink, or basin 22 in which the user can wet their hands 18 with a liquid 32 (e.g., water 34), wash their hands 18 with a liquid 32 (e.g., soap 36 or a sanitizing liquid 38), rinse their hands 18 with a liquid 32 (e.g., water 34), and/or dry their hands 18 with air 52 within (as shown in subsequent figures, such as FIGS. 19-24). Accordingly, the entire handwashing process (and the entire handwashing sequence (120), as described further herein) occurs inside of the basin 22, which prevents liquid 32 from dripping outside of the basin 22 (such as onto the floor 15 or the counter 16 (the floor 15 and the counter 16 are shown in subsequent figures)) and provides a more compact and consolidated handwashing process. The basin 22 may optionally include any of the various features and configurations of the basin 222 or 322 (as described below), according to the desired configuration.

Due to the shape of the basin 22 as shown in FIGS. 4-5, the basin 22 is configured to contain liquid 32 used to wash the user's hands, help prevent the liquid 32 from splashing out of the basin 22, and direct air 52 downward into the basin 22 to dry the user's hands. Due to the automatic cleaning process, the basin 22 may also be configured to be self-cleaning.

The basin 22 may be constructed out of a variety of different materials, including but not limited to stainless steel, ceramic, or solid surface material. According to other exemplary embodiments, the basin may be formed from a vitreous china material, a metal, a polymeric material, a composite material, a ceramic-coated aluminum, or any other desired material. The basin 22 may optionally include an overflow drain.

As shown in FIGS. 3-5, the bottom portion of the basin 22 includes a drain 70 to drain liquid 32 and air 52 (as shown in subsequent figures) through the bottom portion of the basin 22. The drain 70 continually allows liquid 32 and air 52 to drain passively, immediately, and continually. Plumbing 72 may be attached to the drain 70 beneath the basin 22 to allow the liquid 32 and the air 52 to be completely evacuated from the basin 22. The plumbing 72 may include a p-trap 73.

As shown in FIG. 5 (as well as FIG. 13), the handwashing station 20 may include a drain cover 71 within the basin 22 to cover the drain 70 in order to prevent items from falling down the drain 70 and to allow the user to stop the drain 70, if desired. The drain cover 71 may optionally include lighting to illuminate the bottom, inner portion of the basin 22. The drain 70, the drain cover 71, and the plumbing 72 may optionally include any of the various features and configurations of the drains 370, the drain cover 371, and the plumbing 372 (as described further herein), according to the desired configuration.

Optionally, the handwashing station 20 may include at least one fluid outlet vacuum to capture and actively drain the liquid 32 and the air 52 through the drain 70 and to further facilitate airflow by drawing the air 52 (and any residual liquid 32) downward toward the drain 70 of the basin 22. Accordingly, the air 52 (and the liquid 32) is prevented from being blown or splashed upward toward the user and out of the top of the basin 22.

Liquid Dispensing System

As shown in FIGS. 6-9 (as well as FIGS. 18-21 and 23), the handwashing station 20 includes a liquid dispensing system 30 that includes at least one liquid dispenser 31 that is configured to dispense liquid 32, such as the water 34, the soap 36, and/or the sanitizing liquid 38, into the basin 22 in order to wet, wash, and/or rinse the user's hands 18. Since the water 34, the soap 36, and/or the sanitizing liquid 38 are dispensed directly into the basin 22 through the at least one liquid dispenser 31 (as shown in FIGS. 18-21 and 23), the user does not have to move their hands 18 to a separate location outside of the basin 22 during the handwashing process (to obtain soap or sanitizing liquid, for example), which acts to reduce the likelihood that the liquid 32 will be dripped outside of the basin 22. Additionally, since the liquid dispensing system 30 dispenses liquid into the middle area of the basin 22 and the air dispensing system 50 (as described further herein) also dispense air into the middle area of the basin 22, the user can leave their hands in the middle area of the basin 22 to wet, wash, rinse, and dry their hands 18 and does not have to move their hands 18 to different locations (within the basin 22 or outside of the basin 22).

Figure 6:
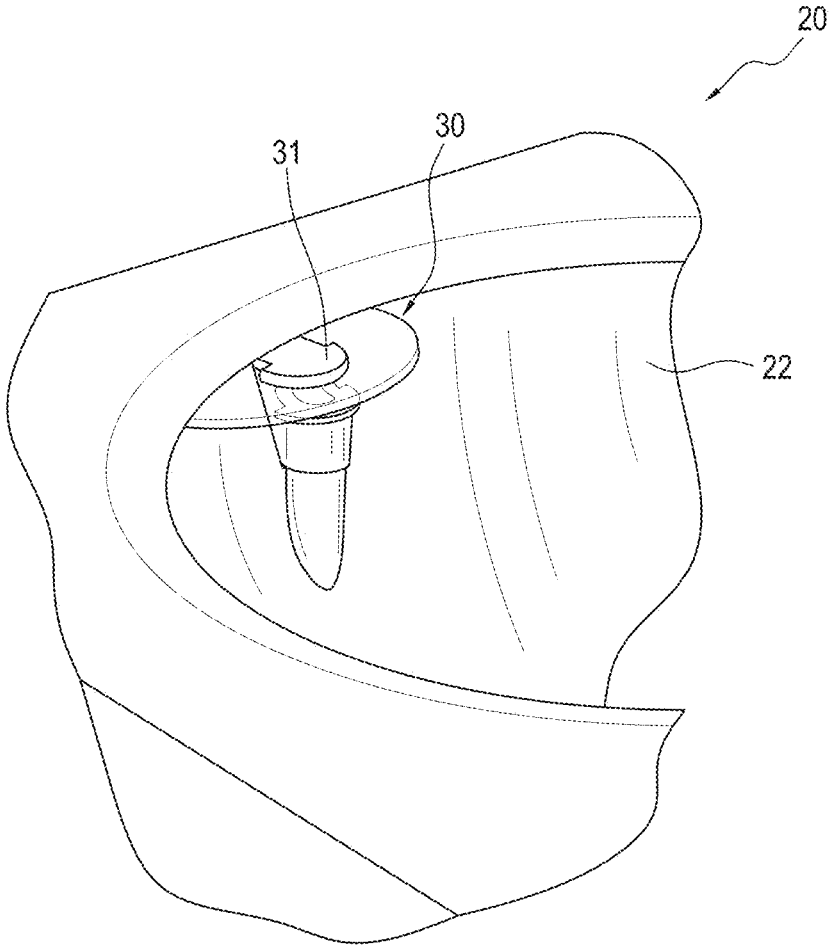
FIG. 6 is a perspective view of a liquid dispenser positioned within the handwashing station of FIG. 1.

FIG. 6 shows one configuration of the liquid dispenser 31 of the liquid dispensing system 30 that is configured to fan the liquid 32 into or as a flat spray. The liquid dispensing system 30, the liquid dispenser 31, and the liquid 32 (including the water 34, the soap 36, and the sanitizing liquid 38) may optionally include any of the various features and configurations of the liquid dispensing system 230 or 330, the liquid dispenser 231 or the water dispenser 331, and the liquid 232 or the water 334 and soap 336 (as described below), respectively, according to the desired configuration.

Figure 7:
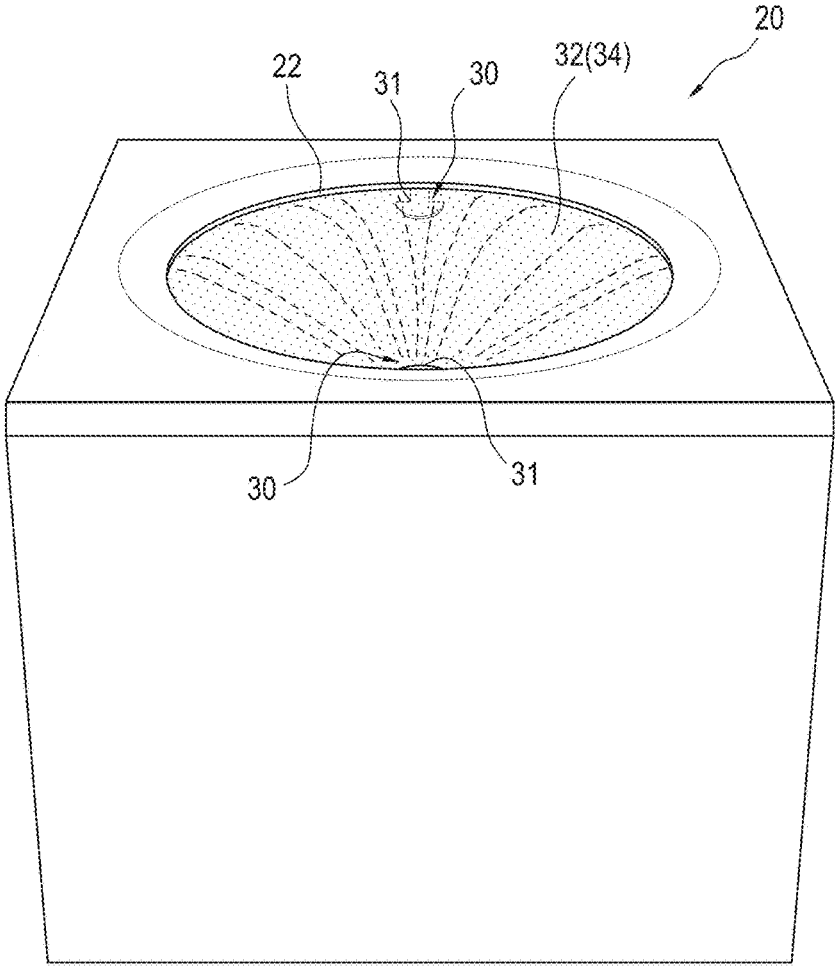
FIG. 7 is a front view of liquid flowing within the handwashing station of FIG. 1.
Figure 8:
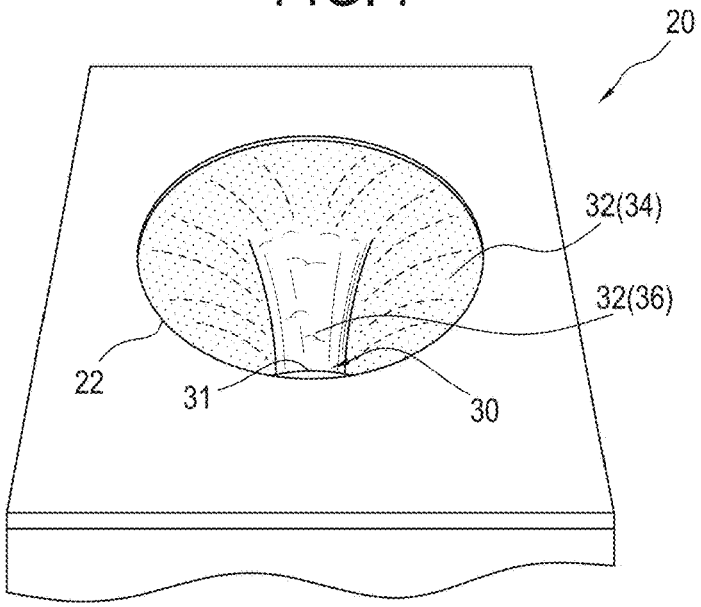
FIG. 8 is a perspective view of soap and water being dispensed into the handwashing station of FIG. 1.
Figure 9:
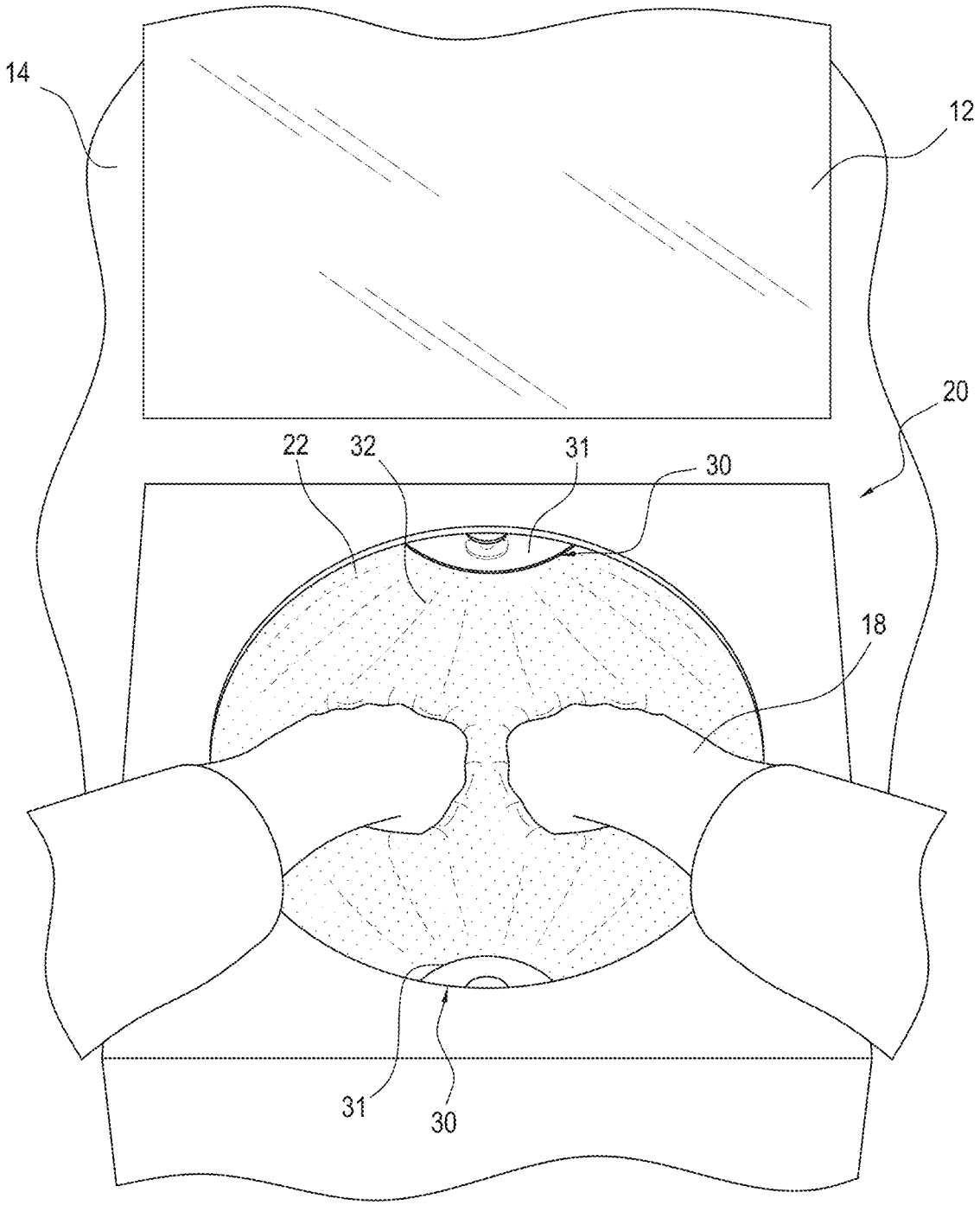
FIG. 9 is a top view of a user placing their hands within the handwashing station of FIG. 1.

As shown in FIGS. 7-9, the liquid dispenser(s) 31 are configured to spray the liquid 32 as a flat spray in order to immerse the user's hands 18 in the liquid 32 to give the user an experience similar to washing or dipping their hands 18 into a river. More specifically, as shown in FIGS. 7-8, the liquid dispenser(s) 31 spray or dispense liquid 32 as a fan or sheet of liquid 32 flowing within the basin 22 and across the width of the basin 22 such that the entire opening at the top of the basin 22 is traversed by a sheet of flowing liquid 32 and the user's hands 18 are immersed in liquid 32 (as shown in FIG. 9).

The flow of liquid 32 may be laminar or a flow that is not turbulent in order to further prevent water from being splashed out of the basin 22 and onto surrounding areas, like the counter 16 or floor 15. A variety of different spray technologies and spray types may be used. According to one embodiment, the liquid dispensers 31 is configured to dispense the liquid 32 such that the liquid 32 flows as a substantially flat, laminar layer or fan of water or a thin, laminar, water layer that is a "waterfoil" that substantially extends across the entirety of a top opening of the basin 22 and for better coverage along the user's hands 18. According to another embodiment, the liquid dispensers 31 may each include multiple jets or nozzles that direct the liquid 32 into multiple different streams extending within the basin 22. Multiple liquid dispensers 31 may be positioned relative to each other about the inside or top of the basin 22 to create a variety of different spray patterns of liquid 32 that provide laminar flow, including matrices or crisscross patterns.

The handwashing station 20 may have one liquid dispenser 31 (as shown in FIG. 8) or multiple liquid dispensers 31 (i.e., two liquid dispensers 31, three liquid dispensers 31, etc.) positioned in different areas within the basin 22. According to one embodiment as shown in FIG. 7, the handwashing station 20 has two liquid dispensers 31 positioned along opposite sides of the basin 22 that direct the liquid 32 in two different directions from either side of the basin 22. By positioning the liquid dispensers 31 along different areas within the basin 22 (such as opposite sides, for example), all sides of the user's hands are completely covered in liquid 32 (thus allowing the user to wet and rinse off their hands more quickly) without causing the liquid to splash out of the basin 22. According to one embodiment, one of the liquid dispensers 31 may be positioned within the basin 22 along the user side 23 and the other liquid dispenser 31 may be positioned within the basin 22 along the wall side 21. However, the liquid dispensers 31 can be positioned anywhere within the basin 22 (in particular along the top portion of the basin 22) and therefore could be positioned on the right and left sides of the basin 22. The flow rates through the various liquid dispensers 31 may be the same or may be different from each other, according to the desired configuration and to meet any water usage regulations, requirements, or restrictions.

The liquid dispensers 31 can be positioned at the same level or height within the basin 22 or at different levels or heights. According to one embodiment (as shown in FIG. 7, as well as FIGS. 21 and 23), the liquid dispensers 31 are positioned at different levels or heights within the basin 22 in order to spray liquid 32 at the same time in two different layers (i.e., a first liquid layer at a higher level and a second liquid layer at a lower level). According to another embodiment (see FIGS. 77-79, for example), the liquid dispensers 31 are positioned at the same level or height within the basin 22 in order to spray liquid 32 at the same time and towards each other at substantially the same level. Accordingly, liquid 32 from liquid dispensers 31 at the same level may collide into each other in approximately the middle of the basin 22 during use.

The liquid dispensers 31 may be constructed out of a variety of different materials, including but not limited to plastic. The liquid dispensers 31 may allow the liquid 32 to flow in a variety of different rates, such as approximately 2 gallons per minute (gpm), 1.7 gpm, or 0.5 gpm, depending on the desired configuration.

The liquid dispensing system 30 may include a water mixer in order to mix hot and cold water 34 to the desired temperature and a thermostat to ensure that the correct temperature of water 34 is being dispensed.

Air Dispensing System

Figure 10:
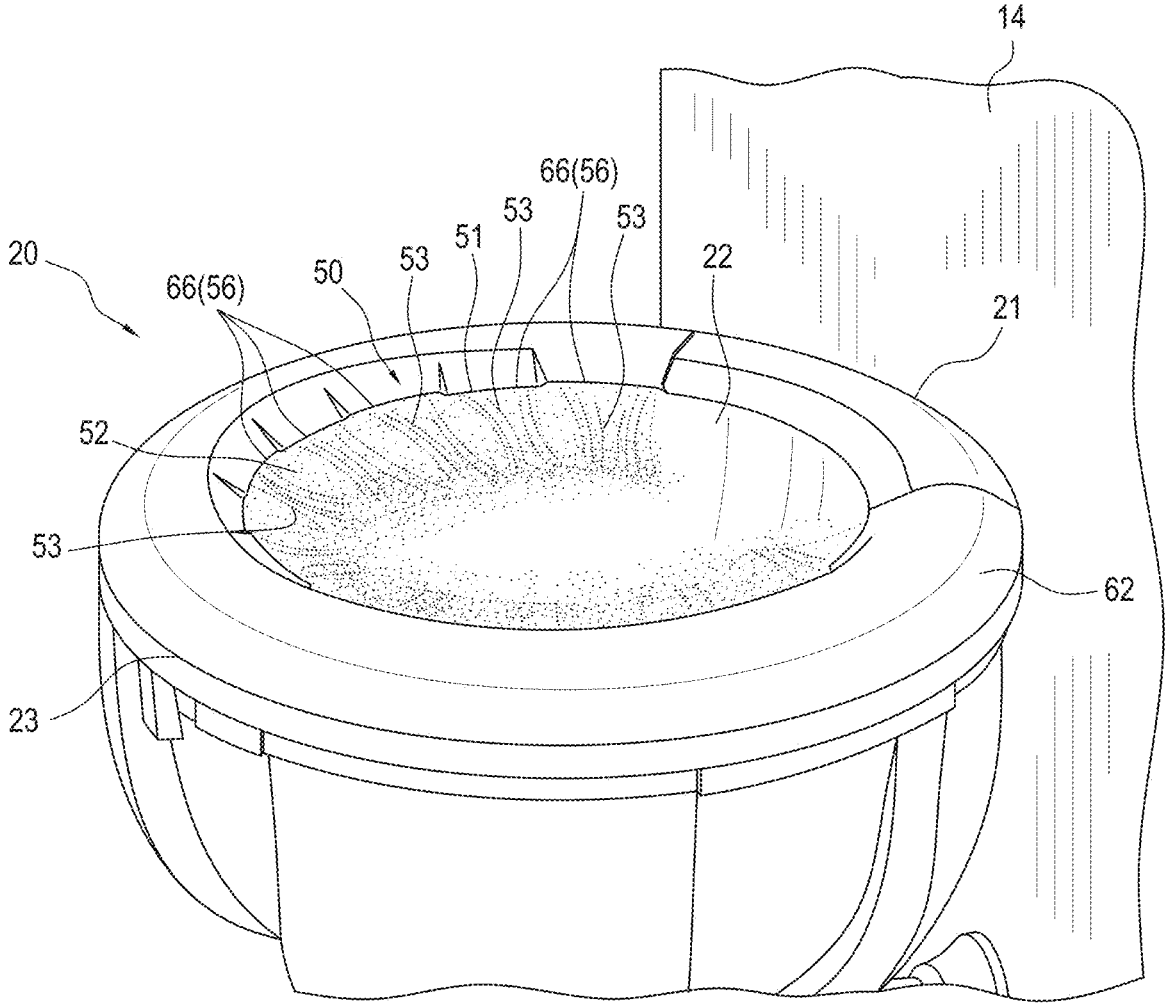
FIG. 10 is a perspective view of a handwashing station with an air dispensing system according to one embodiment.

Once the liquid 32 is no longer being dispensed from the liquid dispensing system 30 and the flow of liquid 32 stops (i.e., after the hands have been washed and optionally rinsed), as described further herein, the handwashing station 20 blows out air 52 in order to dry the user's hands 18, as shown in FIG. 10. Accordingly, as shown in FIGS. 10-16, the handwashing station 20 includes a hand dryer or air dispensing system 50 that includes at least one air blade, air outlet, or air dispenser 51 that is configured to blow at least one stream of air 52 (as shown in FIG. 10) into the basin 22 to dry the user's hands 18. As shown in FIG. 10, the air dispenser 51 may be positioned at the top or opening of the basin 22. The air dispensing system 50, the air dispenser 51, and the air 52 may optionally include any of the various features and configurations of the air dispensing system 350, the first and second air dispensers 351 and 353, and the air 352 (as described below), respectively according to the desired configuration.

According to one embodiment, the air dispenser 51 angles the air 52 downward toward the drain 70 positioned along a bottom portion of the basin 22 in order to direct air 52 at a downward angle further into the basin 22 and toward the drain 70. The air dispenser 51 is positioned at least partially within the basin 22 or directs the air 52 into the basin 22. This configuration also prevents the air 52 from blowing up toward the user and from splashing liquid 32 up toward the user and/or out of the basin 22, thereby preventing the handwashing station 20 from creating a dirty or wet environment within the bathroom and the area surrounding the handwashing station 20. However, according to various other embodiments, the air dispenser 51 may dispense the air 52 in a substantially horizontal manner or may angle the air 52 upward, depending on the desired configuration.

Due to the configuration of the air dispenser 51, the air 52 flows downwardly into the basin 22 from the air dispensers 51, and the air 52 does not bounce off of the hands 18 up toward the user as the air 52 flows into the basin 22. The air dispensing system 50 may dispense the air 52 such that the highest pressure of the air 52 is along and through the air dispensers 51.

The air dispensing system 50 may include multiple air dispensers 51 along the perimeter of the basin 22 or one air dispenser 51 that extends around the entire perimeter of the basin 22. This configuration directs air 52 completely around the user's hands 18 (i.e., at 360°), which dries the user's hands 18 more quickly.

Figure 11:
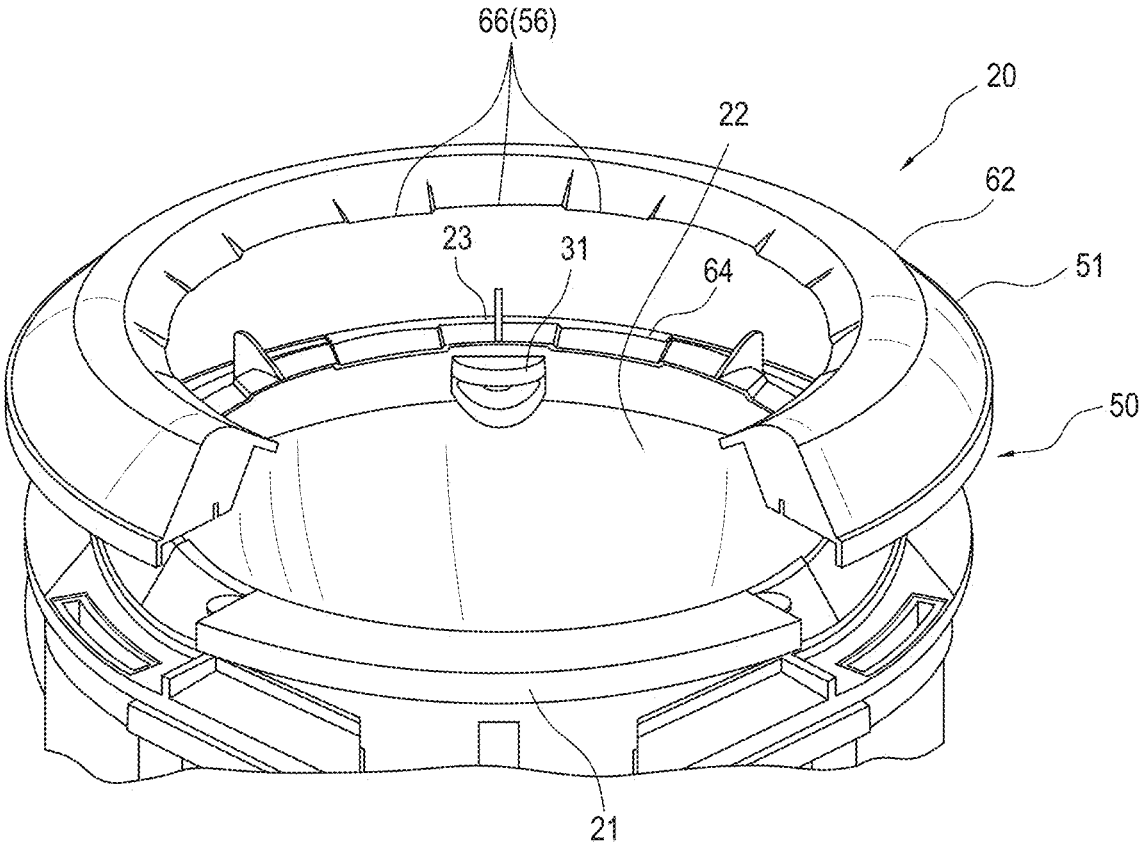
FIG. 11 is an exploded view of the handwashing station of FIG. 10.
Figure 12:
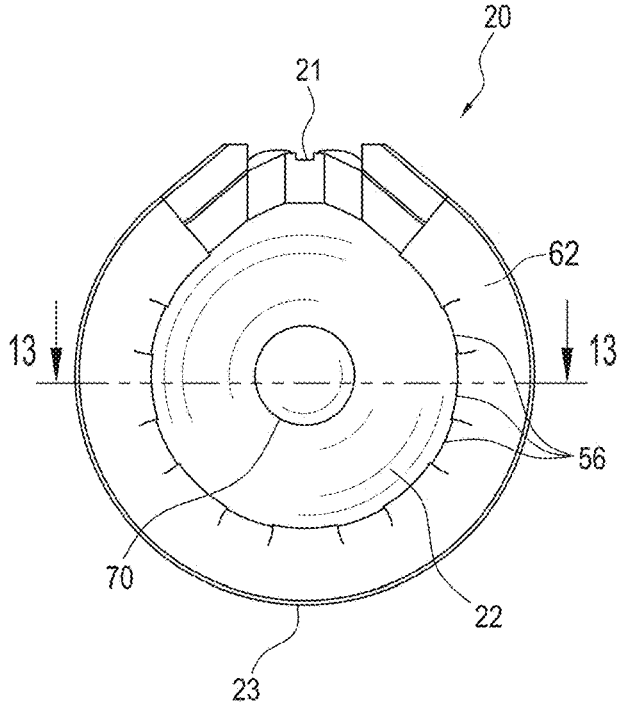
FIG. 12 is a top view of the handwashing station of FIG. 10.
Figure 13:
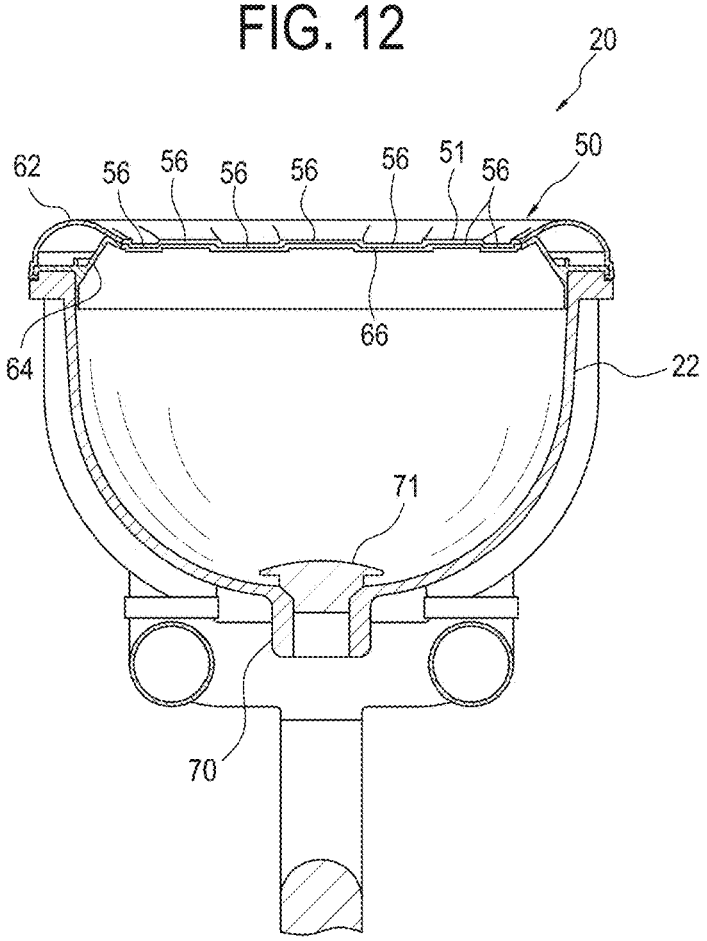
FIG. 13 is a cross-sectional view through Section 13-13 of FIG. 12.
Figure 14:
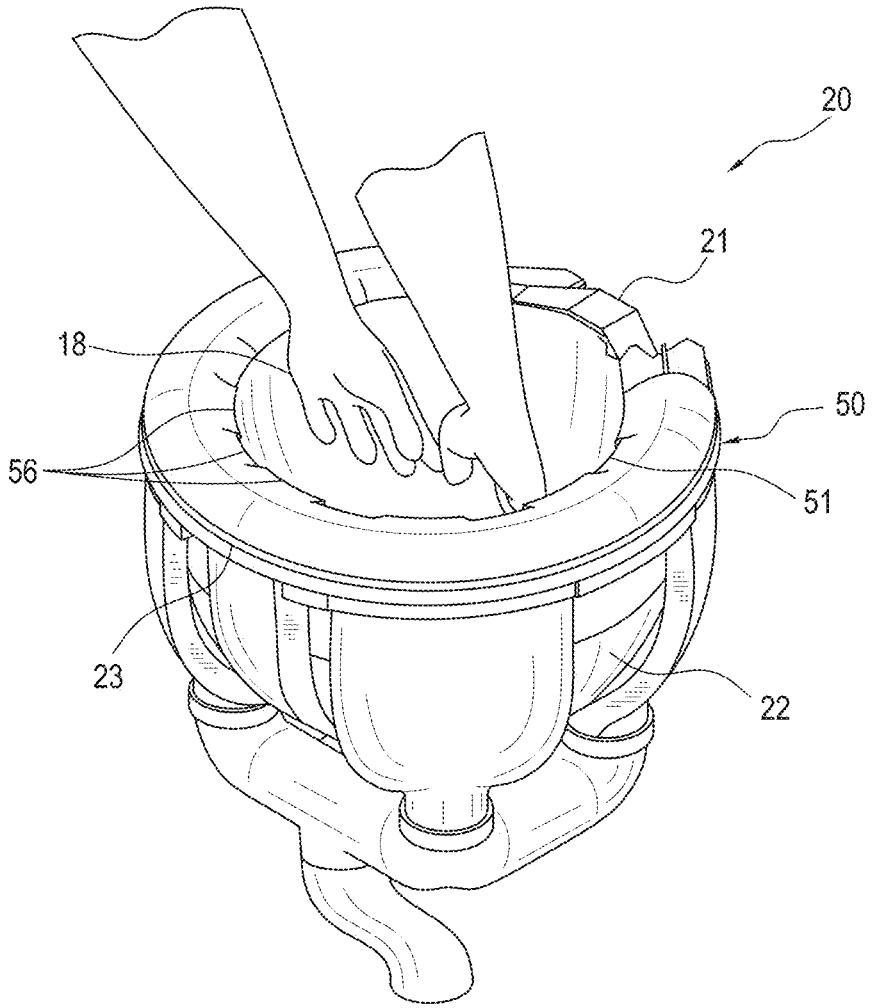
FIG. 14 is a perspective view from the user side of the handwashing station of FIG. 10 with hands.

As shown in FIGS. 11 and 13 (in view of FIG. 12), the air dispenser 51 includes an upper layer or component 62 and a lower layer or component 64. The upper component 62 is positioned on top of the lower component 64 with a small slit, slot, or gap 66 extending between the upper component 62 and the lower component 64 such that air 52 can flow between the upper component 62 and the lower component 64 into the basin 22. The gap 66 may be a variety of different sizes according to the desired air pressure, volume of air 52 to be dispensed, and noise level. For example, the gap 66 may be approximately 0.5 millimeters (mm) or 0.9 mm. As described further herein, the air dispensing system 50 may have a variety of different configurations. It is understood that the air dispensing system 50 may have any combination of the various configurations.

According to one embodiment as shown in FIGS. 11-14, the air dispensing system 50 extends around only a portion of the perimeter of the basin 22. Accordingly, the air dispenser 51 extends only partially around the inner perimeter of the top, opening, or rim of the basin 22 in a substantially U-shape. The air dispenser 51 may extend continuously in different amounts around the inner perimeter of the basin 22 such as between approximately 50% to 90% of the inner perimeter or approximately 75% of the inner perimeter. Accordingly, the air dispenser 51 may extend continuously around approximately ¾ of (or 270° around) the inner perimeter of the basin 22. By extending around only a portion of the inner perimeter of the basin 22, the air dispenser 51 prevents air 52 (and any residual liquid 32) from bouncing off of the user's hands 18 and up toward the user (e.g., to the user's head or the rest of the user's body).

The air dispenser 51 is positioned such that the portion of the inner perimeter of the basin 22 that the air dispenser 51 does not extend along is along the wall side 21 of the basin 22. The air dispenser 51 can be positioned, however, to extend along the user side 23 of the basin 22 as well as other portions of the basin 22. Accordingly, the air dispenser 51 does not blow air 52 onto the upper sides of the hands 18 during the drying process, which prevents air 52 from bouncing up out of the basin 22 and toward the user.

However, according to another embodiment, the air dispenser 51 may extend completely around the entire inner perimeter of the top, opening, or rim of the basin 22. Accordingly, if the basin 22 has a circular cross-section, the air dispenser 51 extends around in a circle (e.g., is circular). It is noted that, although the air dispenser 51 is show in a circular (or partially circular) configuration, the air dispenser 51 can be any variety of different shapes.

According to one embodiment as shown in FIGS. 11-14, the gap 66 of the air dispenser 51 of the air dispensing system 50 includes multiple substantially horizontal corrugated slots 56 along the length of the air dispenser 51 (as shown in FIG. 13) such that air 52 is dispensed in different positions or levels (e.g., height and/or angle). The corrugated slots 56 are staggered, offset, or corrugated from each other such that the air dispenser 51 dispenses air 52 into different sections, steps, or streams 53 of air 52 (as shown in FIG. 10) that are in at least two different positions (e.g., levels (heights) or angles). Each of the corrugated slots 56 is offset up or down (vertically and/or angularly) from its neighboring corrugated slots 56 such that the air 52 is dispensed from each of the corrugated slots 56 in different height or angular positions (relative to neighboring corrugated slots 56). The air dispenser 51 can be configured such that there are no gaps between each of the streams 53 of air 52.

Each of the corrugated slots 56 may be fluidly continuous along the length of the air dispenser 51 (as shown in FIG. 13) or may be fluidly separate from each other with, for example, a vertical divider between each of the corrugated slots 56 in order support the structure of the air dispenser 51.

Each of the corrugated slots 56 is positioned at a different height and/or angle (compared to its neighboring corrugated slots 56 on either side) in order to stagger each of the streams 53 of air 52 according to their height and/or angle. Although the corrugated slots 56 can be positioned in a variety of different angles, every other corrugated slots 56 can be positioned at approximately 40° downward (relative to the vertical axis) and each of the other corrugated slots 56 positioned therebetween can be offset at approximately 3-5° from the 40°. Although two positions are shown, it is understood that the corrugated slots 56 can be positioned in any number of positions (heights and/or angles).

Each of the corrugated slots 56 can have a variety of different dimensions. According to one embodiment, the length of the corrugated slots 56 is approximately 1 to 1.25 inches, although it is understood that the corrugated slots 56 can have a variety of different lengths and that each of the corrugated slots 56 can be the same length or different lengths.

Since the air 52 is dispensed along different heights and/or angles from each of the corrugated slots 56 along the length of the air dispenser 51, the streams 53 of air 52 are staggered (as shown in FIG. 10) and the air pressure of the air 52 is maintained for longer as the air 52 flows further from the air dispenser 51 within the basin 22 and the streams 53 of air 52 can be more laminar with less air turbulence. For example, as the air 52 flows out from the air dispenser 51, the air 52 expands and dissipates in all directions as the air pressure reduces. By spacing out the air 52 into streams 53 in different positions (e.g., heights and/or angles), each of the streams 53 of air 52 do not have to fight air turbulence from nearby streams 53 of air 52 as the streams 53 of air 52 expand. Instead, the streams 53 of air 52 have room to dissipate and expand outward without losing energy by being disrupted by or disrupting the air pressure of the neighboring streams 53 of air 52, which helps maintain the air pressure of each of the streams 53 of air 52 for longer (compared to when all of the air 52 is dispensed at the same height and angle).

The corrugated slots 56 (as shown in FIG. 10) allow the air dispenser 51 to maintain air pressure of the air 52 for longer. Accordingly, the air dispenser 51 of the embodiment of FIG. 10 (i.e., with corrugations) has a wider area of high air pressure compared to the air dispenser 51 of the embodiment of FIG. 15 (i.e., with no corrugations) (as described further herein).

Figure 15:
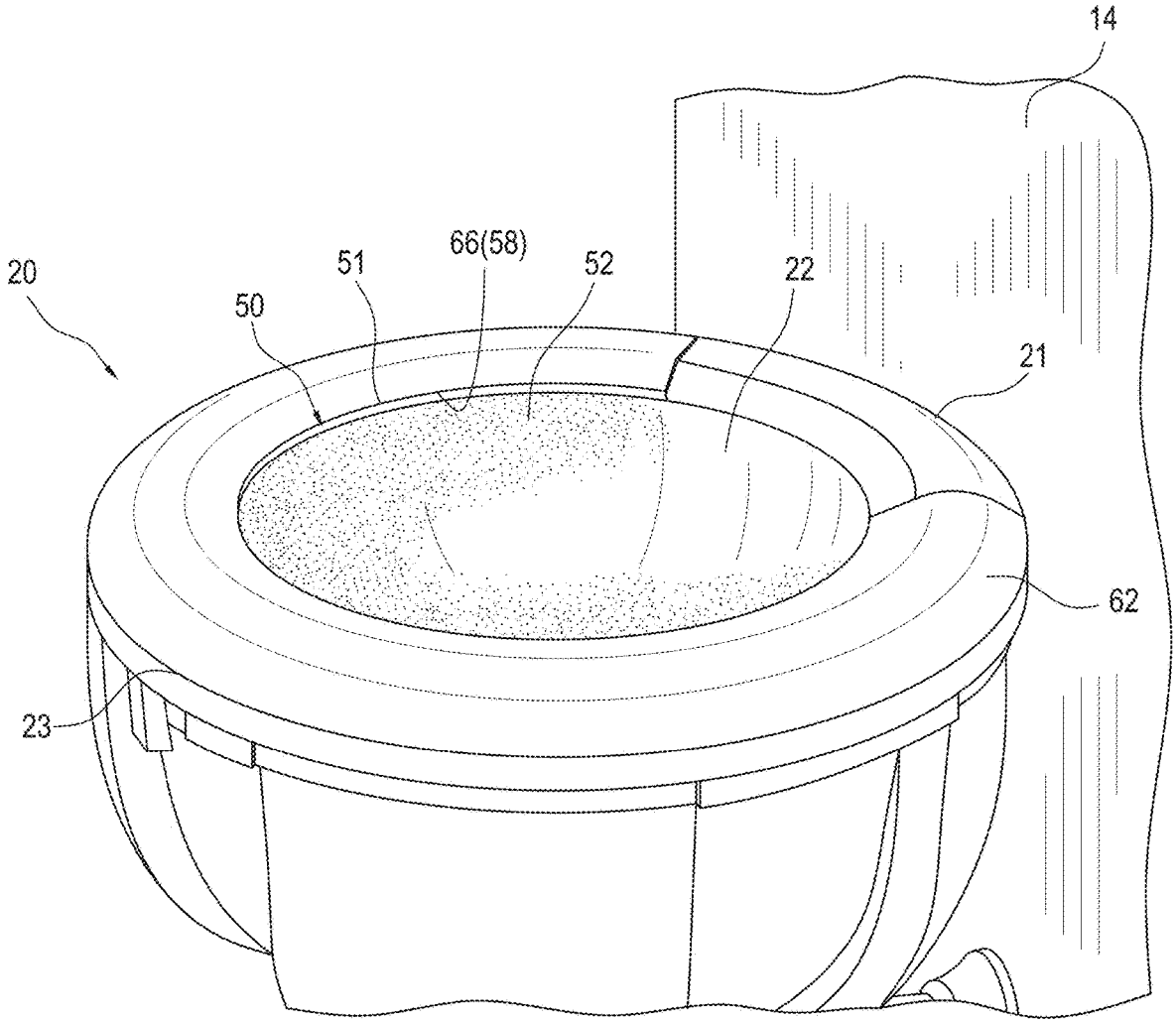
FIG. 15 is a perspective view of a handwashing station with an air dispensing system according to another embodiment.

According to another embodiment as shown in FIG. 15, the gap 66 of the air dispenser 51 of the air dispensing system 50 is one level slot 58 that dispenses air 52 in a single level or position (i.e., height and angle) around the inner perimeter of the basin 22. Alternatively, the air dispenser 51 may have multiple level slots 58 that are all at the same height and angle such that all of the air 52 is dispensed at the same height and angle.

Each of the embodiments of the air dispensing system 50 quickly dries the user's hands 18 and captures the liquid 32 from the hands 18. Furthermore, each of the embodiments of the air dispensing systems 50 is used with a basin 22 that includes a drain 70 at the bottom of the basin 22. Accordingly, rather than pooling or dripping onto the floor 15, the liquid 32 from the hands 18 is captured, removed, and drained from the bathroom through the drain 70 as the air dispensing system 50 dries off the user's hands 18. Each of the embodiments of the air dispensing system 50 may be used with the rest of the handwashing station 20 or as a stand-alone air dispensing system 50 (and optionally with a conventional water dispenser and/or soap dispenser).

The various configurations (e.g., the U-shape of the air dispenser 51 and/or the corrugated slots 56) allow the air dispensing system 50 to dry the hands 18 faster than conventional hand dryers. For example only, due to the configuration of the handwashing station 20 and the air dispensing system 50, the air dispensing system 50 may dry hands 18 in approximately 7-12 seconds. Additionally, the shape of the basin 22 (e.g., the half-spherical shape of the basin 22) may further help expedite the hand drying process. Due to the shape the basin 22, the basin 22 may capture more of the air 52 within the basin 22 as the air 52 is being dispensed from the air dispenser 51. While the air 52 is within the basin 22, the air 52 may bounce from the hands 18 to the inner surface of the basin 22 and back to the hands 18 before losing significant air pressure, which exposes the hands 18 to more air flow and allows the hands 18 to be dried even faster. The half-sphere shape of the basin 22 with tangent geometry may increase the amount that the air 52 bounces between the sides of the basin 22 and the hands 18 to allow the hands 18 to be dried faster.

Figure 16:
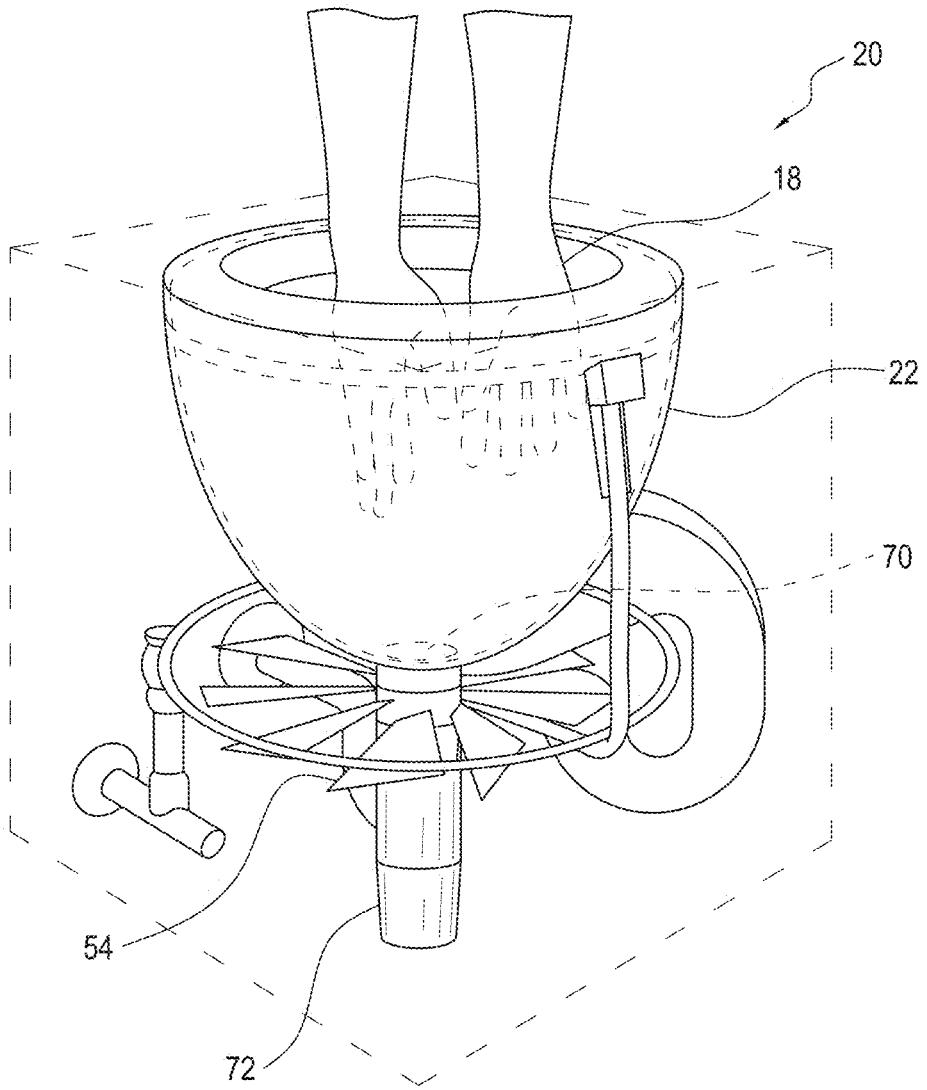
FIG. 16 is a partially transparent, perspective view of a handwashing station according to another embodiment.

In order to provide air flow through the air dispenser 51, the air dispensing system 50 may include an air dryer or blower, such as a circular air blade or fan assembly 54 with a blower motor, as shown in FIG. 16, that directs air 52 toward and through the air dispenser 51. The air fan assembly 54 may be positioned beneath the basin 22 such that air 52 is directed up around the outside of the basin 22, through the air dispenser 51, downward inside of the basin 22, and optionally through the drain 70. The air fan assembly 54 may be constructed out of a variety of different materials, including but not limited to plastic. Depending on the desired configuration, alternatively or additionally, other blower types and configurations may be used with the handwashing station 20.

The air dispensing system 50 may include air tubing 59 and at least one air duct or channel 57 to direct the air 52 from the fan assembly 54 to the air dispenser 51 to be dispensed into the basin 22 (see, for example, FIGS. 4-5). The air tubing 59 may be positioned beneath the basin 22 and the air channel(s) 57 may be positioned around and along the outside of the basin 22. According to one embodiment, the air tubing 59 may direct the air 52 into four separate air channels 57 that direct the air 52 into the air dispenser 51. However, it is understood that the air dispensing system 50 may have any number of air channels 57. The air channels 57 may optionally include any of the various features and configurations of the air channels 357 (as described further herein), according to the desired configuration.

The dispensed air 52 may be room temperature or may be heated or hot air in order to speed up the drying process. The air 52 may optionally be filtered through high-efficiency particulate air (HEPA) that is filtered (before being dispensed) through a HEPA filter.

The air dispensing system 50 may be configured to dispense air 52 relatively quietly from the handwashing station 20. For example, the air dispensing system 50 may dispense air 52 at approximately 70 decibels (dB) or less.

The air dispenser 51 may be constructed out of a variety of different materials, including but not limited to plastic (e.g., nylon) or stainless steel.

Hand Washing

Figure 21:
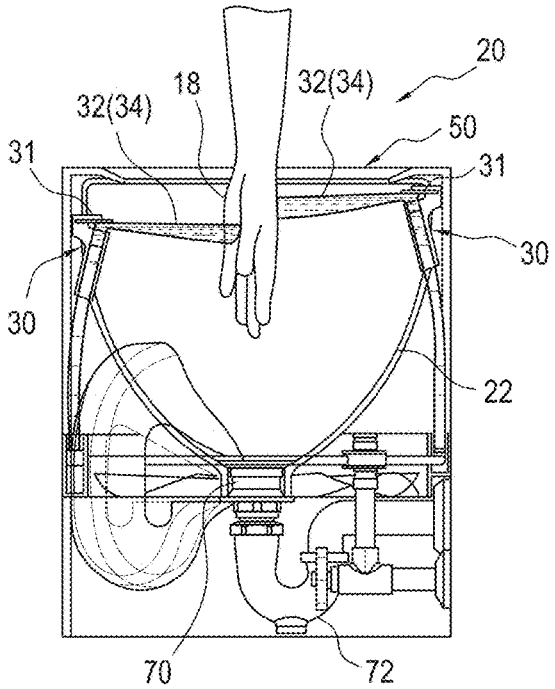
FIG. 21 is a side view of the handwashing station of FIG. 17 rinsing the hand.
Figure 22:
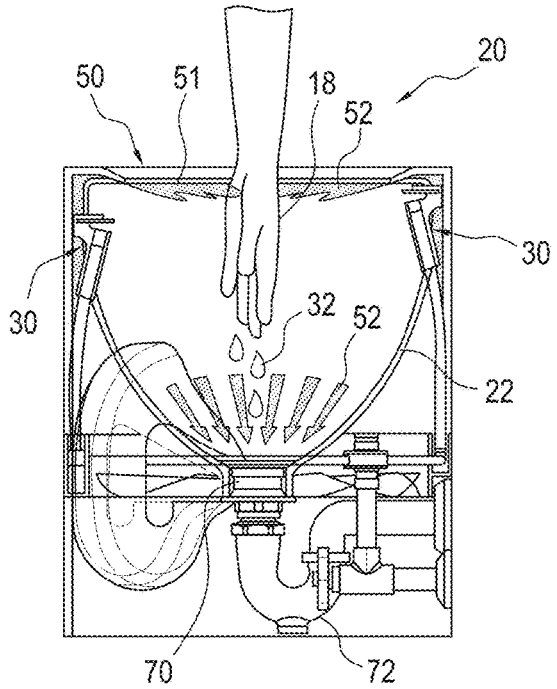
FIG. 22 is a side view of the handwashing station of FIG. 17 drying the hand.
Figure 23:
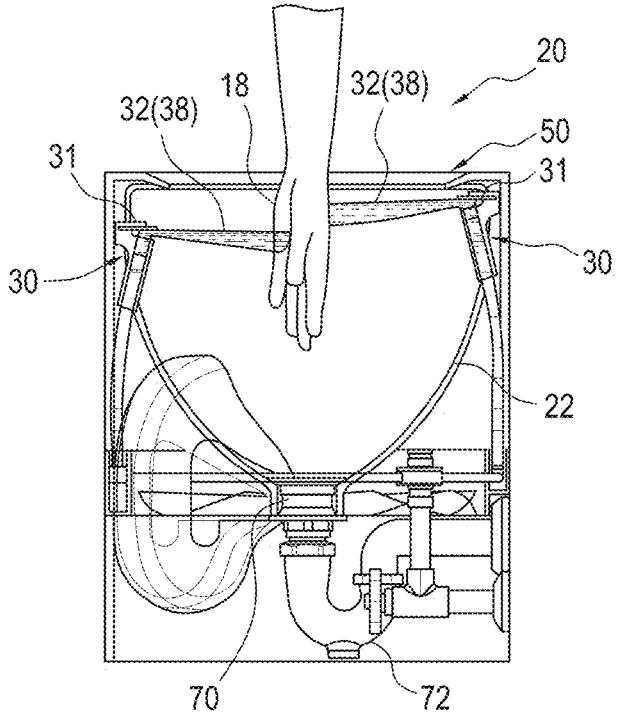
FIG. 23 is a side view of a handwashing station washing a hand with sanitizing liquid according to one embodiment.
Figure 24:
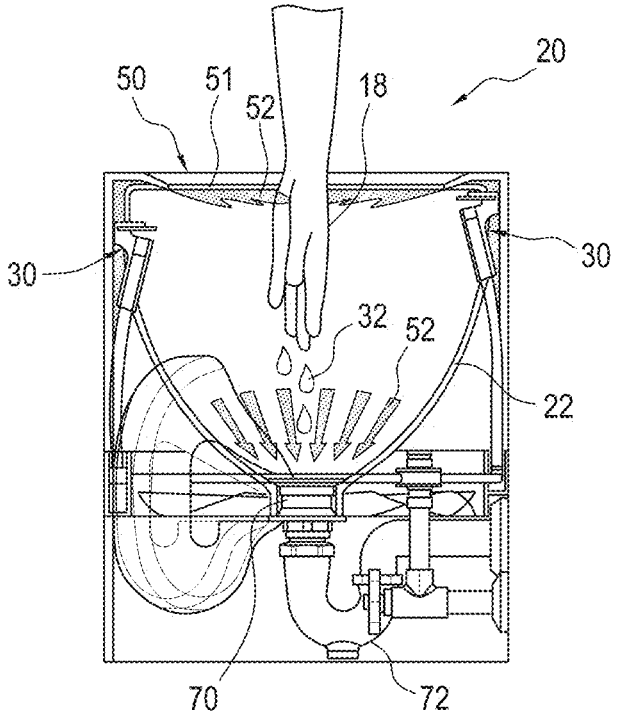
FIG. 24 is a side view of the handwashing station of FIG. 23 drying the hand.

As shown in FIGS. 17-22 and FIGS. 23-24, the liquid dispenser(s) 31 dispense liquid 32 into the basin 22 in order to allow the user to wash their hands 18 through a variety of different sequences (as described further herein). The liquid 32 may refer to water 34 and/or soap 36 (as shown in the embodiment of FIGS. 17-22) or sanitizing liquid 38 (as shown in the embodiment of FIGS. 23-24).

According to the embodiment shown in FIGS. 17-22, the liquid 32 that the liquid dispensers 31 are configured to dispense is water 34 and/or soap 36, which allows the user to wet, soap, wash, and clean their hands 18. For example, the handwashing station 20 wets the user's hands 18 with water 34, washes the user's hands 18 with soap 36, and rinses the user's hands 18 with water 34. The soap 36 may be, for example, an integrated soap, such as bubble soap or liquid soap.

Figure 19:
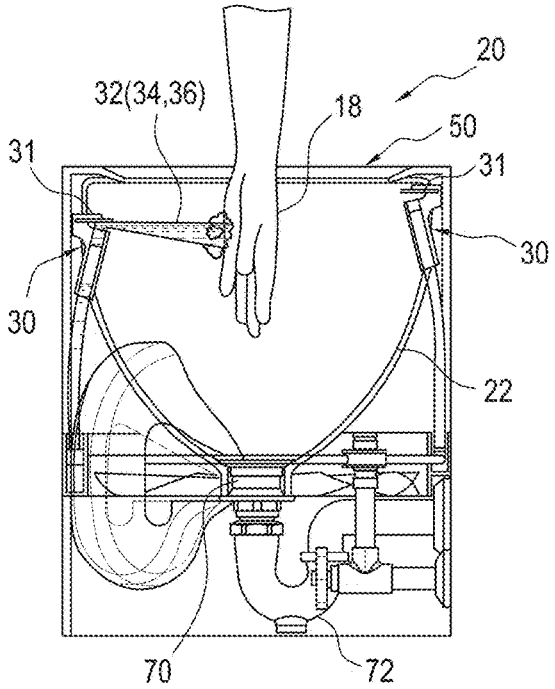
FIG. 19 is a side view of the handwashing station of FIG. 17 wetting and soaping a hand with soap and water.

The water 34 and the soap 36 can be dispensed together and/or separately (or a combination thereof) throughout the handwashing sequence (120). According to one embodiment, the water 34 and the soap 36 can be dispensed at the same time in order to both wet and soap the hands 18 at the same time. For example, as shown in FIG. 19, the soap 36 is dispensed such that the soap 36 is entrained, integrated with, or mixed within the water 34. Alternatively, the water 34 and the soap 36 can be dispensed at different times or in separate steps such that the soap 36 is dispensed during a separate step than the water 34. For example, the water 34 could be ejected or dispensed by itself to wet the hands 18, then the soap 36 could be ejected or dispensed by itself to wash the hands 18, and finally the water 34 could again be dispensed by itself to rinse the hands 18. As shown in FIG. 21, the water 34 is dispensed separately from the soap 36 such that the hands 18 can be rinsed with water 34 (and without any soap 36).

Figure 77:
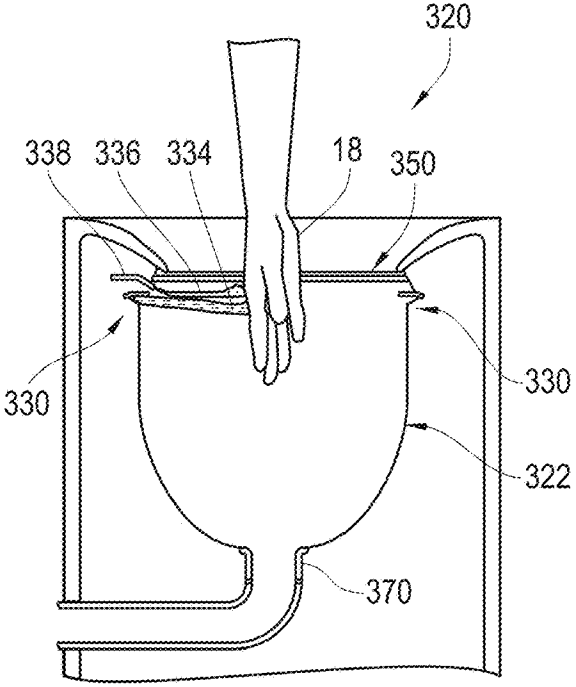
FIG. 77 is a side view of the handwashing station of FIG. 51 dispensing soap and water.

Alternatively, the soap 36 is dispensed such that the soap 36 flows as a layer on top of or above the water 34 (see, for example, FIGS. 8 and 77). Since the soap 36 is lighter than the water 34, the soap 36 may be dispensed from above the water 34 such that the soap 36 rides on top of the layer of water 34. Approximately 1 gram of soap 36 may be dispensed per use and a container of soap 36 accessible to the liquid dispensers 31 may hold approximately 1 liter of soap 36.

The water 34 and the soap 36 may be dispensed into the basin 22 in a variety of different sequences. For example, when any liquid 32 is being dispensed, the water 34 may flow continually while the soap 36 may be dispensed at a particular interval (or a variety of different intervals). According to one embodiment, the water 34 may be dispensed (with or without the soap 36) to wet the hands 18, the soap 36 may then be dispensed (with or without the water 34) to clean the hands 18, and then water may again be dispensed (without the soap 36) to rinse the hands 18. However, it is understood that a variety of other different sequences of water 34 and soap 36 dispensing can be used.

Figure 18:
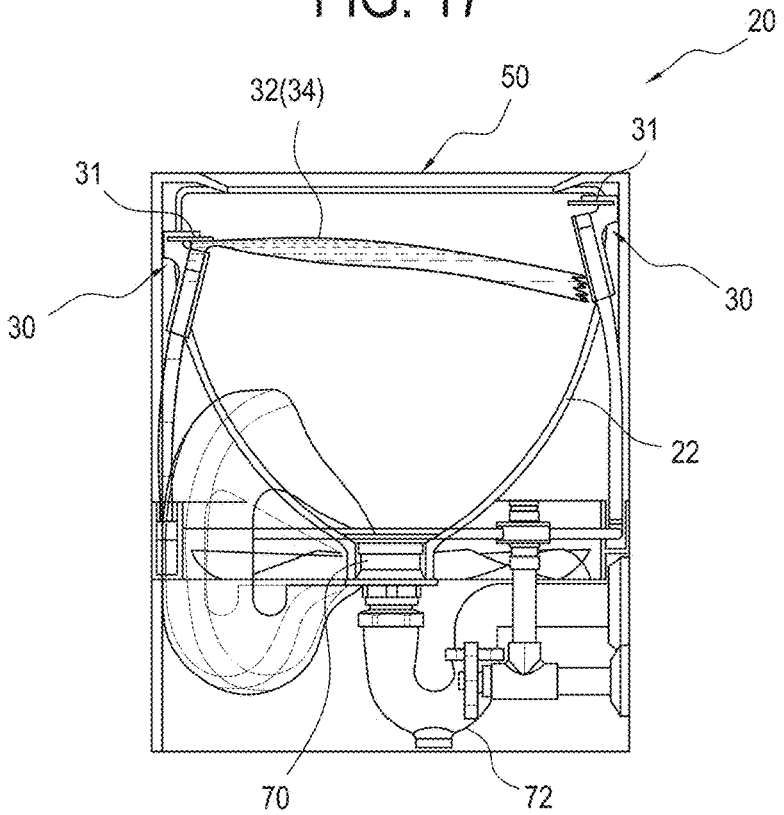
FIG. 18 is a side view of the handwashing station of FIG. 17 spraying water.

According one embodiment as shown in FIGS. 18-19 and 21, the water 34 and the soap 36 can be dispensed through the same liquid dispenser 31. The water 34 and the soap 36 can be dispensed at different times and separately from each other through the same liquid dispenser 31, as shown in FIGS. 18 and 21. Alternatively or additionally, the water 34 and the soap 36 can be dispensed at the same time and flow together concurrently through the same liquid dispenser 31 (as shown in FIG. 19). For example, the water 34 and the soap 36 may be mixed or blended together upstream of the liquid dispenser 31 and dispensed out of the liquid dispenser 31 together.

Figure 58:
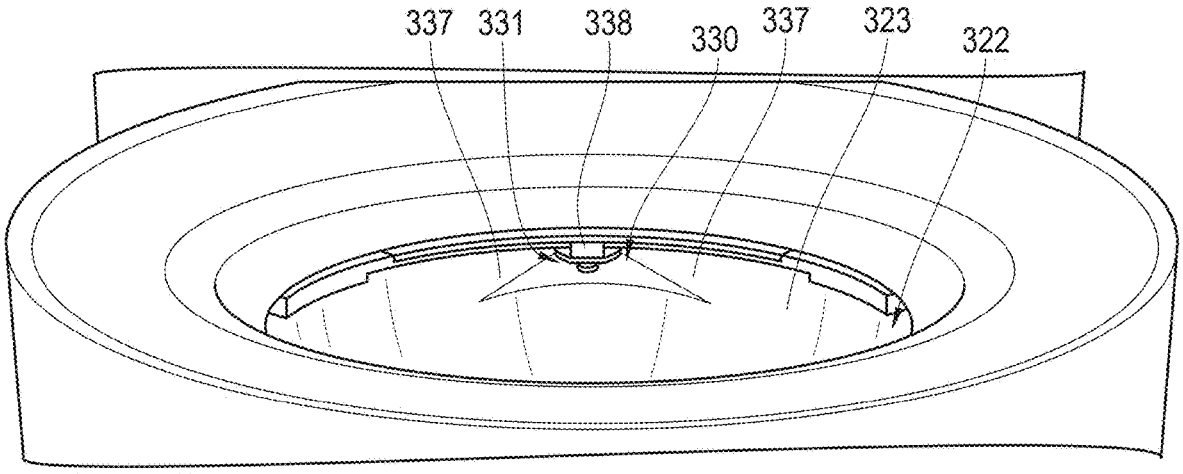
FIG. 58 is a front view of a portion of the basin structure of the handwashing station of FIG. 51.
Figure 59:
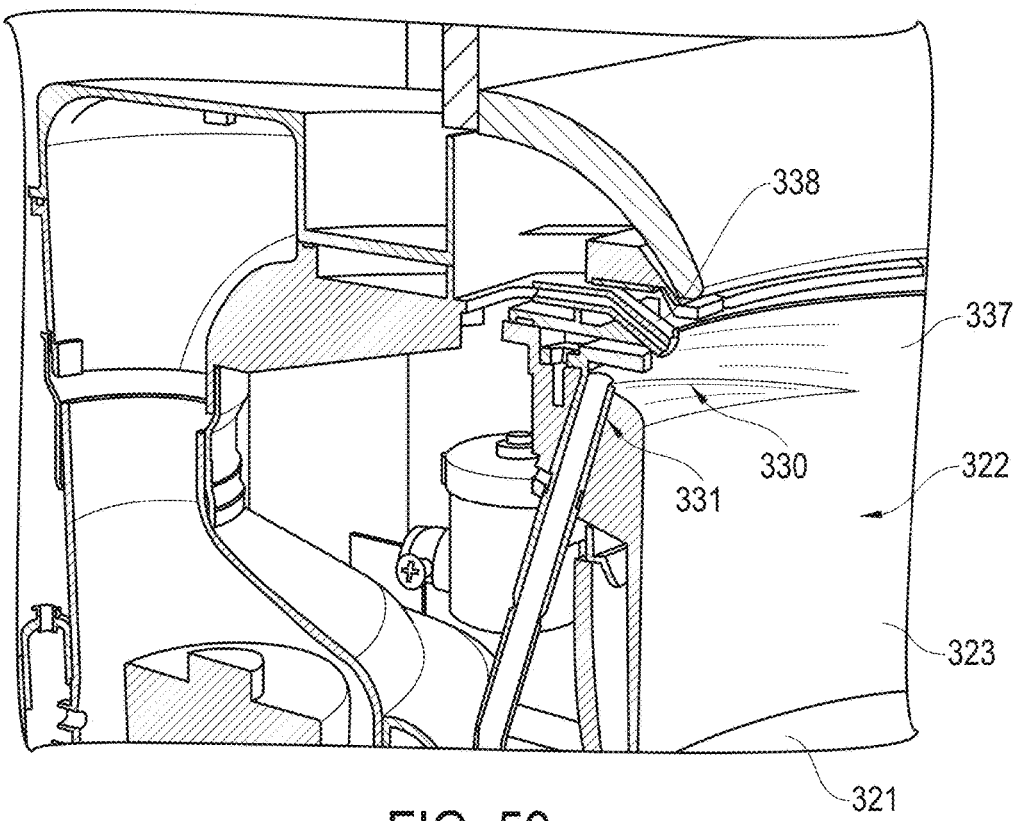
FIG. 59 is a cross-sectional view through a back portion of the handwashing station of FIG. 51.
Figure 61:
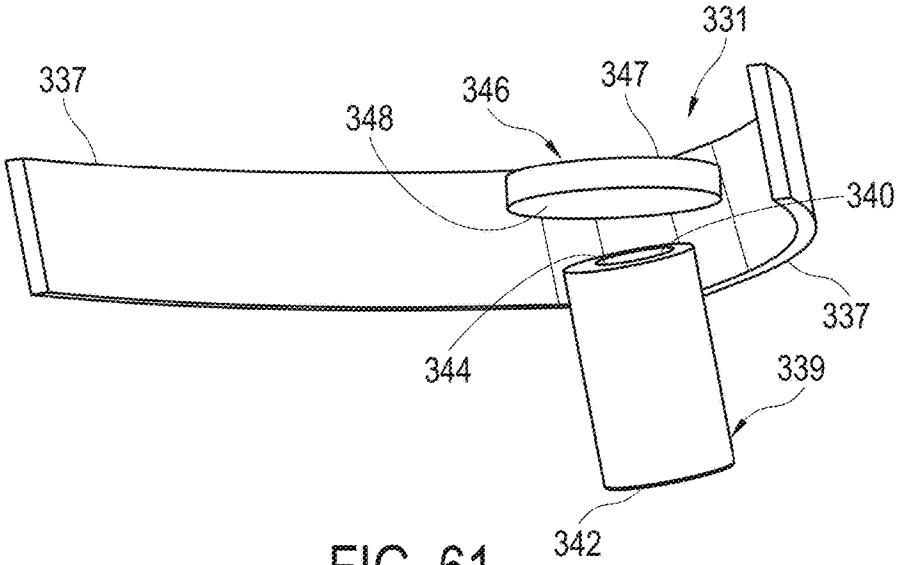
FIG. 61 is a perspective view of the liquid dispensing assembly of FIG. 60 with side walls.
Figure 60:
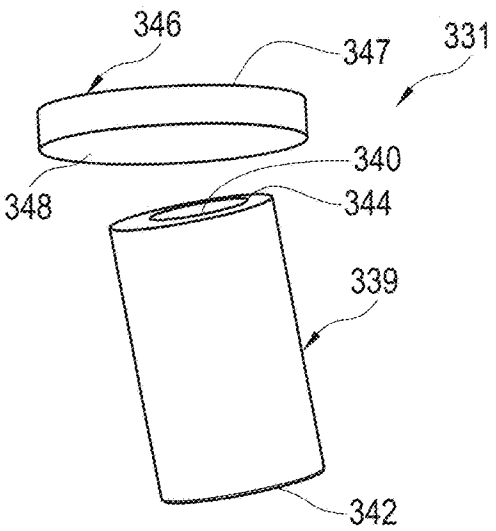
FIG. 60 is a perspective view of a liquid dispensing assembly of the handwashing station of FIG. 51.
Figure 63:
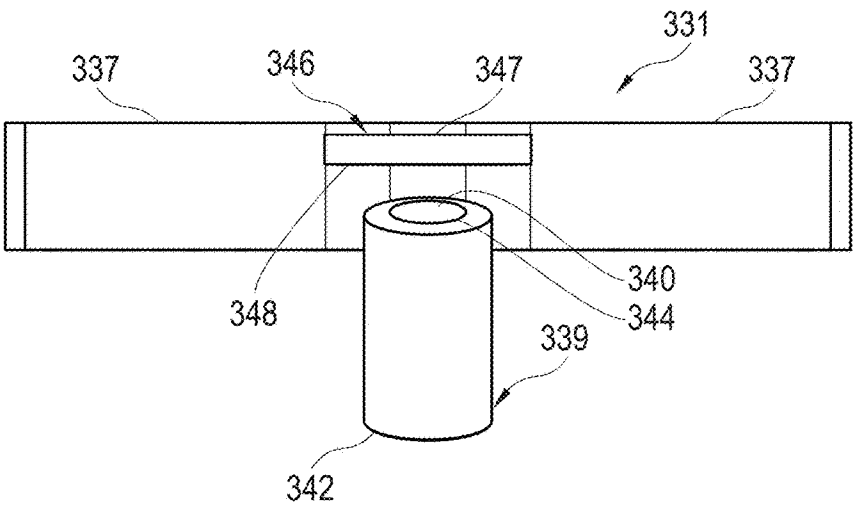
FIG. 63 is a front view of the liquid dispensing assembly of FIG. 60 with side walls.

Alternatively, the handwashing station 20 may include separate dedicated liquid dispensers 31 (e.g., a dedicated water dispenser and a dedicated soap dispenser) to allow water 34 and soap 36 to be dispensed separately from separate liquid dispensers 31 (as described further herein in reference to FIGS. 58-59, for example). The water 34 and the soap 36 can be dispensed from separate liquid dispensers 31 at the same time or at different times from each other (or a combination thereof) in order to properly wet, wash, and rinse the user's hands 18. According to one embodiment, the soap 36 can be dispensed from a dedicated soap dispenser while the water 34 is being dispensed from a dedicated water dispenser. The dedicated soap dispenser may be positioned directly above the dedicated water dispenser such that the soap 36 flows with (and fans outward with) the water 34.

According to the embodiment shown in FIG. 23, the liquid 32 that the liquid dispensers 31 dispense is a sanitizing liquid 38, which allows the user to wash their hands 18 without soap 36 and without the need to rinse their hands 18 with water. The sanitizing liquid 38 may be, for example, a soapless cleansing liquid, such as eWater (e.g., low sodium, ionized water) and/or Microbubble. The sanitizing liquid 38 does not need to be rinsed off from the hands 18 during the washing process and can instead simply be dried from the hands 18 (by the air dispensing system 50, for example), which expedites the hand washing process while still allowing the hands 18 to be completely cleaned.

The liquid dispensers 31 may have a metered flow such that the liquid dispensers 31 are turned off after being on for a particular amount of time or dispensing a particular volume of liquid 32. For example, if the water 34 and the soap 36 are dispensed separately, the specified amount of time or volume may be different for the water 34 and the soap 36 in order to dispense the correct ratio of water 34 and soap 36. The number of gallons per cycle that the liquid dispenser 31 outputs varies depending on the desired configuration, the desired wash time, and any applicable flow limits or restrictions where the liquid dispenser 31 is being used. According to one embodiment for example only, the liquid dispensers 31 may output approximately 0.2 or 0.25 gallons per cycle and according to another embodiment for example, only, the liquid dispensers 31 may output approximately 0.6 gallons per cycle. However, it is understood that the liquid dispenser 31 can be configured to output any number of gallons per cycle.

Handwashing Sequence

As shown in FIGS. 18-22 and FIGS. 23-24, the entire handwashing sequence (120) of the handwashing station 20 occurs within the basin 22. The handwashing station 20 may be configured to wash (optionally including wetting, soaping, and rinsing) and dry the hands 18 through a variety of different sequences of events. Although various handwashing sequences (120) are shown, the handwashing sequence 120 may vary according to the desired configuration and according to any applicable regulations, requirements, or restrictions, such as water usage regulations. Additionally, the handwashing sequence (120) may be used with other handwashing stations, such as the handwashing stations 220 or 320.

Figure 17:
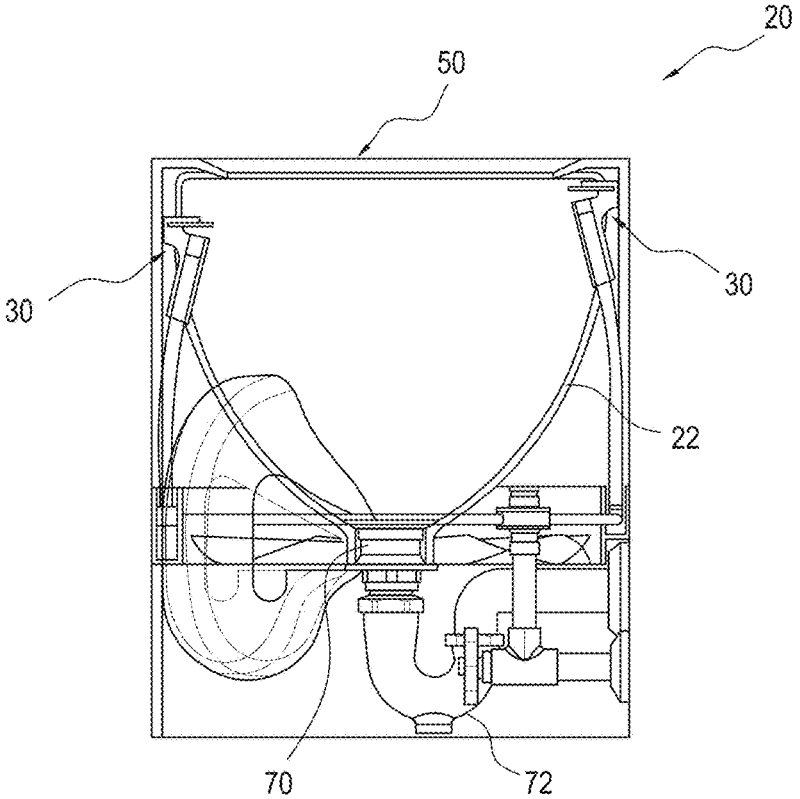
FIG. 17 is a side view of a handwashing station according to one embodiment.

According to one embodiment as shown in FIGS. 17-22, the handwashing station 20 is first turned off (as shown in FIG. 17) such that the liquid dispensers 31 are not dispensing liquid and the air dispenser 51 is not dispensing air. The handwashing sequence (120) may be initiated based on either when the user approaches the handwashing station 20 or when the user places their hand 18 into the basin 22. For example, according to one embodiment, when the user approaches the handwashing station 20, the body sensor 394 (as described further herein) senses or detects the user's body and the handwashing sequence (120) is initiated. Optionally, the liquid dispenser 31 may first dispense the liquid 32 (e.g., water 34) into the basin 22 before the user has inserted their hand 18 into the basin 22 in order to provide a visual indication of how to use the handwashing station 20 to the user, as shown in FIG. 18. Liquid 32 may flow from one or both of the liquid dispensers 31 (e.g., the liquid 32 may flow from only the liquid dispenser 31 positioned toward the user side 23 and therefore closer to the user or from only from the liquid dispenser 31 positioned toward the wall side 21 and therefore furthest to the user). However, in order to conserve water, the handwashing station 20 may not include this initial step to provide a visual indication to the user.

Figure 20:
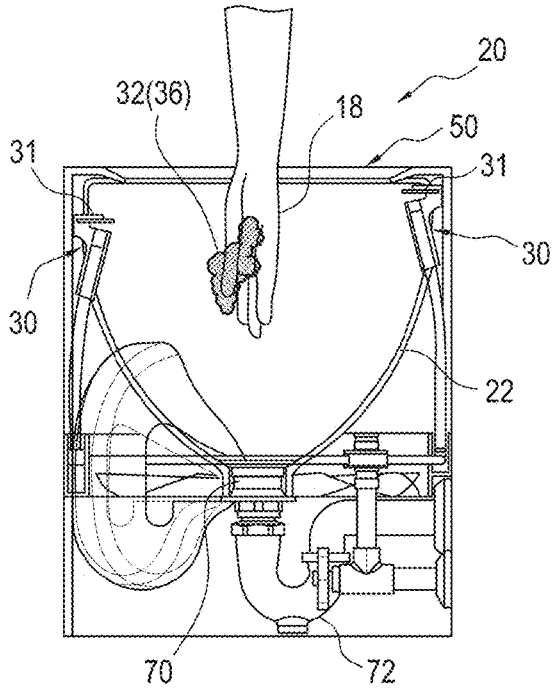
FIG. 20 is a side view of the handwashing station of FIG. 17 with the hand being scrubbed.

When the user's hands 18 are positioned within the basin 22 (or optionally when the user approaches the handwashing station 20, depending on the desired configuration), liquid 32 (containing both soap 36 and optionally water 34) is sprayed from one of the liquid dispensers 31 into the basin 22 and onto the hands 18 to first wet and soap the hands 18, as shown in FIG. 19. Optionally, the liquid dispensers 31 may pre-rinse the user's hands with only water 34 prior to applying any soap 36. Subsequently, the flow of the soap 36 is stopped and the flow of the water 34 is stopped or slowed to allow the user to wash and scrub their soapy hands 18 in the basin 22 (as shown in FIG. 20). Once the hands 18 have been washed and scrubbed (or after a particular amount of time has elapsed), the flow of soap 36 is completely stopped and only water 34 is sprayed from both of the liquid dispensers 31 into the basin 22 and onto the hands 18 to allow the user to rinse off their hands 18, as shown in FIG. 21. As described further herein, the liquid dispensers 31 are located on opposite sides of the basin 22 and at different heights. Once the hands 18 have been rinsed (or after a particular amount of time has elapsed), air 52 is blown from the air dispenser 51 into the basin 22 and onto the hands 18 to dry off the hands 18, as shown in FIG. 22. At the same time, the liquid 32 and optionally the air 52 is drained through the drain 70 (and optionally may be actively drawn through or into the drain 70 with a vacuum, as described further herein).

FIGS. 23-24 show another embodiment of washing the user's hands 18. More specifically, when the user's hands 18 are positioned within the basin 22 and the handwashing sequence (120) is initiated, liquid 32 (containing the sanitizing liquid 38) is sprayed from the liquid dispensers 31 into the basin 22 and onto the hands 18 to wash the hands 18 in the basin 22, as shown in FIG. 23. Once the hands 18 have been washed (or after a particular amount of time has elapsed), air 52 is blown from the air dispenser 51 into the basin 22 and onto the hands 18 to dry off the hands 18, as shown in FIG. 24. At the same time, the liquid 32 and optionally the air 52 is drained through the drain 70 (and optionally may be actively drawn through or into the drain 70 with a vacuum, as described further herein).

Figure 25:
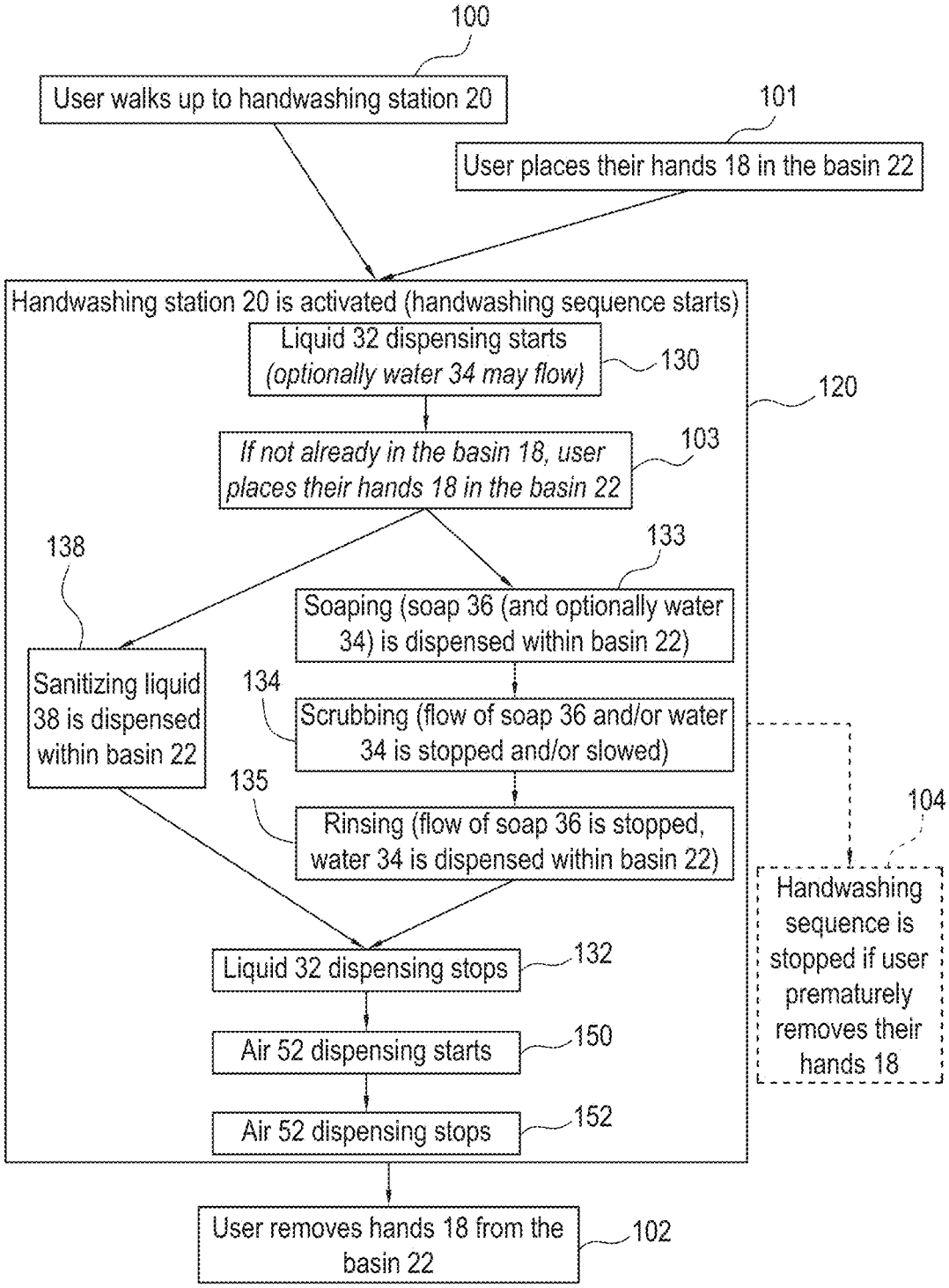
FIG. 25 is a schematic flow diagram illustrating the operation of the handwashing station according to yet another embodiment.

In order to use the handwashing station 20, a sequence of a variety of different events may occur, as shown in FIG. 25. Before the user walks up to the handwashing station 20 and/or before the user puts their hands into the basin 22, the handwashing station 20 may be off, as shown in FIG. 17. According to one embodiment as shown in FIG. 25, when the user walks up to or approaches the handwashing station 20 (100), a body sensor (such as body sensor 394, as described further herein) detects the user approaching or nearby the handwashing station 20 and sends a signal to an actuator that automatically activates the handwashing station 20 and starts the handwashing sequence (120). Once the handwashing station 20 is activated in such a manner, the handwashing sequence (120) starts by first activating the liquid dispensing system 30 in response to the signal from the body sensor. Accordingly, the liquid dispensing system 30 dispenses the liquid 32 (i.e., water 34) into the basin 22 (130) without the user's hand 18 in the basin 22, as shown in FIG. 18. Accordingly, the liquid 32 (e.g., the water 34) may begin to flow within the basin 22 before the user places their hands 18 into the basin 22 and the soap 36 or sanitizing liquid 38 is only dispensed once the user places their hands 18 into the basin 22 (as shown in FIGS. 18-19).

According to another embodiment, when the user places their hands 18 in the basin 22 (101), a hand sensor (such as hand sensor 396, as described further herein) detects the hands 18 being inserted into the basin 22 and sends a signal to an actuator, which automatically activates the handwashing station 20 and starts the handwashing sequence (120). Once the handwashing station 20 is activated in such a manner, the handwashing sequence (120) starts by first activating the liquid dispensing system 30 in response to the signal from the hand sensor. Accordingly, the liquid dispensing system 30 dispenses the liquid 32 (i.e., water 34) into the basin 22 (130) once the user's hand 18 in the basin 22, and the liquid 32 (including the water 34) only starts to flow within the basin 22 after the user places their hands 18 into the basin 22, as shown in FIG. 19.

Once the handwashing sequence (120) is initiated, the liquid dispensing system 30 is activated or turned on such that the liquid dispensing system 30 starts to dispense the liquid 32 into the basin 22. Accordingly, the liquid 32 starts to flow and is dispensed from the liquid dispenser(s) 31 (130) in order to wash or clean the hands 18. As described further herein, water 34 may optionally flow within the basin 22 (130) with or without the user's hands 18 in the basin 22 (as shown in FIG. 18). If the user has not already placed their hands 18 in the basin 22, the user then can place their hands 18 in the basin 22 (103) in order for the handwashing sequence (120) to continue or start.

FIG. 25 depicts two different embodiments of washing methods within the handwashing station 20 in which either soap 36 or sanitizing liquid 38 is dispensed. If the washing method utilizes sanitizing liquid 38, once the liquid 32 dispensing starts (130) and the hands 18 of the user are in the basin (103), the sanitizing liquid 38 is dispensed within the basin 22 (138) in order to wash the hands 18 (as shown in FIG. 23). If the washing method utilizes soap 36, once the liquid 32 dispensing starts (130) and the hands 18 of the user are in the basin (103), water 34 and soap 36 are dispensed within the basin 22 at different intervals in order to soap, scrub (or wash), and rinse the hands 18. The water 34 and the soap 36 can be dispensed together or separately and may be dispensed a variety of different intervals, as described further herein. For example, a step of soaping the user's hands 18 (133) may first begin in which soap 36 (and optionally water 34) is dispensed within the basin 22 (as shown in FIG. 19) to wet and soap the user's hands. Subsequently, a step of scrubbing (and thereby washing) the user's hands 18 (134) begins in which the flow of soap 36 and/or water 34 is stopped and/or slowed (as shown in FIG. 20) to allow the user to wash and scrub their hands 18. Finally, a step of rinsing the user's hands 18 (135) begins in which the flow of soap 36 is stopped and water 34 is dispensed within the basin 22 (as shown in FIG. 21) to rinse the user's hands 18. According to yet another embodiment, the user may optionally soap their hands using a separate, stand-alone soap dispenser that is outside of the basin 22.

Once the hands 18 are washed (and optionally rinsed) or after a certain amount of time has elapsed, the liquid dispensing system 30 is deactivated, stopped, or turned off such that the liquid 32 stops flowing and liquid 32 is no longer dispensed from the liquid dispensers 31 (132). Subsequently, the air dispensing system 50 is activated or turned on such that air 52 dispensing starts and air 52 starts to flow and is dispensed from the air dispenser 51 (150) in order to dry the hands 18, as shown in FIGS. 22 and 24. For example, the air fan assembly 54 may be turned on in order to initiate the air flow. Once the hands are dry or after a certain amount of time has elapsed, the air dispensing system 50 is deactivated, stopped, or turned off such that the air 52 stops flowing and air 52 is no longer dispensed from the air dispenser 51 (152) (e.g., the air fan assembly 54 is turned off), which completes the handwashing sequence (120). The user then removes their hands 18 from the basin 22 (102).

It is noted that, if, at any point in the handwashing sequence (120), the user leaves the handwashing station 20 or removes their hands 18 from the basin 22 prematurely before the handwashing sequence (120) is completed, the handwashing sequence (120) pauses. If the user puts their hands 18 back into the basin 22 within a certain relatively short period of time, the handwashing sequence (120) resumes where it left off and continues the handwashing sequence (120). However, if the user (or a new user) puts their hands 18 back into the basin 22 within a certain relatively longer period of time, the handwashing sequence (120) restarts and begins again from the beginning of the handwashing sequence (120).

Depending on the desired washing method (i.e., soap 36 or the sanitizing liquid 38), the total time to wash and dry the hands 18 may be different. Additionally, the time for each of the individual steps may vary according to the desired configuration and according to any applicable regulations, requirements, or restrictions, such as water usage regulations. For example only, in the embodiment shown in FIGS. 19-22, the washing steps (133, 134, 135) may take approximately 17 seconds (soaping the hands 18 (133) may take approximately 2 seconds (i.e., FIG. 19), scrubbing the hands 18 (134) may take approximately 5 seconds (i.e., FIG. 20), rinsing the hands 18 (135) may take approximately 10 seconds (i.e., FIG. 21)) and the drying step (150) (i.e., FIG. 22) may also take approximately 10 seconds, for a total of approximately 27 seconds. For example only, in the embodiment shown in FIGS. 23-24, the washing step of dispensing the sanitizing liquid 38 (138) (i.e., FIG. 23) may take approximately 12 seconds and the drying step (150) (i.e., FIG. 24) may take approximately 10 seconds, for a total of approximately 22 seconds. According to another embodiment, the washing steps (133, 134, 135) may take approximately 20 seconds (wetting the hands 18 may take approximately 2 seconds, soaping the hands 18 (133) and scrubbing the hands 18 (134) may take approximately 4 seconds, and rinsing the hands 18 (135) may include a small rinse for approximately 4 seconds, a normal rinse for approximately 5 seconds, and a full rinse for approximately 5 seconds) and the drying step (150) may take approximately 25 seconds, for a total of approximately 45 seconds. According to another embodiment, the washing steps (133, 134, 135) may take approximately 11.5 seconds (wetting the hands 18 may take approximately 1 second, soaping the hands 18 (133) may take approximately 1.5 seconds, scrubbing the hands 18 (134) may take approximately 3 seconds, and rinsing the hands 18 (135) may include a normal rinse for approximately 5 seconds and a full rinse for approximately 1 second) and the drying step (150) may take approximately 25 seconds, for a total of approximately 36.5 seconds. However, it is understood that these steps may be lengthened or shortened depending on the desired process. For example, the drying step (150) may be less than approximately 6 seconds, less than approximately 13 seconds, or approximately 16 to 20 seconds.

Additional Features of the Handwashing Station

Figure 26:
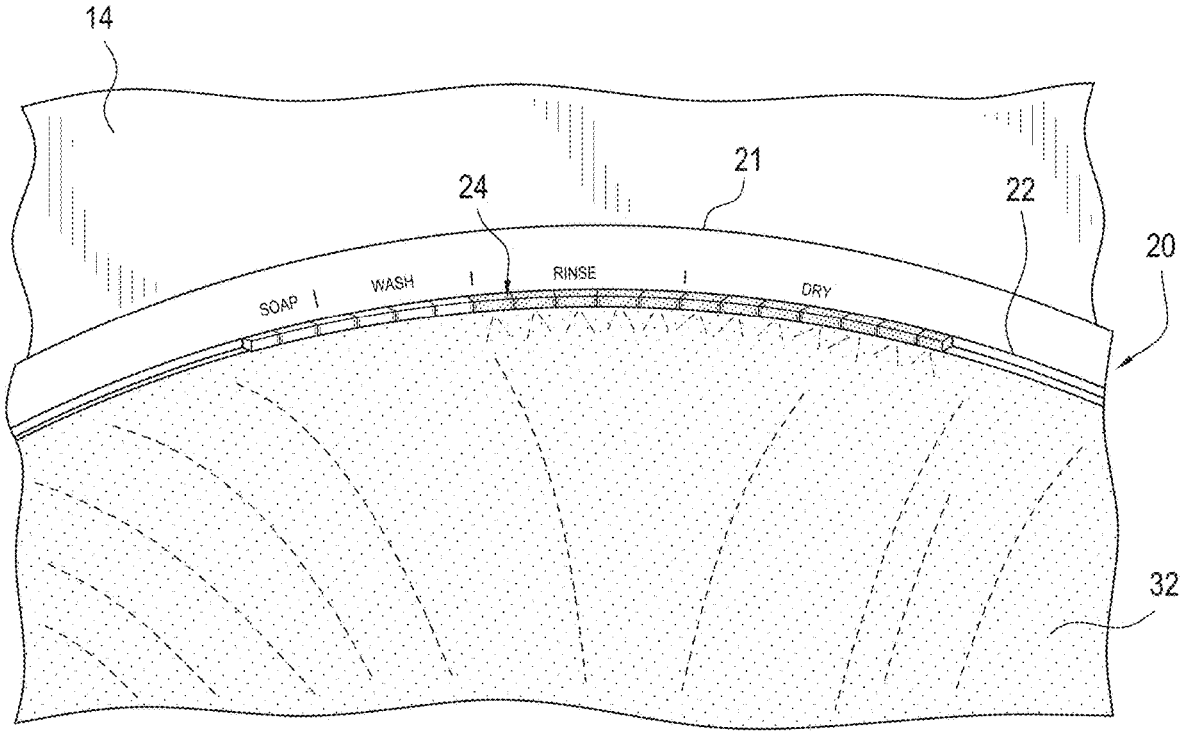
FIG. 26 is a perspective view of process indicators of a handwashing station according to one embodiment.

According to one embodiment as shown in FIG. 26, the handwashing station 20 includes a display or process indicators 24 that show the progress of the various steps of the handwashing sequence (120) (as described further herein). The process indicators 24 may be positioned next to each other on the outside of, on the top of, along the rim of, or within the basin 22. The process indicators 24 may be positioned along a wall side 21 of the basin 22 such that the user can easily visualize the process indicators 24 while using the handwashing station 20. The wall side 21 of the basin 22 refers to the side of the basin 22 that is closest to the wall 14 of the bathroom and is opposite to a user side 23 of the basin 22 (where the user side 23 is the side of the basin 22 that the user approaches to use the handwashing station 20). Alternatively, the process indicators 24 may be positioned in other areas within the bathroom, such as along the mirror 12.

The process indicators 24 may include lights, such as LED lights, and corresponding labels for each step (e.g., "Soap," "Wash," "Rinse," and "Dry") along the length of the process indicators 24. As the handwashing sequence (120) progresses through each of the steps, individual process indicators 24 may turn on or off to indicate the progress of the handwashing sequence (120). Although FIG. 26 illustrates one possible embodiment for the process indicators, it should be appreciated that other types of process indicators may be used instead (e.g., display panels that convey visual information, clocks that indicate the amount of time remaining, displays that includes words indicative of the stage of the washing process, etc.). The process indicators 24 may optionally include any of the various features and configurations of the process indicators 324 (as described further herein), according to the desired configuration.

The handwashing station 20 may optionally include one or more sensors (e.g., hand detection sensors) to automatically detect when the user has moved their hands 18 into the basin 22. For example, any type of proximity sensor may be used and may be located within the basin 22, such as near the opening or top of the basin 22 and may be actuated when the hands 18 are near or within the basin 22. Alternatively or additionally, the handwashing station 20 may include one or more body detection sensor(s) to detect when the user has walked up to or approached the basin 22. Each sensor may be, for example, an infrared, laser, CMOS, or microwave sensor. According to other exemplary embodiments, the sensor(s) may be a proximity sensor that can detect when the hands 18 are within the basin 22. When the sensor detects that the hands 18 are within the basin 22 (or the user has approached the basin 22), the sensor sends a signal to an actuator, which automatically turns on and controls the handwashing sequence (120), as described further herein. The sensors may be, for example, the hand sensor 396 and the body sensor 394, as described further herein.

Figure 27:
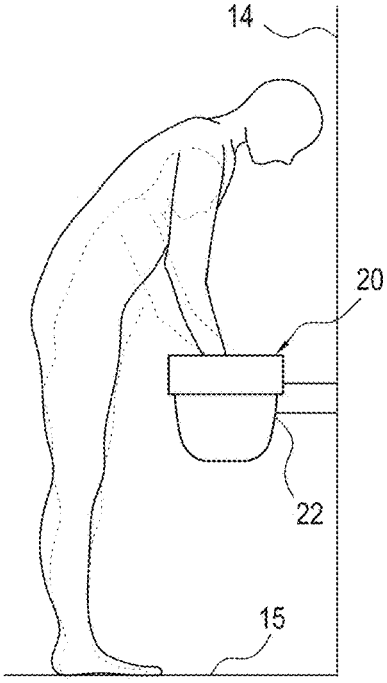
FIG. 27 is a side view of a handwashing station in one position according to one embodiment.
Figure 28:
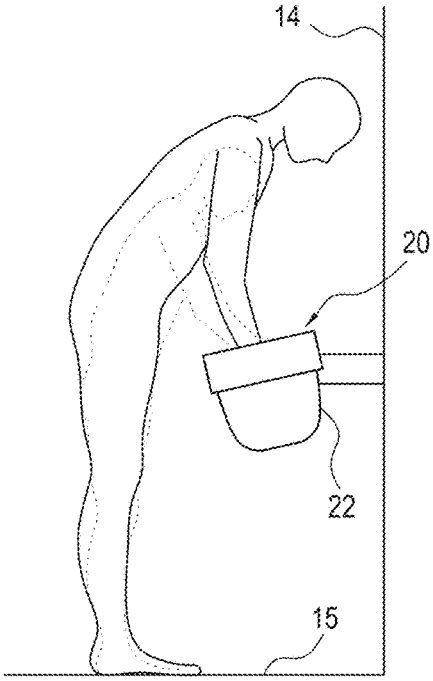
FIG. 28 is a side view of a handwashing station in another position and being used from a standing position according to another embodiment.
Figure 29:
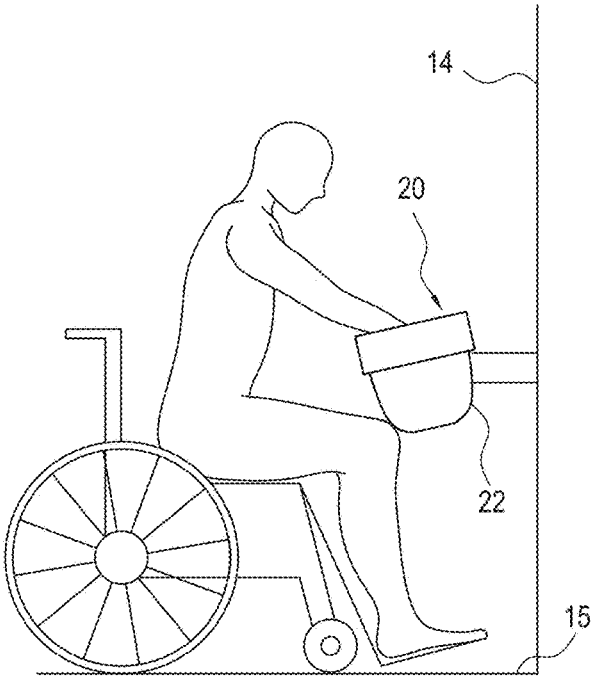
FIG. 29 is a side view of the handwashing station of FIG. 28 being used from a seated position.
Figure 33:
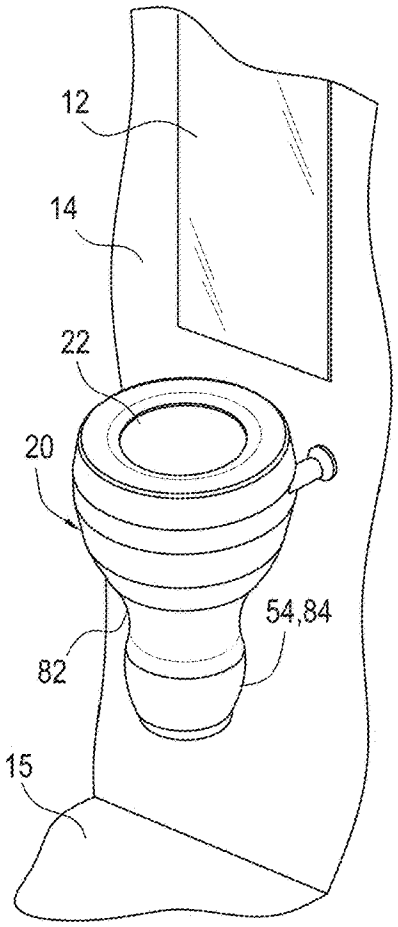
FIGS. 30-43 are perspective and front views of various embodiments of handwashing stations.
Figure 32:
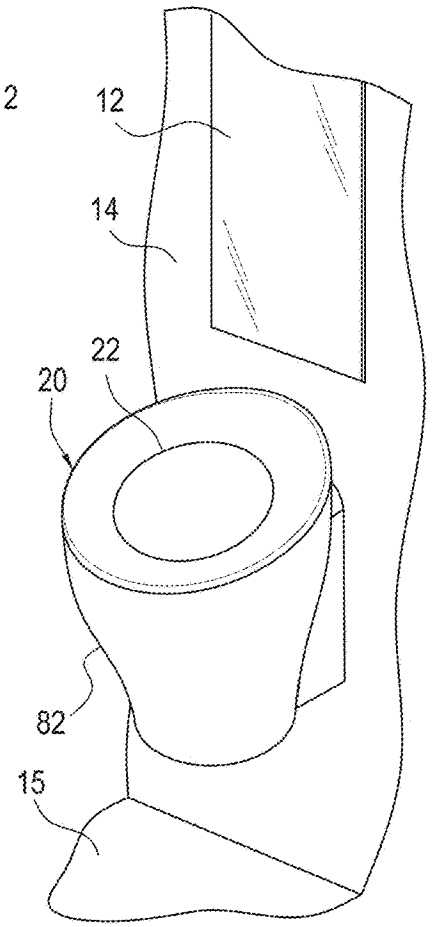
Figure 31:
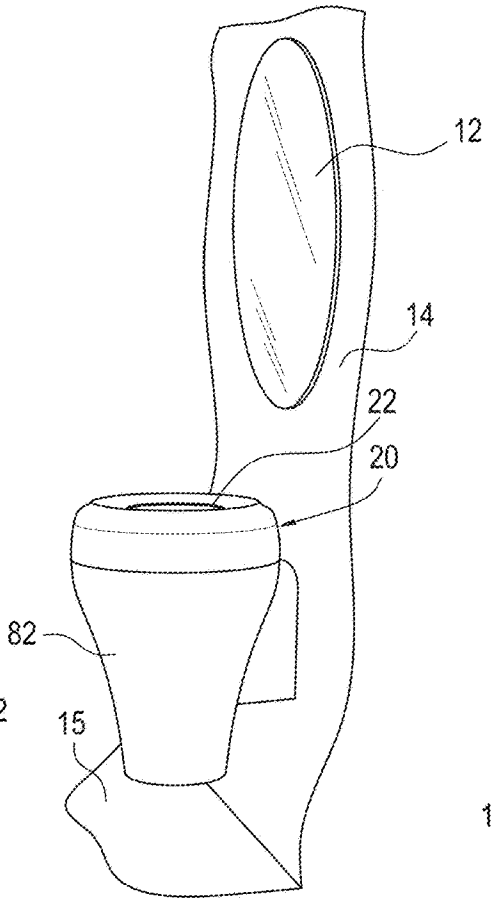
Figure 30:
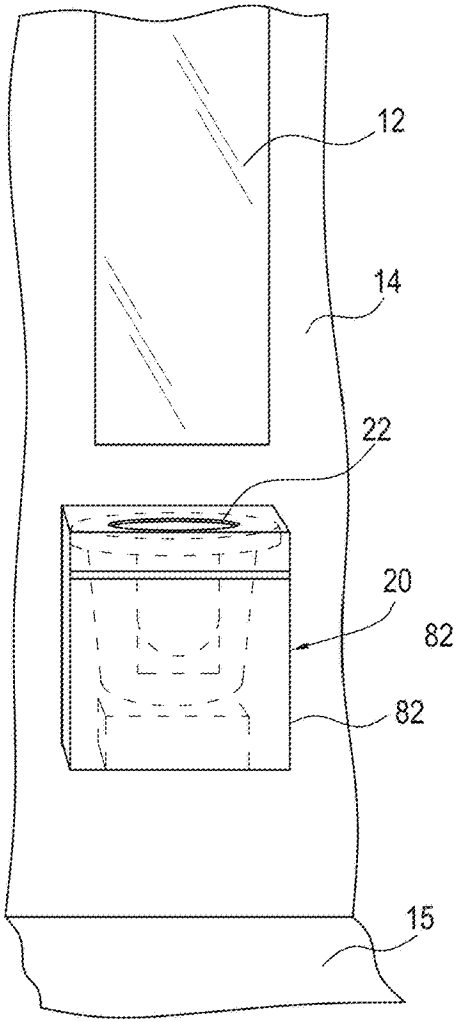
Figure 34:
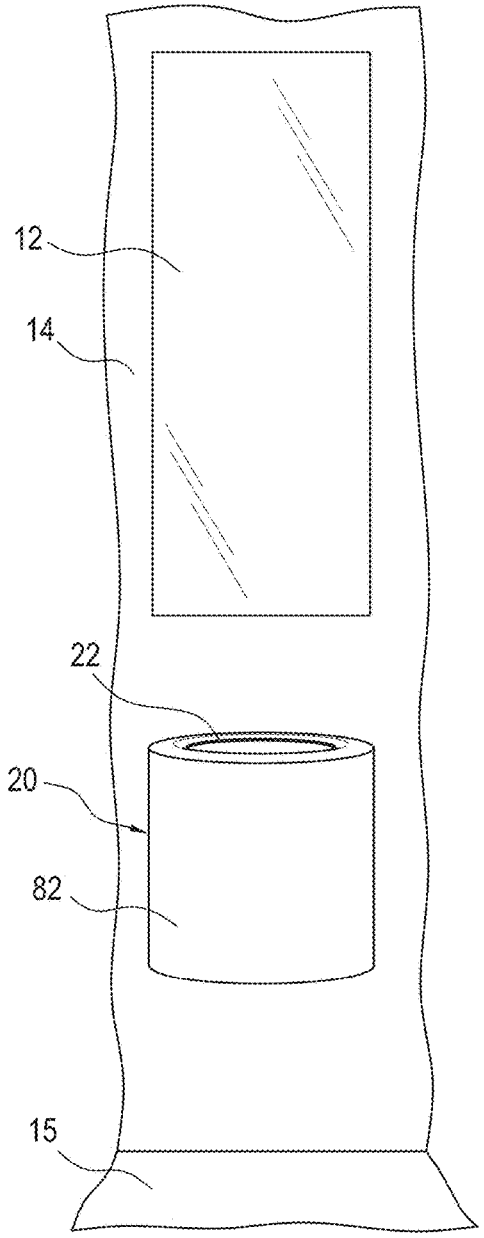

The dimensions and position (e.g., height and angle) of the handwashing station 20 (specifically the basin 22, as described further herein) may be chosen depending on the desired configuration and human factor considerations. For example, FIGS. 27-29 show a variety of different positions of the handwashing station 20 within the bathroom in order to allow a variety of differently-sized users to easily use and access the handwashing station from a standing position (as shown in FIGS. 27-28) or a seated position (i.e., in wheelchair, as shown in FIG. 29).

According to various embodiments, the handwashing station 20 can be used within a bathroom, such as a public, commercial, or private restroom, washroom, water closet, or bathroom. The bathroom can be within a variety of different locations including, but not limited to, a private residence, an airport, an airplane, a train, an office building, a shopping center, or a restaurant. Although a bathroom is referred to herein, the handwashing station 20 can be used within other areas outside of a bathroom, including but not limited to a kitchen, a factory, a hotel room, or a public area.

Figure 35:
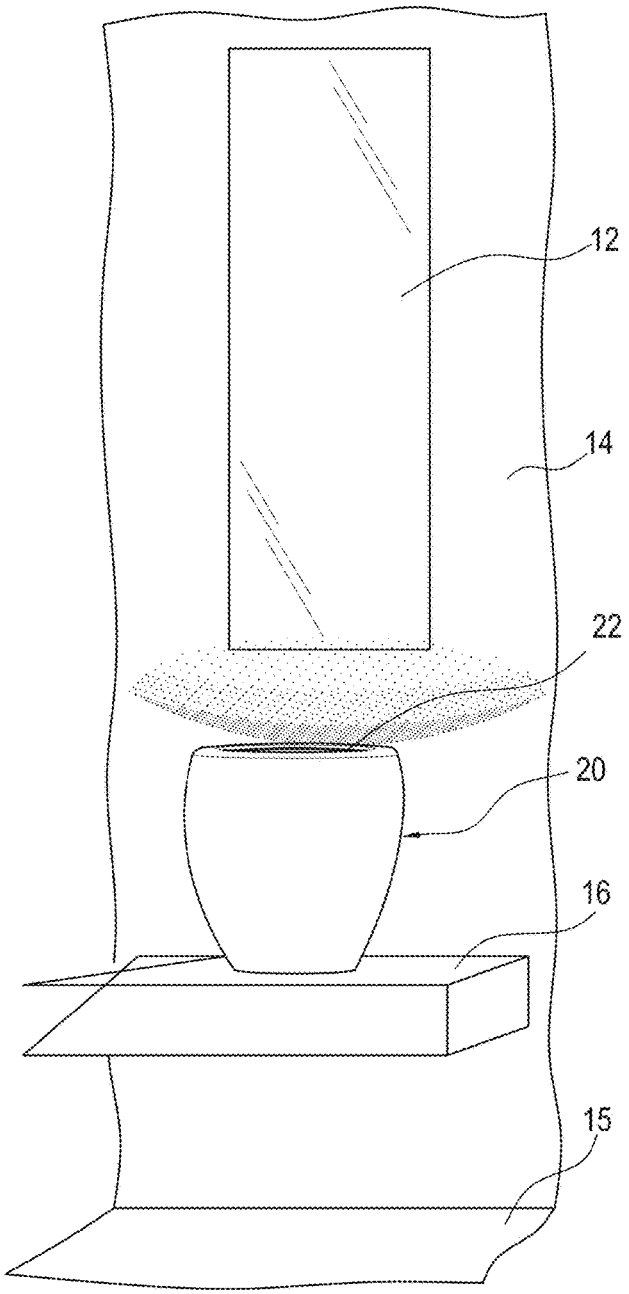
Figure 36:
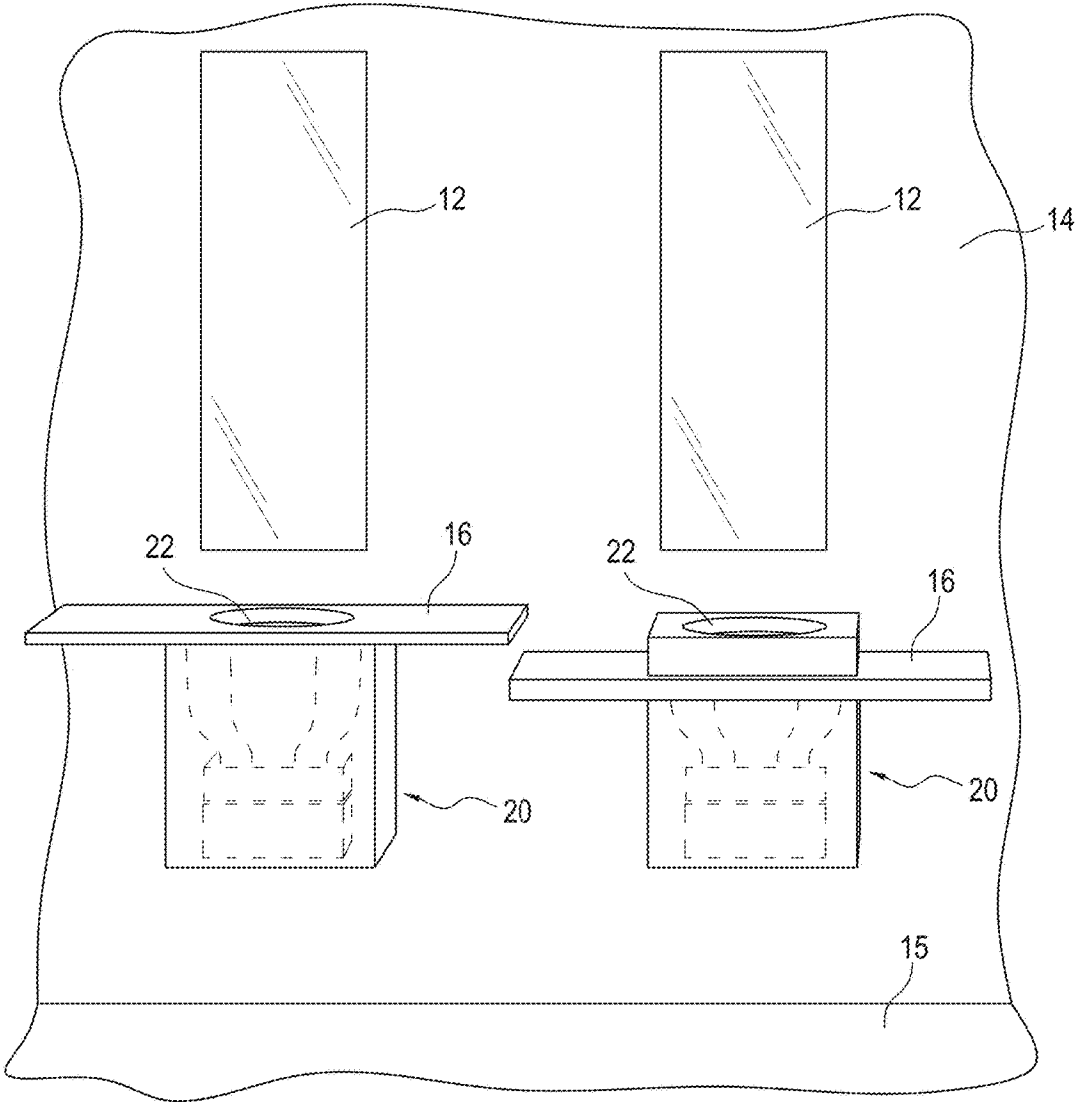
Figure 39:
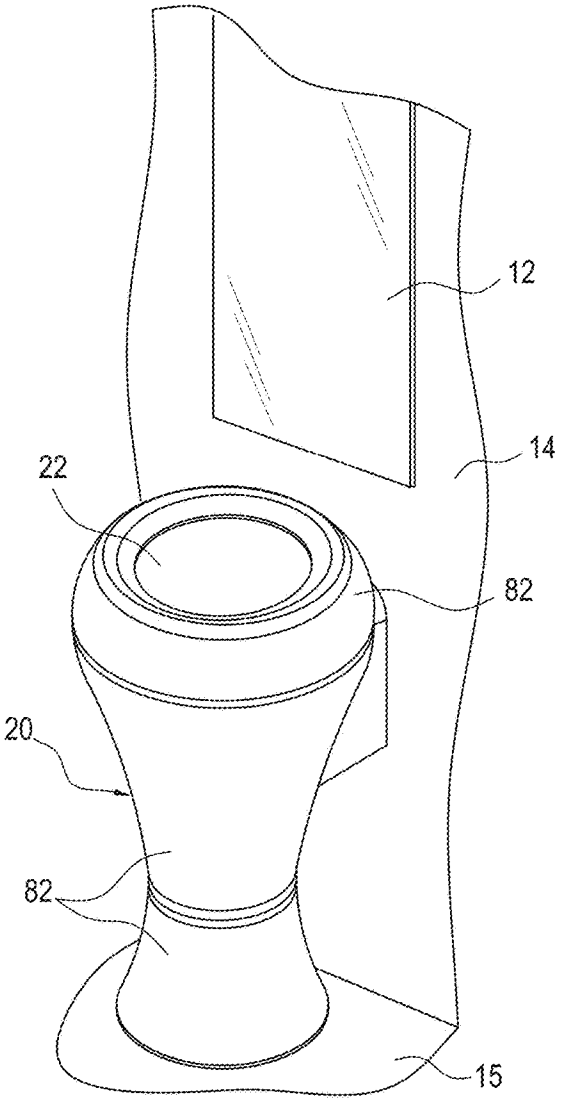
Figure 40:
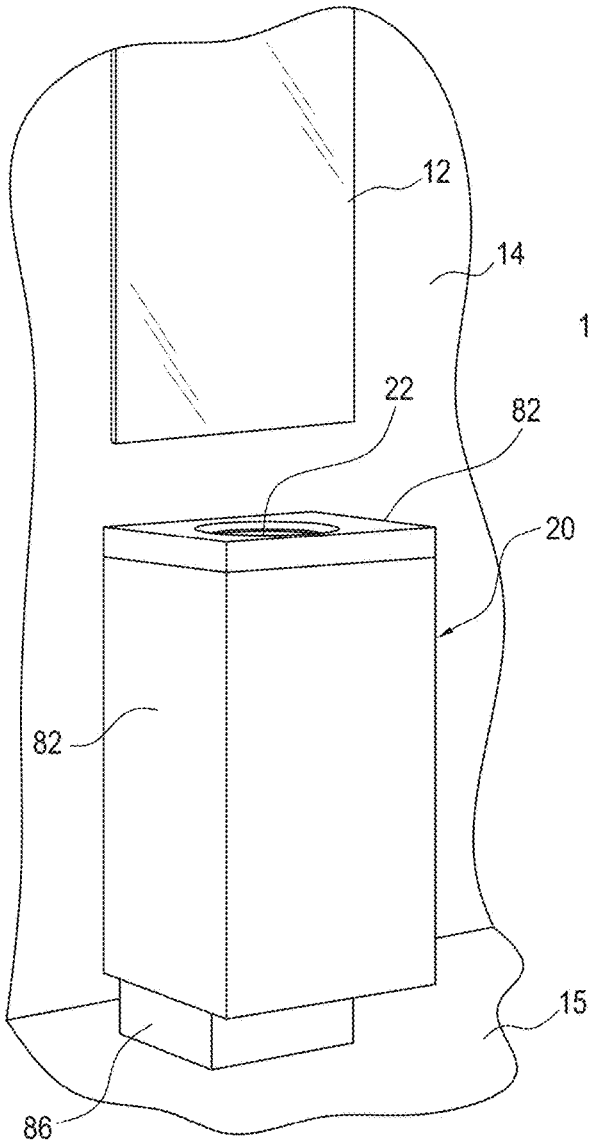
Figure 41:
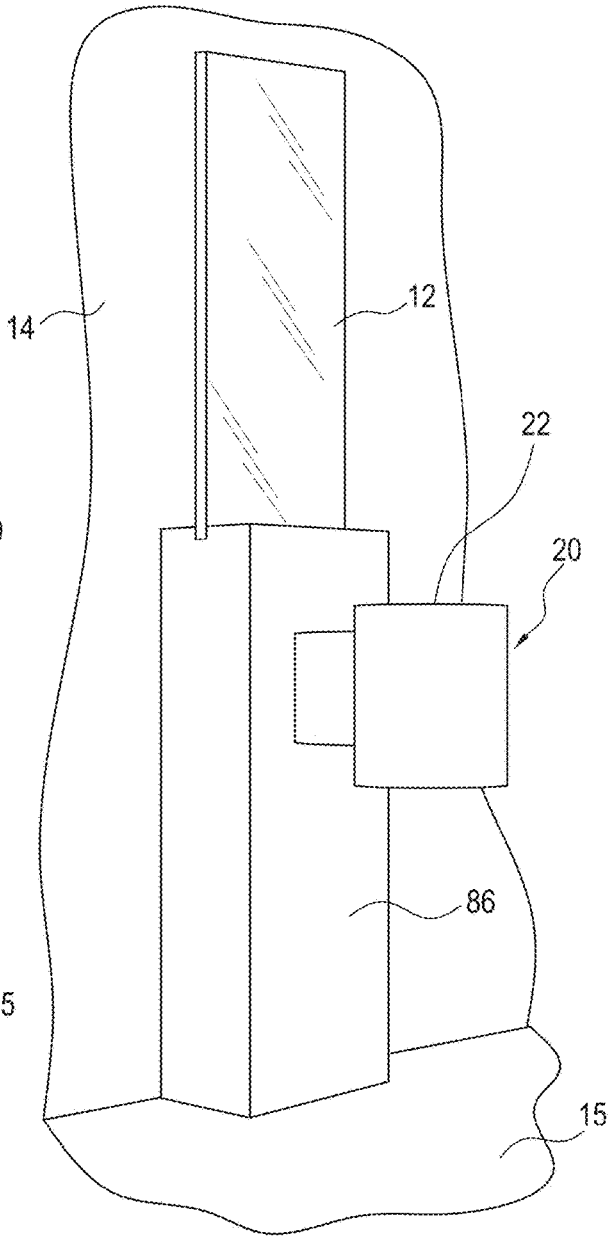
Figure 42:
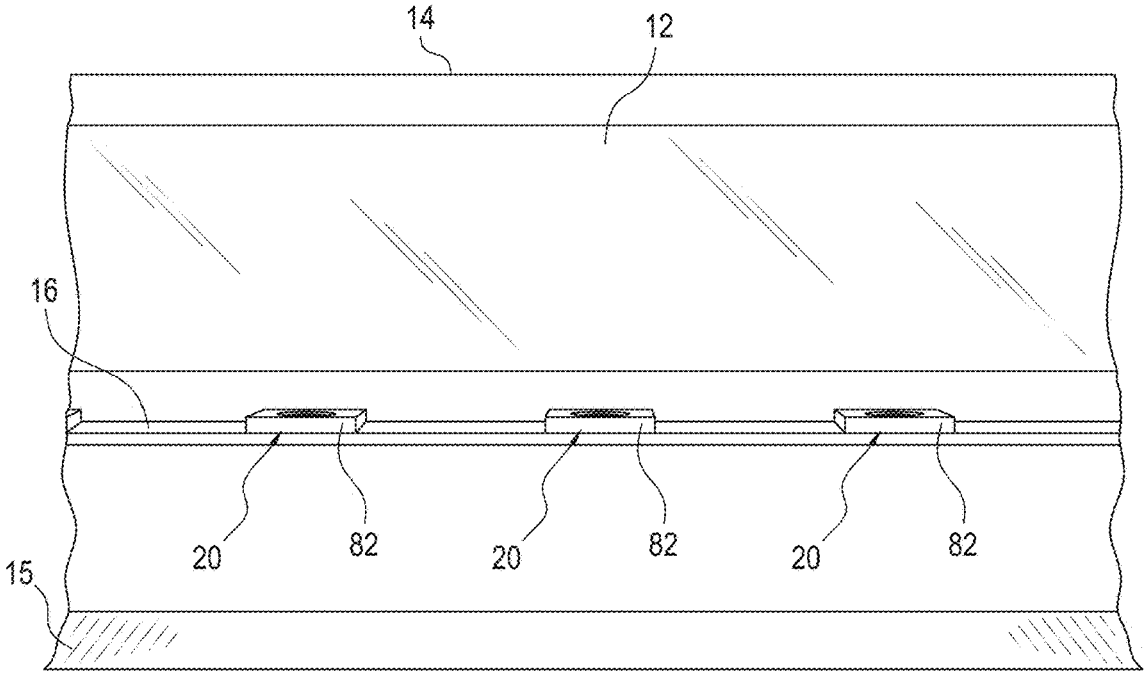

The handwashing station 20 can be positioned in a variety of different areas within the bathroom. The handwashing station 20 may be positioned near (e.g., under) a mirror 12 for the user to look at while washing and drying their hands. According on one embodiment as shown in FIGS. 30-34, the handwashing station 20 can be directly attached to a wall 14 of the bathroom (and optionally spaced from the floor 15 in a wall-hung configuration). Alternatively or additionally, the handwashing station 20 can be positioned or secured on top of a counter 16 within the bathroom (e.g., "over-counter," as shown in FIG. 35), positioned at least partially beneath the counter 16 (e.g., "under-mount," as shown in FIG. 36), or positioned or mounted at least partially within the counter 16 (as shown in FIG. 42, as described further herein). As shown in FIGS. 37-41, the handwashing station 20 can be positioned on and supported by a floor 15 in the bathroom and may include, for example, a decorative pod stand or pedestal. According to various embodiments, the handwashing station 20 may include a base 86 that rests along and optionally attaches to the floor 15 to support the rest of the handwashing station 20 (as shown in FIGS. 40-41).

Figure 43:
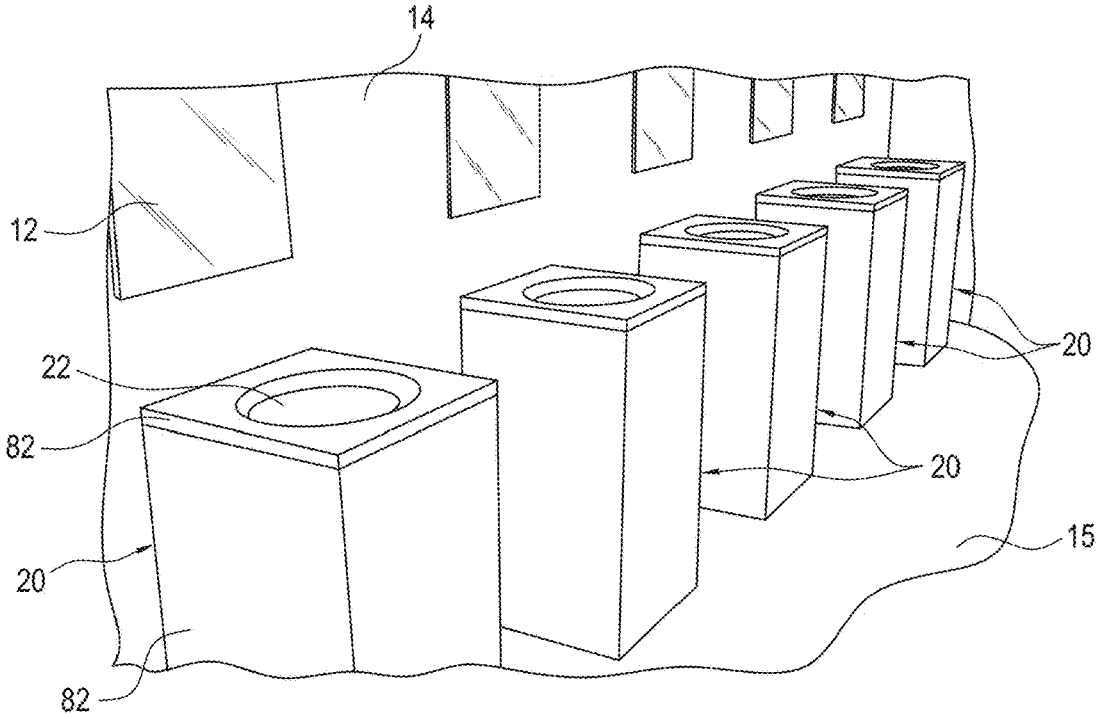

As shown in FIGS. 42-43, for example, multiple handwashing stations 20 can be positioned next to each other within the bathroom in order to provide multiple areas for multiple users to wash and dry their hands 18 at the same time, which may be particularly beneficial within public restrooms. The multiple handwashing stations 20 may each have their own mirror 12 or may share one or more mirrors 12.

As further shown in FIGS. 30-43, the handwashing station 20 may also include other components, such as outer housing or exterior components 82 to cover, conceal, or house other components within the handwashing station 20 and to provide the desired aesthetic look of the handwashing station. The exterior components 82 may be made out of a variety of different materials, including but not limited to stainless steel, bent sheet metal, engineered stone, wood, leather, ceramic, brass, glass, litho cast, and/or any suitable metal, polymer, and/or composite material. The exterior components 82 and optionally any of the interior components may be plated. The exterior components 82 that are glass may be formed using a spinning mold. The size of each of the exterior components 82 depends on the size of the components housed within the exterior components 82. Additionally, the handwashing station 20 can be a variety of different colors, according to the desired configuration. The outside of the basin 22, may have a variety of different shapes according to the desired configuration and aesthetic.

Figure 38:
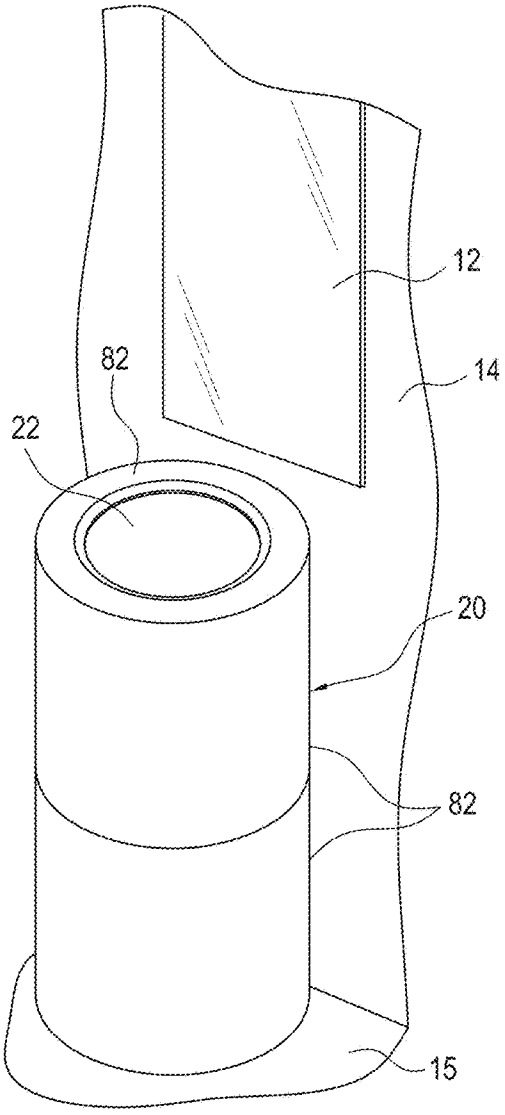
Figure 37:
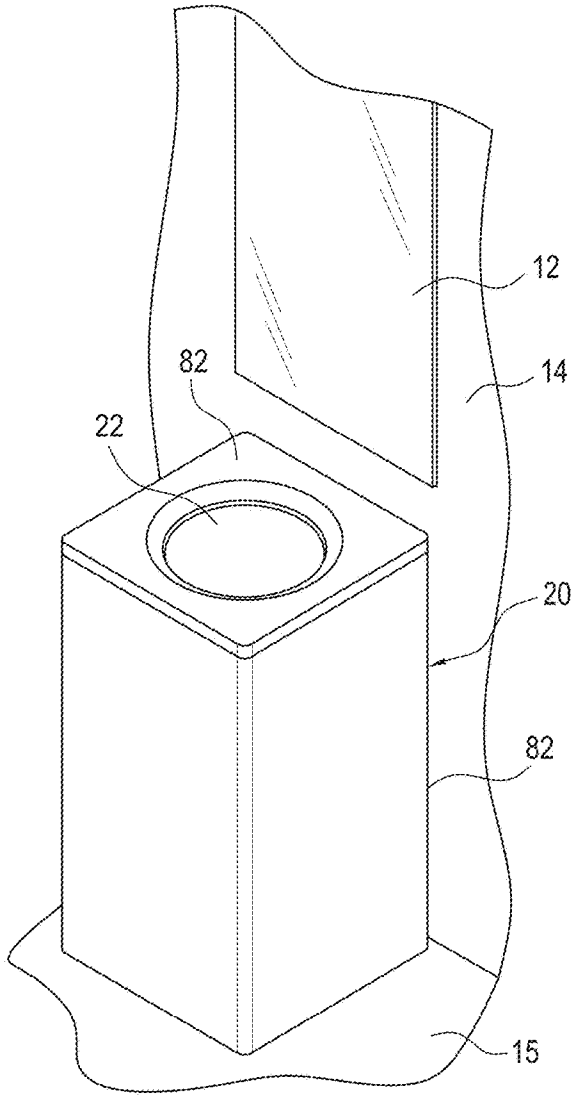

As shown in FIGS. 30-43, the exterior components 82 may determine the overall shape of the handwashing station 20, which may variety according to the desired look and configuration of the handwashing station 20. For example, the handwashing station 20 may be a rectangular prism (as shown in FIG. 37), a cylinder (as shown in FIG. 38), a contoured shape (as shown in FIG. 39), or any other desired shape. The contoured shape of the handwashing station 20 may include a variety of different contours and materials in order to obtain the desired aesthetic. The exterior components 82 and the base 86 may optionally include any of the various features and configurations of the exterior components 382 and the base 386 (as described further herein), respectively, according to the desired configuration.

As shown in FIG. 42, the handwashing station 20 may be configured to be inserted into a counter 16 (though, for example, a hole in the counter 16) such that only the top exterior component 82 of the handwashing station 20 is shown (if at all). Accordingly, the handwashing station 20 has minimal outer aesthetic exterior components (aside from a frame for support and the various functional components of the handwashing station 20) below the basin 22 since the area below the basin 22 is obscured within the counter 16.

The handwashing station 20 may also include electronic components 84 (which may include a computer, processor, and/or a controller) to control the automatic processes within the handwashing station 20. The electronic components 84 may connect to an electric power supply that may provide different amounts of power.

Liquid Dispensing System

FIGS. 44-50 show a liquid dispensing system 230 according to one embodiment. As shown in FIGS. 44-48, the liquid dispensing system 230 includes a nozzle or liquid dispenser 231 that allows liquid 232 to flow through and creates a laminar flow of the liquid 232 as the liquid 232 exits the liquid dispenser 231 (as described further herein). The liquid dispenser 231 includes a body 239, a top lip 250, and a bottom lip 270. The liquid dispensing system 230, the liquid dispenser 231, and the liquid 232 may optionally include any of the various features and configurations of the liquid dispensing system 30 or 330, the liquid dispenser 31 or the water dispenser 331, or the liquid 32 (including the water 34, the soap 36 and the sanitizing liquid 38) or the water 334 or soap 336 (as described further herein), respectively, according to the desired configuration.

Figure 47:
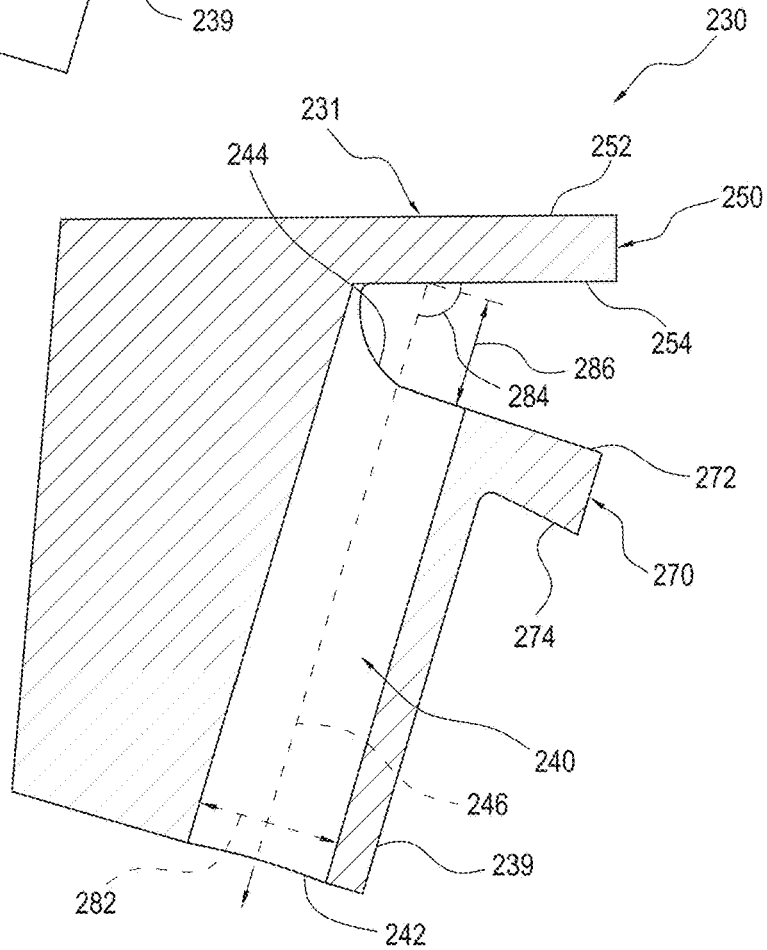
FIG. 47 is a cross-sectional view of the liquid dispenser of FIG. 44.

The body 239 of the liquid dispenser 231 defines a conduit 240 (e.g., passage, passageway, channel, waterway, tube, duct, etc.) for routing liquid 232 through the liquid dispenser 231. The conduit 240 extends within and along a portion of the length of the liquid dispenser 231. As shown in FIG. 47, the conduit 240 includes a conduit inlet 242 for the liquid 232 to flow into the conduit 240 and a conduit outlet 244 for the liquid 232 to flow out of the conduit 240. The conduit 240 extends along and directs the flow of liquid 232 along (and parallel to) a longitudinal axis 246 of the conduit 240 (which extends through the middle of the conduit 240). The body 239 and the conduit 240 (including the conduit inlet 342 and the conduit outlet 244) may optionally include any of the various features and configurations of the body 339 and the conduit 340 (including the conduit inlet 342 and the conduit outlet 344) (as described further herein), respectively, according to the desired configuration.

In order to create a laminar flow of the liquid 232 flowing through and exiting the liquid dispenser 231, the liquid dispenser 231 includes the top lip 250 which protrudes over the conduit outlet 244 in order to intercept the liquid flow from the conduit outlet 244 and create laminar flow. The top lip 250 includes a top surface 252 and a bottom surface 254 on opposite sides of the top lip 250. The bottom surface 254 is positioned such that the liquid 232 directly contacts and impacts the bottom surface 254 after exiting out of the conduit outlet 244. Accordingly, the bottom surface 254 deflects the liquid 232 flowing out from the conduit 240, as described further herein. The top lip 250 (including the top surface 252 and the bottom surface 254) may optionally include any of the various features and configurations of the deflector 346 (including the top surface 347 and the bottom surface 348) (as described further herein), according to the desired configuration.

According to one embodiment, the liquid dispenser 231 may also include the bottom lip 270 that extends from the body 239 of the liquid dispenser 231 directly underneath the top lip 250. The bottom lip 270 includes a top surface 272 and a bottom surface 274 on opposite sides of the bottom lip 270. As shown in FIG. 47, the top surface 272 of the bottom lip 270 may be angled relative to the bottom surface 254 of the top lip 250 in order to provide a greater area for the liquid 232 to exit the liquid dispenser 231 as laminar flow 238. According to an alternative embodiment, the liquid dispenser 231 may not include the bottom lip 270.

Figure 44:
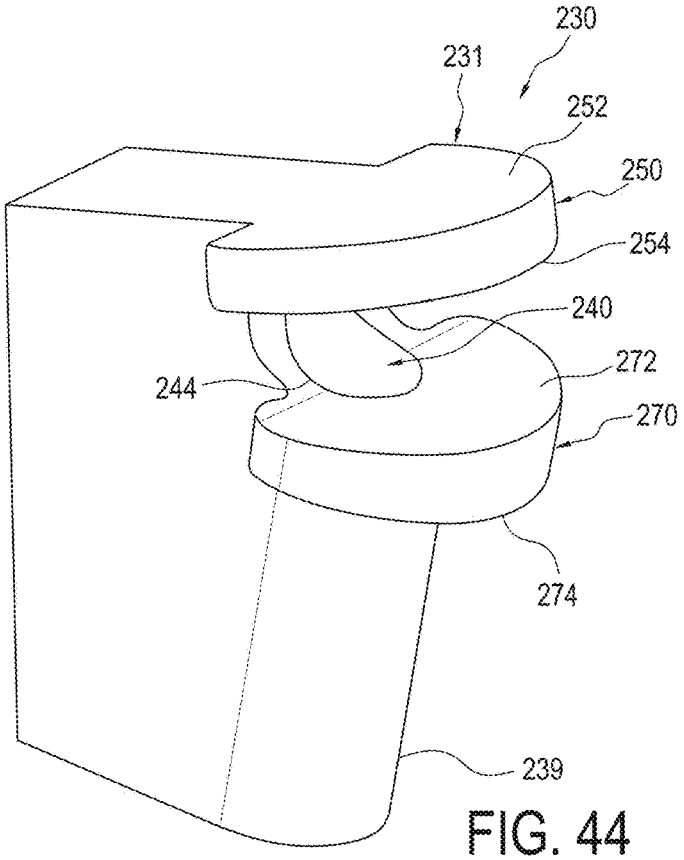
FIG. 44 is a perspective view of a liquid dispenser according to one embodiment.
Figure 45:
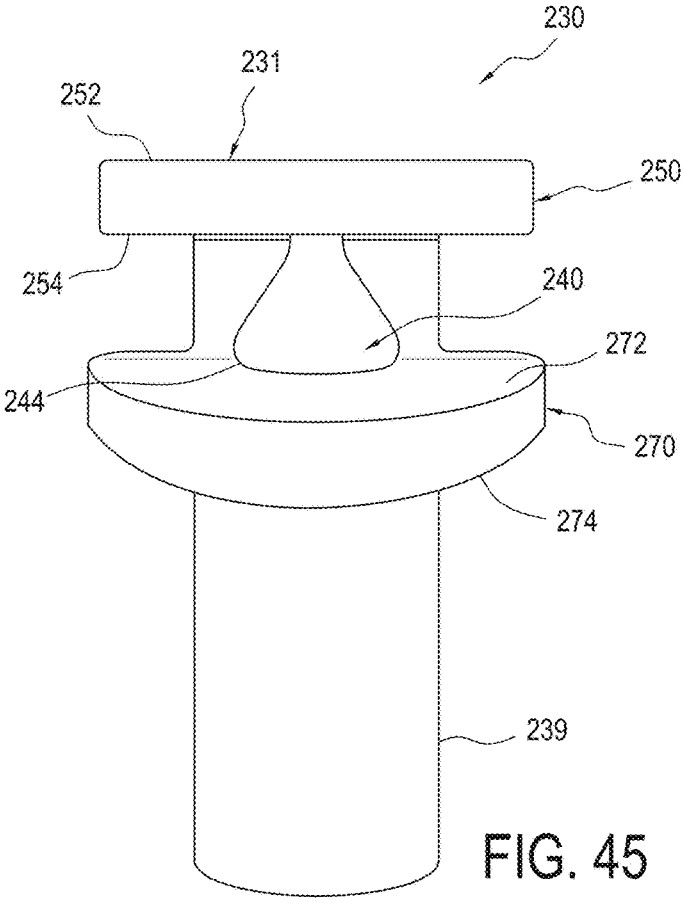
FIG. 45 is a front view of the liquid dispenser of FIG. 44.
Figure 46:
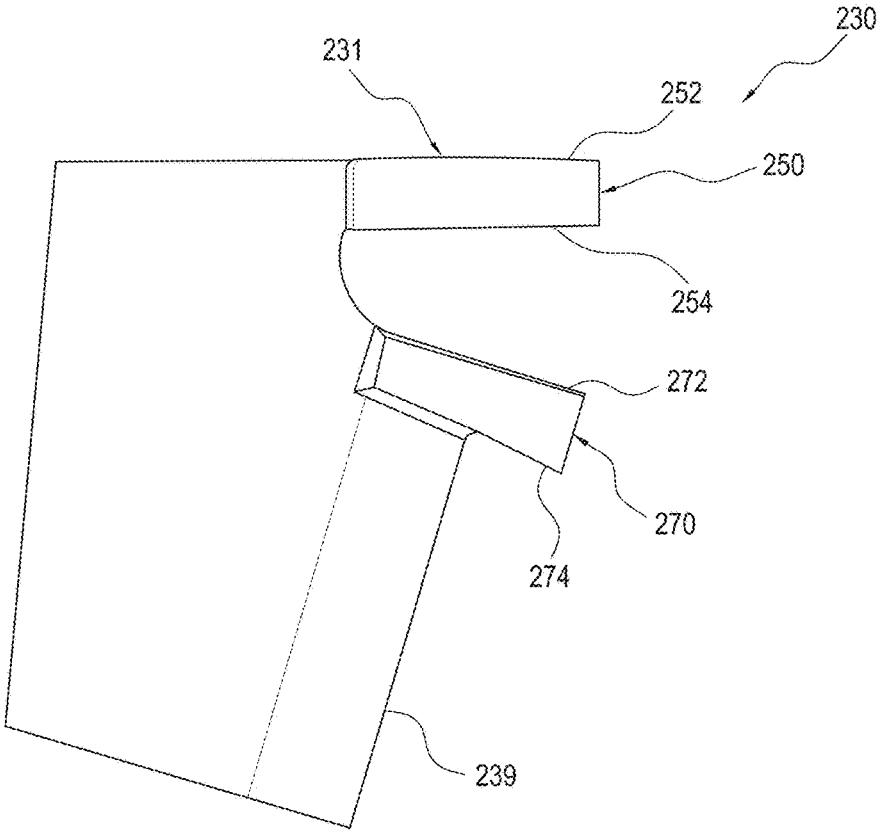
FIG. 46 is a side view of the liquid dispenser of FIG. 44.

The dimensions of the top lip 250 and the bottom lip 270 may vary according to the desired configuration. As shown in FIGS. 44-45, the width of the top lip 250 and/or the bottom lip 270 may be wider than the diameter 282 of the conduit 240 and the width of the body 239 of the liquid dispenser 231. The thickness of the top lip 250 and the bottom lip 270 may also vary according to the desired configuration.

The relative dimensions and ratios of dimensions of different portions of the liquid dispenser 231 may vary according to the desired configuration and according to the liquid flow rate for the specific use of the liquid dispenser 231. The relative dimensions, ratios of dimensions, and flow rate of the liquid 232 may affect how the liquid 232 flows out of the liquid dispenser 231 and the laminar flow 238 of the liquid 232. For example, the diameter 282 of the conduit 240, the angle 284 between the longitudinal axis 246 of the conduit 240 and the bottom surface 254 of the top lip 250, and the gap or distance 286 between the conduit outlet 244 and the bottom surface 254 of the top lip 250 may vary according to the desired configuration of the liquid dispenser 231 (and conduit 240) and according to each other (in order to obtain an optimal dimensional ratio to create an optimal laminar flow 238). Although the angle 284 refers to the angle between the longitudinal axis 246 of the conduit 240 and the bottom surface 254 of the top lip 250, the angle 284 thereby also refers to the angle of the conduit flow 236 of the liquid 232 exiting the conduit 240 (and before hitting the bottom surface 254 of the top lip 250).

Liquid Flow Through the Liquid Dispenser

Figure 48:
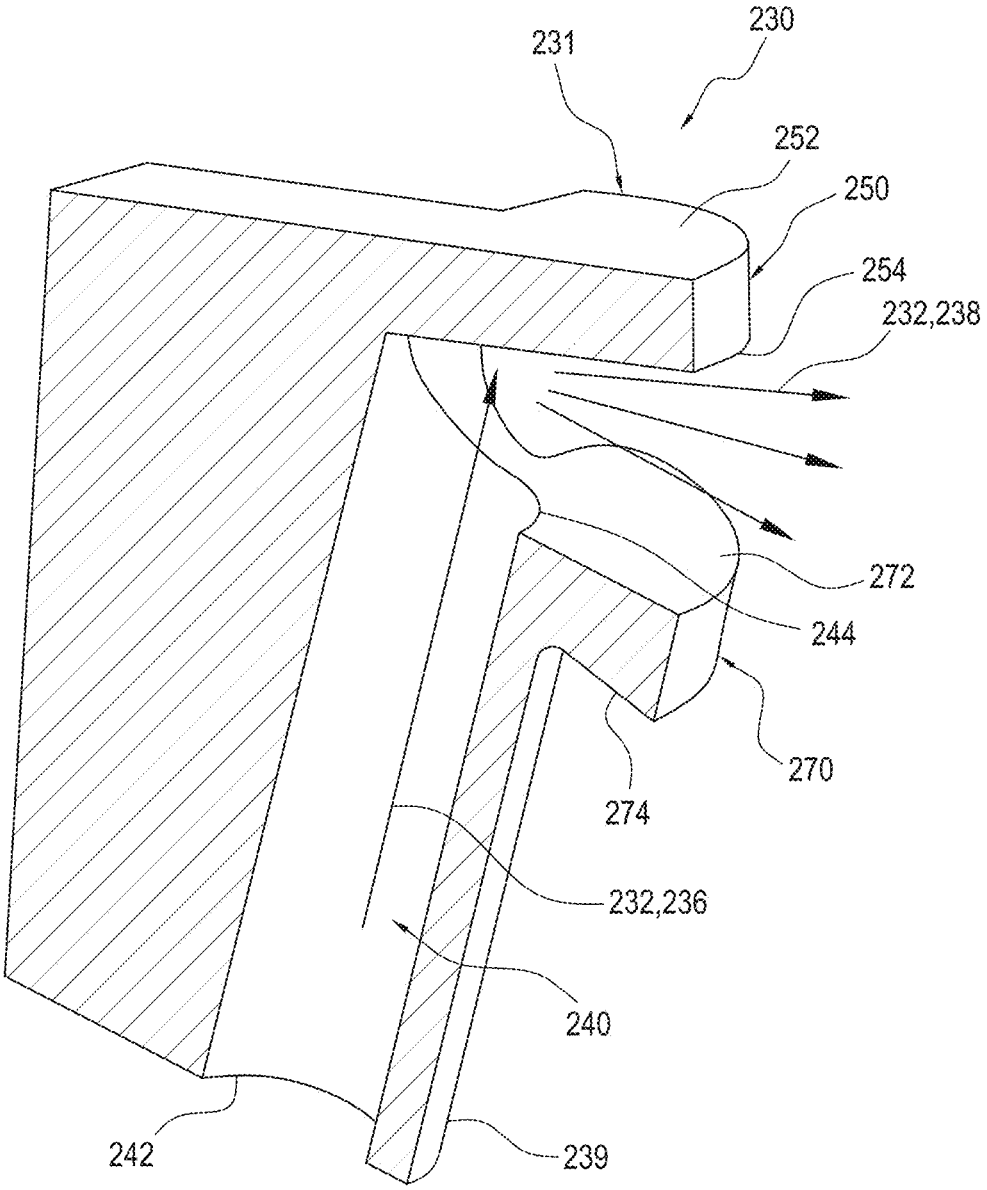
FIG. 48 is a perspective, cross-sectional view of the liquid dispenser of FIG. 44 with liquid flowing through the liquid dispenser.

As shown in FIG. 48, the liquid 232 flows through the liquid dispenser 231. The liquid 232 enters into the liquid dispenser 231 through the conduit inlet 242 of the conduit 240, flows through the conduit 240 (as conduit flow 236), and then exits the conduit 240 through the conduit outlet 244. The liquid 232 exiting the conduit 240 is directed to the bottom surface 254 of the top lip 250. When the liquid 232 contacts or hits the bottom surface 254 of the top lip 250, the bottom surface 254 deflects the liquid 232 and forces the liquid 232 to change from the conduit flow 236 into fan or laminar flow 238 as the liquid 232 splays, deflects, or fans outward and subsequently flows along the length of the bottom surface 254 of the top lip 250 and eventually completely out of the liquid dispenser 231 (as laminar flow 238).

The laminar flow 238 of the liquid 232 flows out from and exits out of the liquid dispenser 231 as a substantially flat and laminar fan, sheet, or layer of liquid 232. Comparatively, conventional liquid dispensers that create laminar flow cause the liquid to flow in a stream, rather than a substantially flat fan. Furthermore, unlike conventional liquid dispensers creating laminar flow, the liquid dispenser 231 does not use or require an aerator to create the laminar flow.

The laminar flow 238 of liquid 232 flowing out of the liquid dispenser 231 can flow in a variety of different widths according to the desired configuration. For example only, the laminar flow 238 of liquid 232 may flow out from the liquid dispenser 231 at approximately 120°, although it is understood that the liquid dispenser 231 can be configured such that the laminar flow 238 of liquid flows out from the liquid dispenser 231 at any angle greater or less than 120°. Comparatively, conventional liquid dispensers that create laminar flow do not allow the liquid to flow in as wide of a sheet as the liquid dispenser 231.

Additionally, the liquid dispenser 231 minimizes the amount of splash that the laminar flow 238 of liquid 232 creates and creates a laminar flow that is relatively less opaque than conventional liquid dispensers that create laminar flow. Accordingly, the laminar flow 238 of liquid 232 may appear more clear or transparent, which may be due to less air within the laminar flow 238 of liquid 232 due to the configuration of the liquid dispenser 231.

The liquid 232 may flow through the liquid dispenser 231 in a variety of different flow rates. For example only, the liquid 232 may flow through the liquid dispenser 231 at a flow rate between approximately 1 to 1.5 gallon/minute. However, it is understood that the flow of the liquid 232 may be more or less than 1 to 1.5 gallons/minute according to the desired use of the liquid dispenser 231. For example, if the liquid dispenser 231 is used within a handwashing station 220, the liquid 232 may flow at a rate of less than approximately 1 gallon/minute. The handwashing station 220 and the basin 222 may optionally include any of the various features and configurations of the handwashing station 20 or 320 and the basin 22 or 322 (as described further herein), respectively, according to the desired configuration.

It is understood that the liquid 232 can be a variety of different types of liquid, including water or a mixture of water and a cleansing liquid (e.g., soap).

Use of the Liquid Dispensing System

The liquid dispensing system 230 may be used within a variety of different liquid dispensing areas in which laminar flow 238 of liquid 232 is desired. For example, the liquid dispensing system 230 may be used within a sink or basin 222 (e.g., a bathroom sink or a kitchen sink).

Figure 49:
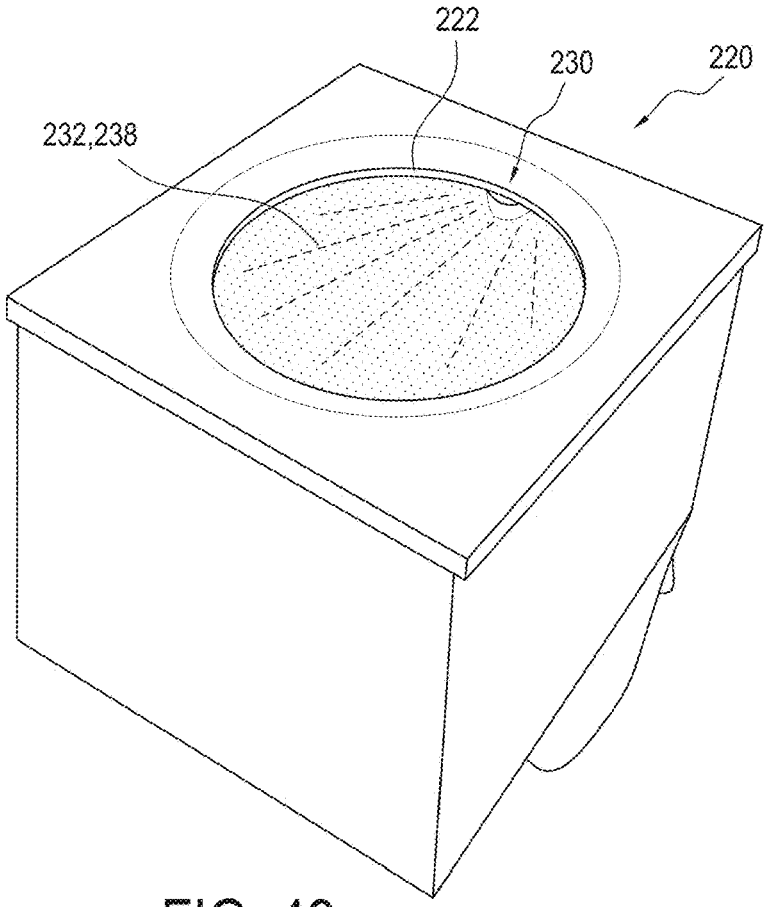
FIG. 49 is a perspective view of a sink with a liquid dispenser according to one embodiment.
Figure 50:
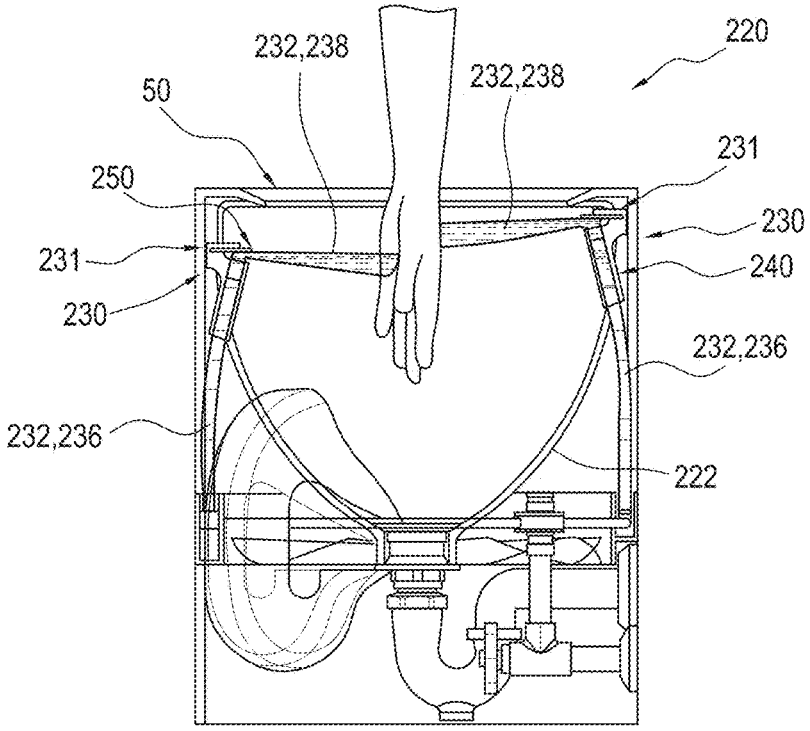
FIG. 50 is a side, cross-sectional view of a sink with two liquid dispensers according to yet another embodiment with a user's hands partially within the sink.

As shown in FIGS. 49-50, the liquid dispensing system 230 may be used and positioned within a basin 222 of a handwashing station 220. The liquid dispensing system 230 may cause the liquid 232 to flow over most (or all) of the top opening of the basin 222 as shown in FIG. 49. Accordingly, when the user places their hands within the basin 222 (as shown in FIG. 50), the liquid 232 from the liquid dispensing system 230 engulfs and surrounds the user's hands.

The various different liquid dispensing areas may include any number of liquid dispensing systems 230 (e.g., at least one liquid dispensing system 230). For example, as shown in FIG. 50, the handwashing station 220 may include two liquid dispensing systems 230 on opposite sides of the basin 222 in order to dispense liquid 232 in different directions and from different areas within the basin 222 at the same time and to completely submerse the user's hands in the liquid 232. According to one embodiment as shown in FIG. 50, the liquid dispensing systems 230 are positioned at different heights within the basin 222. However, according to another embodiment, the liquid dispensing systems 230 are positioned at the same height within the basin 222.

Furthermore, the liquid dispensing system 230 may optionally be used within a handwashing station 220 that includes other dispensers (e.g., an air dispensing system 50, as shown and described further herein), as shown in FIG. 50.

Alternate Embodiment of a Handwashing Station

FIGS. 51-83 show an alternate embodiment of a handwashing station 320. The handwashing station 320 may optionally include any of the various features and configurations of the handwashing stations 20 and 220 (as described further herein), according to the desired configuration. For example, the handwashing station 320 is configured to both wash and dry a user's hands, as described further herein in reference to the handwashing station 20.

Figure 52:
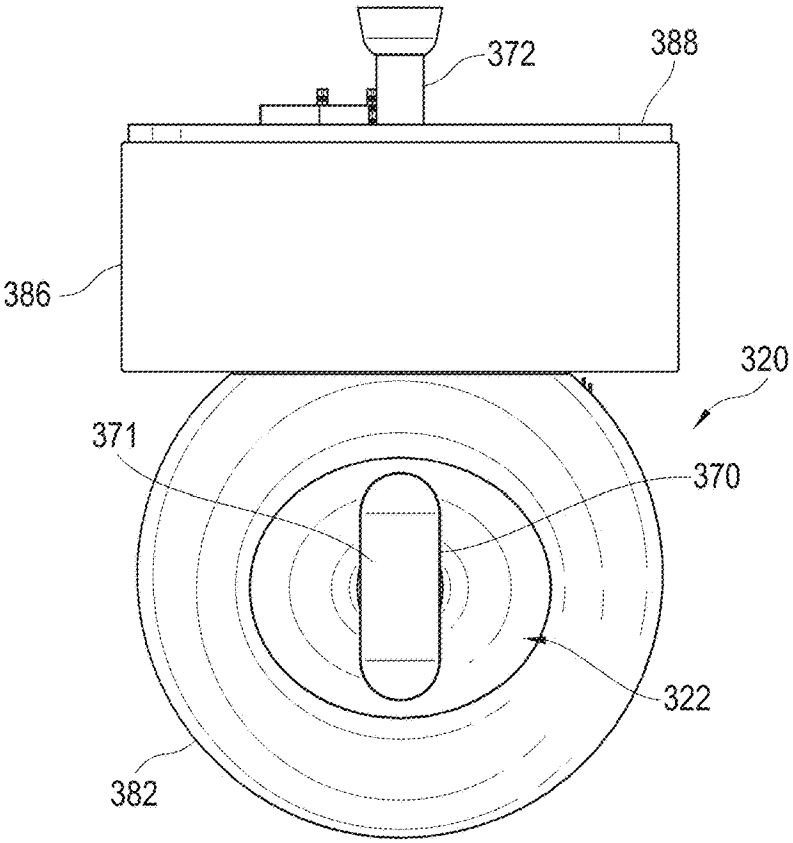
FIG. 52 is a top view of the handwashing station of FIG. 51.
Figure 51:
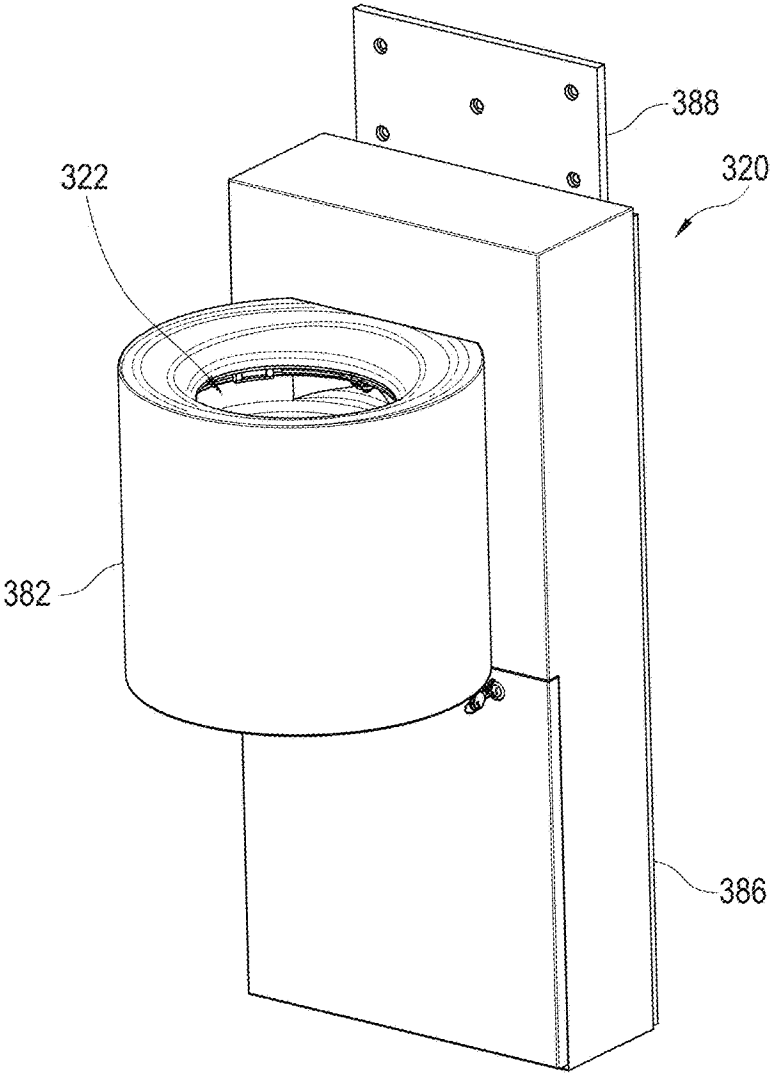
FIG. 51 is a perspective view of a handwashing station according to another embodiment.
Figure 54:
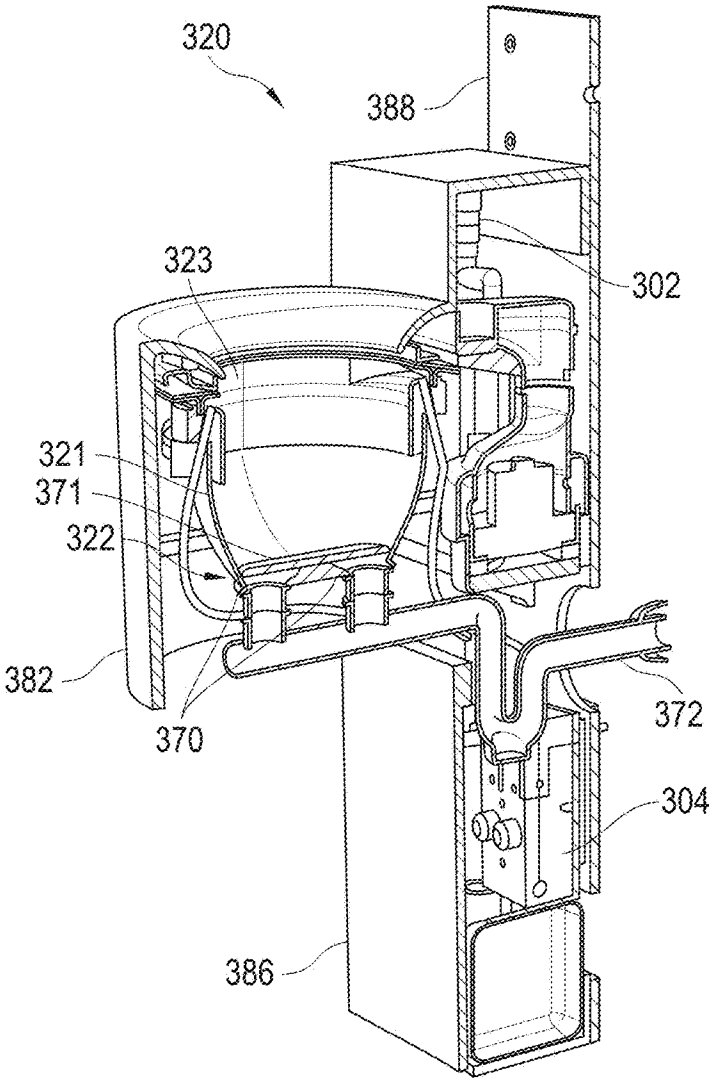
FIG. 54 is a cross-sectional view of the handwashing station of FIG. 51.
Figure 53:
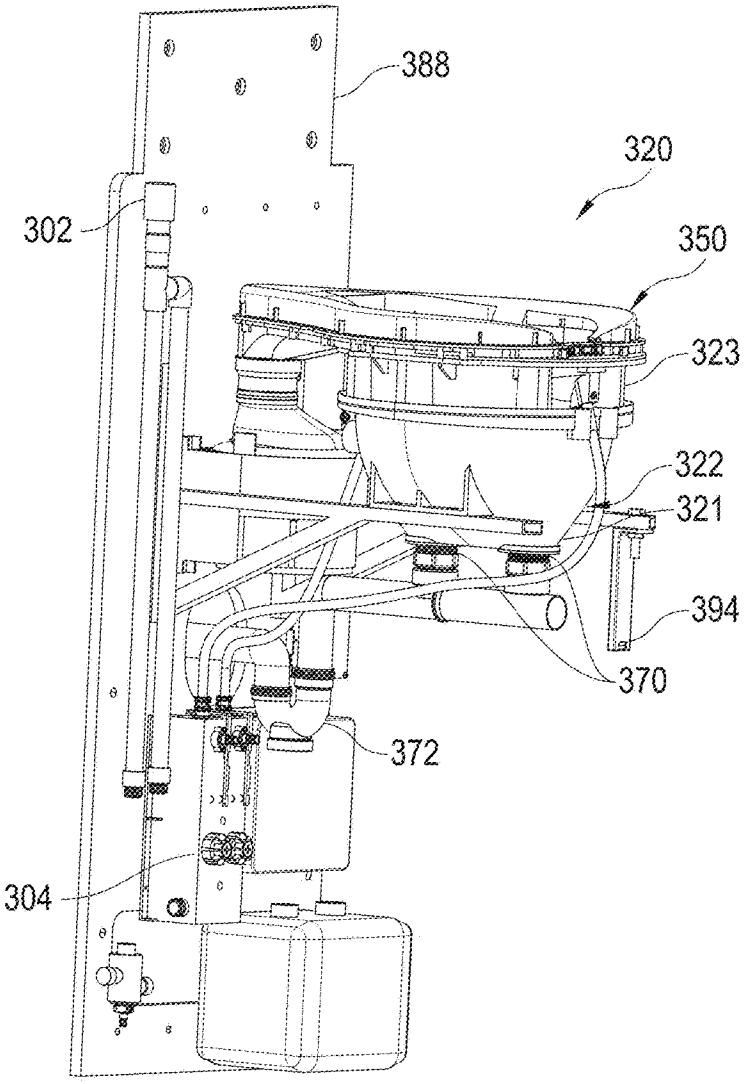
FIG. 53 is a perspective view of the handwashing station of FIG. 51.

As shown in FIGS. 51-52, the handwashing station 320 includes exterior components 382, a base 386, and a frame 388 that are configured to support and/or conceal the various features of the handwashing station 320. The exterior components 382 and the base 386 conceal or cover various components of the handwashing station 320 (i.e., the basin structure 322 and the plumbing, respectively). The exterior components 382 and the base 386 may also conceal various tubing and fluid lines and a soap reservoir. The handwashing station 320 further includes plumbing 372 that may extend from within the exterior components 382, through the base 386, and through the frame 388 (as shown in FIG. 54) and into, for example, a wall of the bathroom. The exterior components 382, the base 386, and the plumbing 372 may optionally include any of the various features and configurations of the exterior components 82, the base 86, and the plumbing 72 (as described further herein), respectively, according to the desired configuration. As shown in FIG. 53, the frame 388 extends along the height of the handwashing station 320 for support.

As shown in FIGS. 51-56, the handwashing station 320 includes a basin structure 322 that is configured to contain and drain liquids. As shown in FIG. 52, the basin structure 322 may optionally have an oval or oblong shape. The basin structure 322 has a two-part or two-piece construction that includes a lower basin 321 and an overlapping rim 323 (as described further herein). The basin structure 322 may optionally include any of the various features and configurations of the basins 22 and 222 (as described further herein), according to the desired configuration. In order to provide water into the basin structure 322, the water flows from a water source through a waterway (not shown), into and through a vacuum breaker 302, into and through a solenoid valve 304 (see FIGS. 53-54), through a water dispenser 331 (as shown and described further herein), and into the basin 22. However, the vacuum breaker 302 is an optional feature and the handwashing station 320 may not include any vacuum breaker. Instead, the handwashing station 320 may include other safety features, as described further herein.

Figure 56:
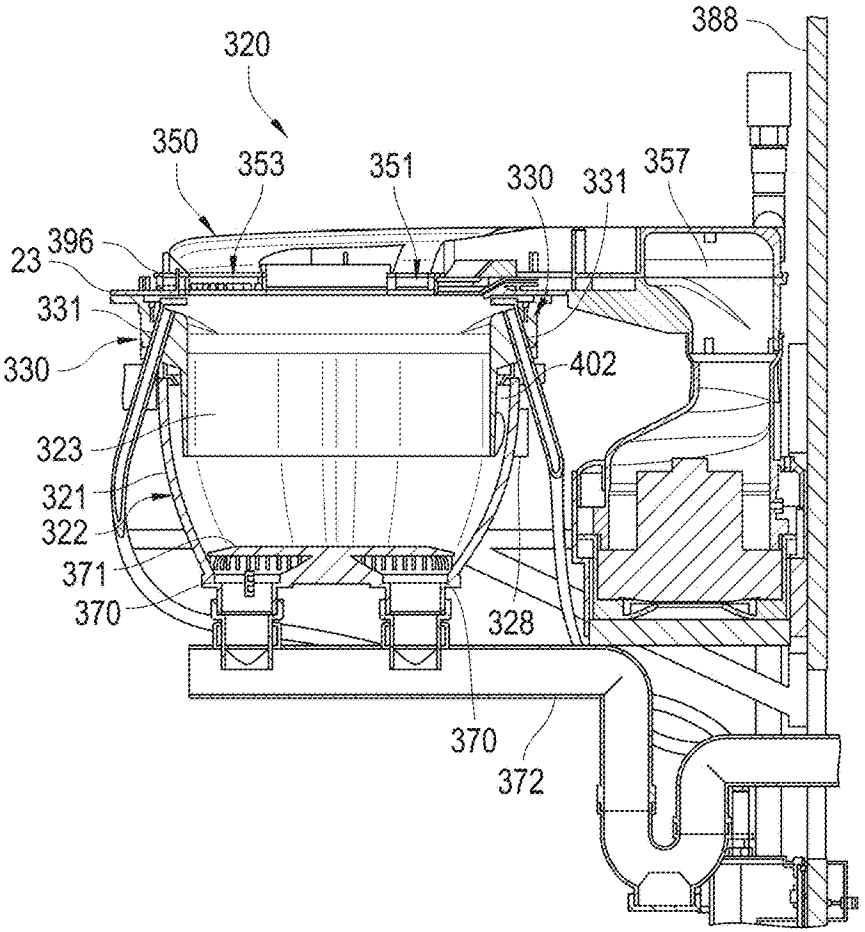
FIG. 56 is a cross-sectional view of the other half of the handwashing station of FIG. 51.
Figure 55:
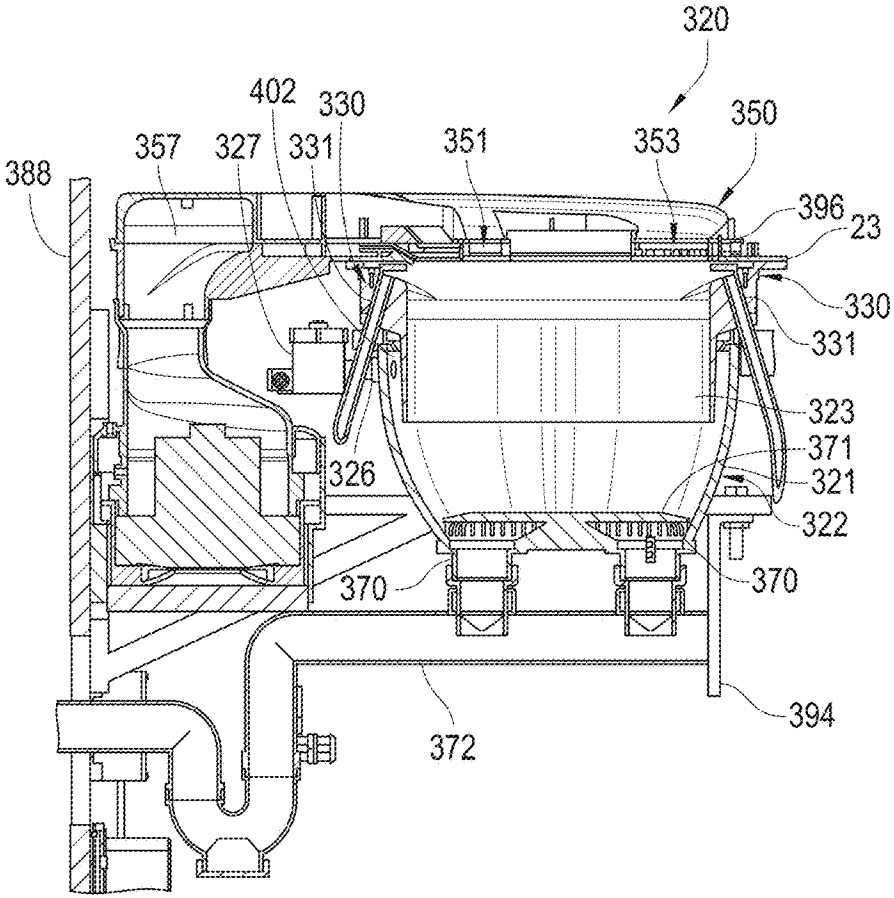
FIG. 55 is a cross-sectional view of one half of the handwashing station of FIG. 51.

As shown in FIGS. 53-56, the handwashing station 320 has two drains 370 (i.e., a dual drain) along the bottom portion of the lower basin 321 to allow liquid and air to drain from within the basin structure 322. The drains 370 may be aligned with each other along the depth of the basin structure 322 (i.e., between the user side and the wall side of the basin structure 322). The drains 370 converge with each other into the plumbing 372 beneath the basin structure 322. However, a single drain may alternatively be used in the handwashing station 320. As shown in FIGS. 54-56 (as well as FIG. 68), the handwashing station 320 may further include a drain cover 371 positioned at the bottom of the basin 22 (above the drains 370) that covers the top of both of the drains 370 (while still allowing fluid to flow into each of the drains 370 from the sides of the drain cover 371). The drains 370 and the drain cover 371 may optionally include any of the various features and configurations of the drain 70 and the drain cover 71 (as described further herein), according to the desired configuration.

In order to detect that a user has approached the handwashing station 320, the handwashing station 320 may include at least one body sensor 394, as shown in FIGS. 53 and 55. The front of the body sensor 394 is faced away from the basin structure 322 in order to detect when the user approaches the handwashing station 320.

Figure 57:
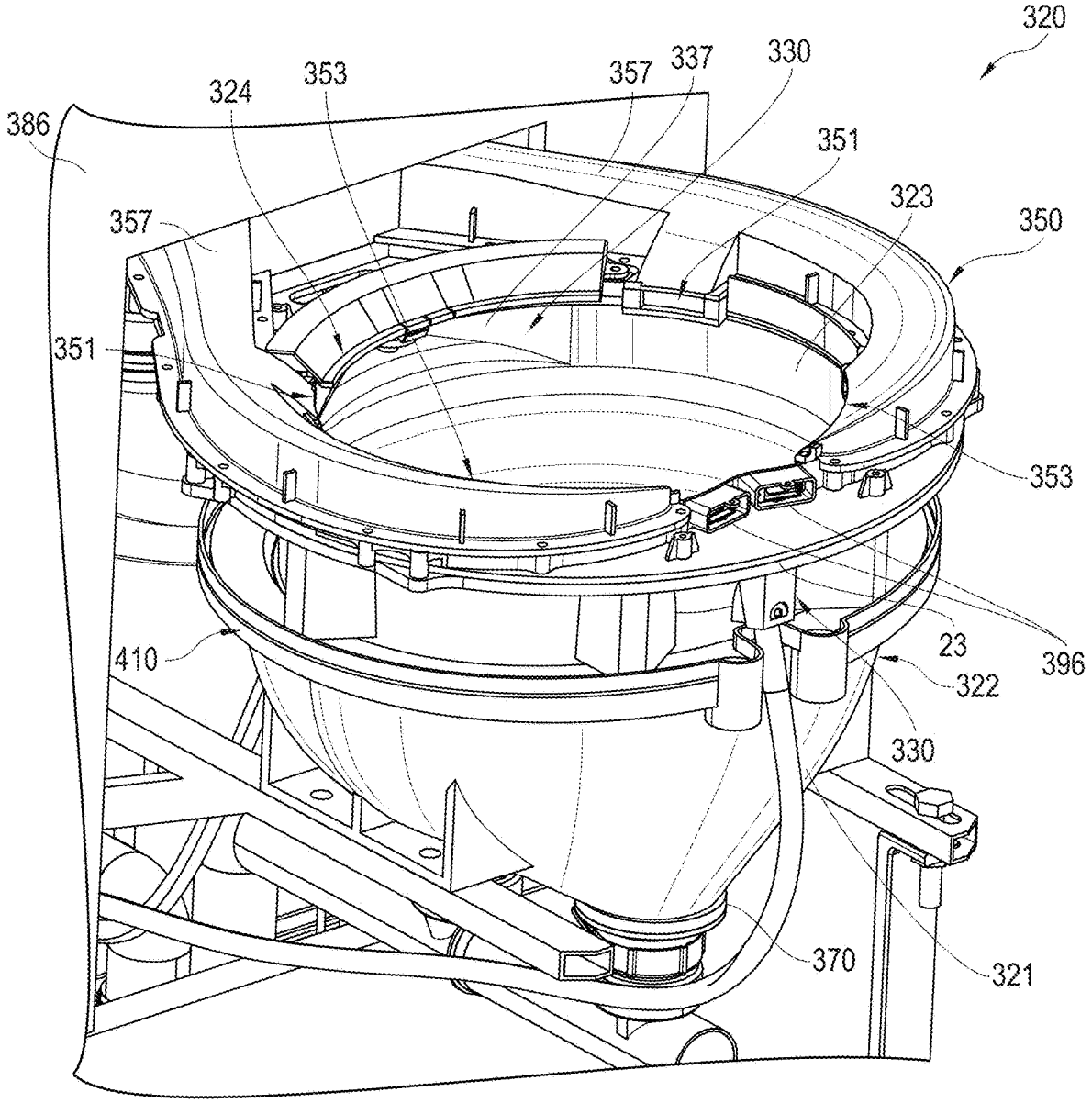
FIG. 57 is a perspective view of a basin structure of the handwashing station of FIG. 51.
Figure 66:
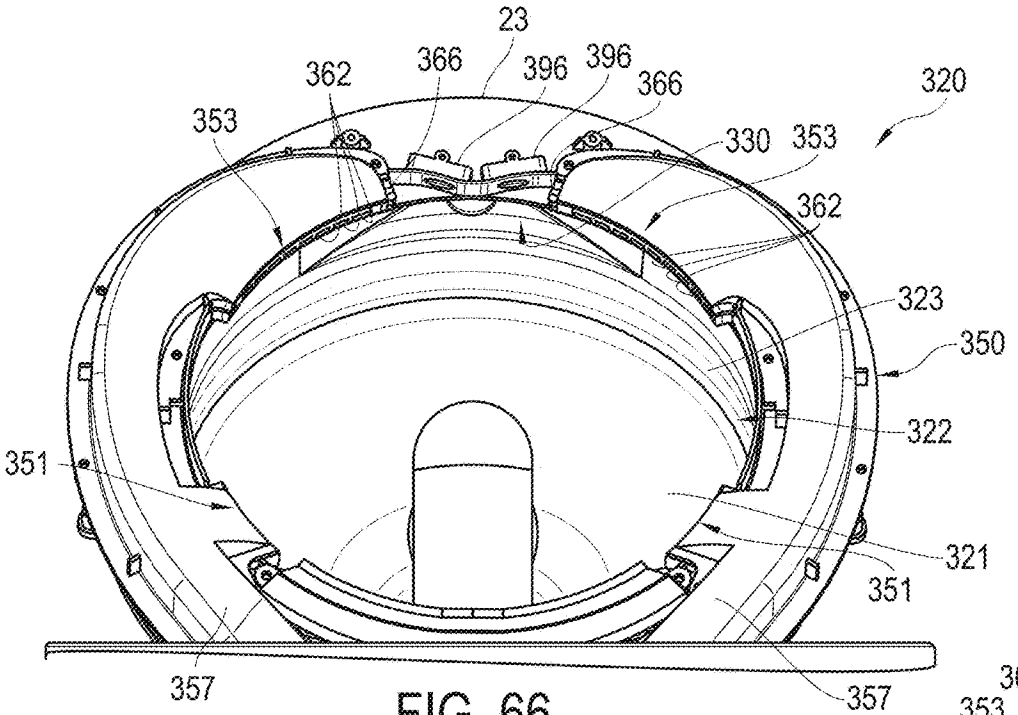
FIG. 66 is a top view of an air dispensing assembly of the handwashing station of FIG. 51.
Figure 67:
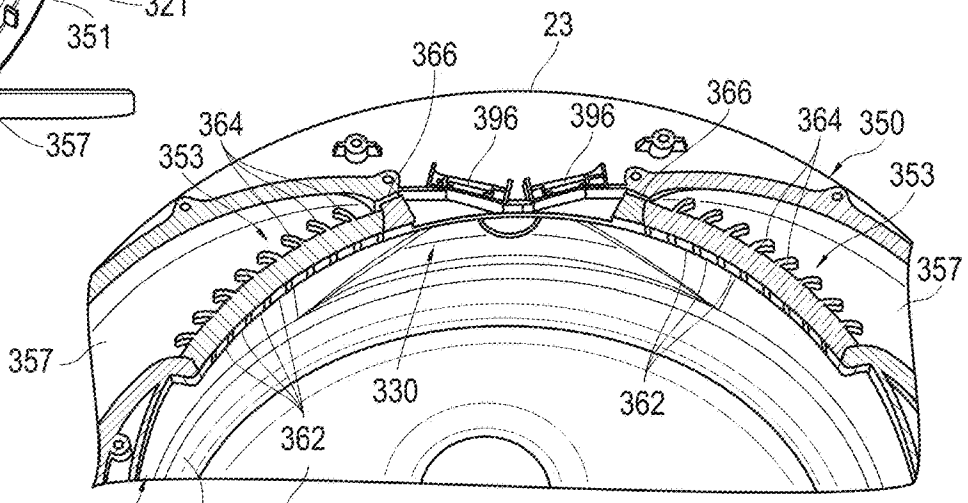
FIG. 67 is a top, cross-sectional view of the air dispensing assembly of FIG. 66.
Figure 68:
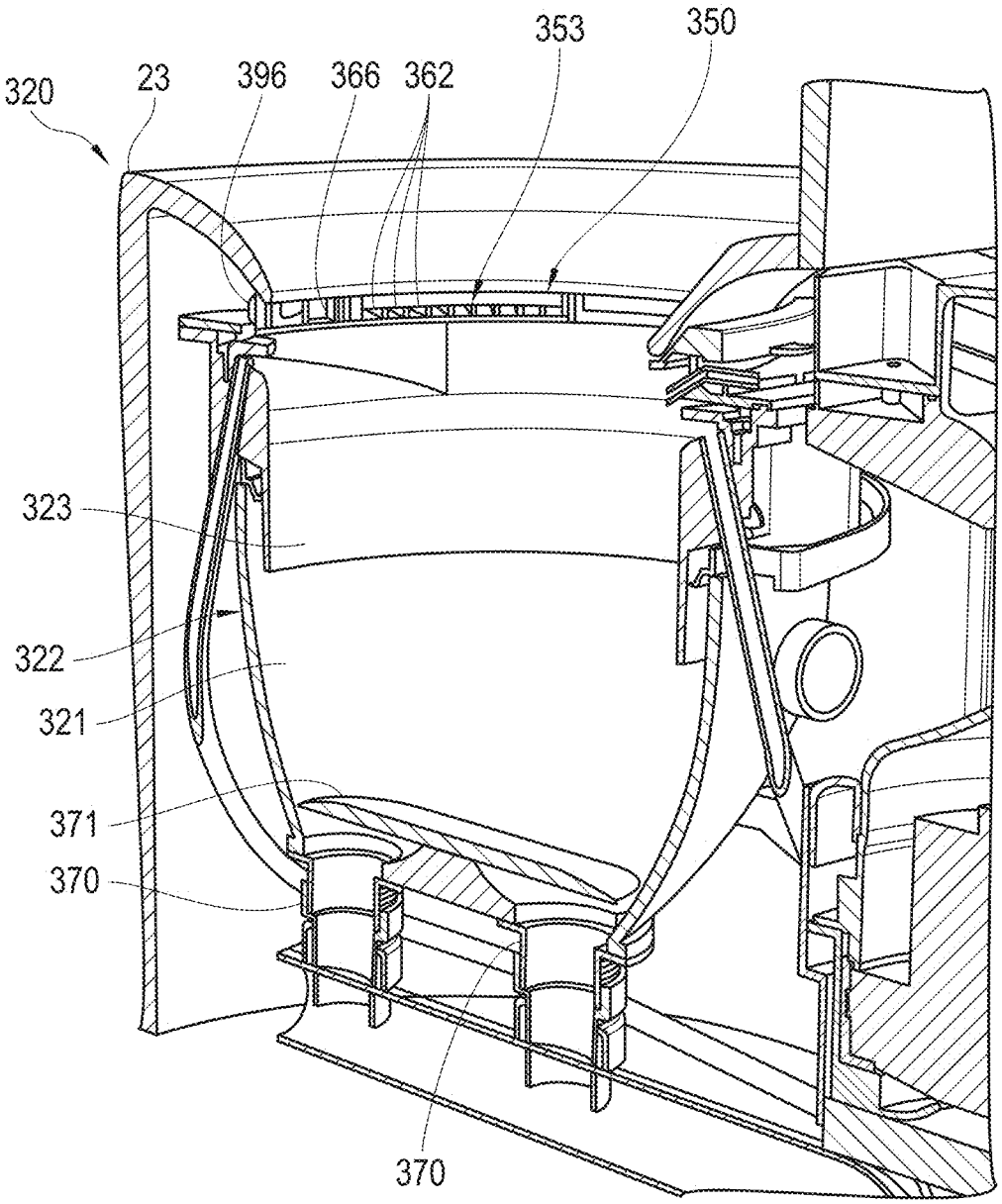
FIG. 68 is a side, cross-sectional view of the air dispensing assembly of FIG. 66.

In order to detect the presence of at least one hand within the basin structure 322, the handwashing station 320 also includes at least one hand sensor 396, as shown in FIGS. 55-57 (as well as FIGS. 66-68). The hand sensor 396 is configured to sensor or detect when the user has inserted or positioned their hand into the basin structure 322. According to one embodiment, the handwashing station 320 has two hand sensors 396 that are positioned toward the top of the basin structure 322 along the user side 23. The hand sensors 396 may be positioned next to each other in a gap along the perimeter between the ends of the two air channels 357. The hand sensors 396 are positioned such that the front of the hand sensors 396 faces toward the basin structure 322 (i.e., away from the user side 23). The body sensor 394 and the hand sensor 396 may be a variety of different types of sensors (e.g., proximity, infrared, or laser sensors), depending on the desired configuration.

As shown in FIGS. 55-57 and as described further herein, the handwashing station 320 includes a liquid dispensing system 330 that is configured to dispense liquid into the basin structure 322 and an air dispensing system 350 that is configured to dispense air into the basin structure 322. The liquid dispensing system 330 and the air dispensing system 350 may optionally include any of the various features and configurations of the liquid dispensing systems 30 and 230 and the air dispensing system 50 (as described further herein), respectively, according to the desired configuration.

As shown in FIGS. 55-57, the handwashing station 320 has two liquid dispensing systems 330 that are positioned along different areas of the basin structure 322, such as opposite inner sides of the basin structure 322. Accordingly, the liquid dispensing systems 330 dispense liquid (i.e., water) in different directions within the basin structure 322, as described further in reference to the liquid dispensing system 30.

The liquid dispensing system 330 dispenses liquid (i.e., soap and water) in two different manners. More specifically, as shown in FIGS. 58-59, the liquid dispensing system 330 includes both a soap nozzle or dispenser 338 that is configured to dispense soap and a water nozzle or dispenser 331 that is configured to dispense water. Accordingly, the liquid dispensing system 330 can dispense soap and water at the same time or separately, depending on the desired configuration and/or current step in the handwashing process. The soap dispenser 338 and the water dispenser 331 may be configured, however, to dispense other liquids other than (or in addition to) soap and water, respectively.

As shown in FIGS. 58-59, the soap dispenser 338 is positioned above or directly on top of the water dispenser 331. Accordingly, as described further herein, the soap dispenser 338 is configured to dispense soap at the same time the water dispenser 331 is dispensing water such that the soap is dispensed on top of the fan of water from the water dispenser 331. Accordingly, the soap rides on top of and is at least partially carried by the layer of water from the water dispenser 331 (see, for example, FIG. 77).

The water dispenser 331 (as shown in FIGS. 60-65) is configured to dispense the water into the basin structure 322 in a substantially flat fan shape with laminar flow, as described further herein. Accordingly, the water dispenser 331 may optionally include any of the various features and configurations of the liquid dispensers 31 and 231 (as described further herein), according to the desired configuration.

Figure 64:
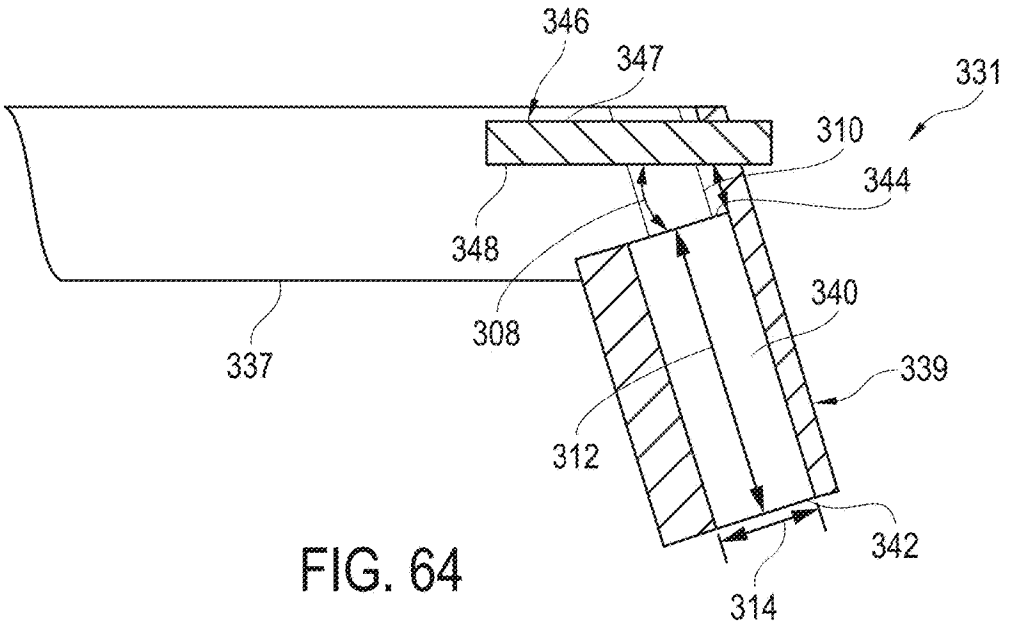
FIG. 64 is a cross-sectional view of the liquid dispensing assembly of FIG. 60 with side walls.
Figure 65:
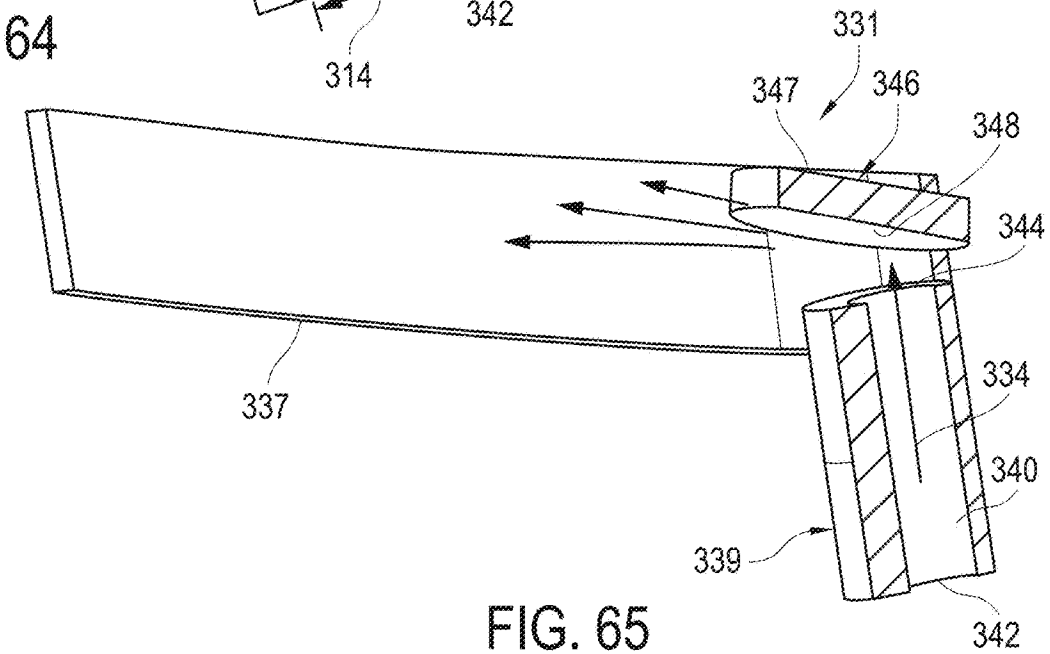

As shown in FIGS. 60-65, the water dispenser 331 includes a body 339 that defines a conduit 340 for routing liquid (i.e., water 334) through the water dispenser 331 (as shown in FIG. 65). The conduit 340 includes a conduit inlet 342 for the water 334 to flow into the conduit 340 and a conduit outlet 344 for the water 334 to flow out of the conduit 340. The body 339 and the conduit 340 (including the conduit inlet 342 and the conduit outlet 344) may optionally include any of the various features and configurations of the body 239 and the conduit 240 (including the conduit inlet 242 and the conduit outlet 244) (as described further herein), respectively, according to the desired configuration.

In order to create a laminar flow of the water 334 flowing through and exiting the water dispenser 331, the water dispenser 331 includes a top flange or deflector 346 which protrudes over the conduit outlet 344 in order to intercept the liquid flow from the conduit outlet 244 and create laminar flow. The deflector 346 includes a top surface 347 and a bottom surface 348 on opposite sides of the deflector 346. The bottom surface 348 is positioned such that the water 334 directly contacts and impacts the bottom surface 348 after exiting out of the conduit outlet 344 (as shown in FIG. 65). Accordingly, the bottom surface 348 deflects the water 334 flowing out from the conduit 340. As the water 334 deflects off the bottom surface 348 of the deflector 346, the water 334 flows in a laminar layer (i.e., a flat and clear water stream, such as the laminar flow 238, as described further herein). The deflector 346 (including the top surface 347 and the bottom surface 348) may optionally include any of the various features and configurations of the top lip 250 (including the top surface 252 and the bottom surface 254) (as described further herein), according to the desired configuration.

As shown in FIGS. 61-66, the water dispenser 331 may further include two side walls 337 on either side of the body 339 and the deflector 346. The side walls 337 stretch the laminar layer of water 334 horizontally (both widthwise and lengthwise) as (and after) the water 334 is deflected off of the deflector 346. Accordingly, the side walls 337 extend along the sides of the body 339 and the deflector 346 and may optionally be tangent to the body 339 and the deflector 346. The side walls 337 form a curve or arc around the body 339 and the deflector 346.

Figure 62:
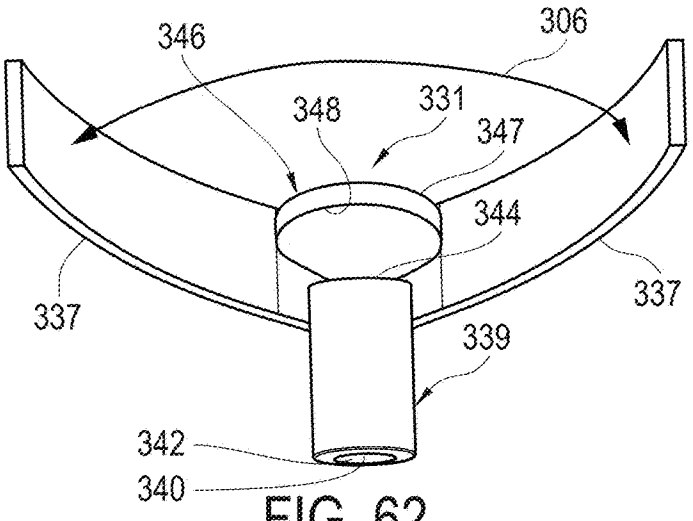
FIG. 62 is a perspective view of the liquid dispensing assembly of FIG. 60 with side walls.

The height of the side walls 337 is approximately equal to or greater than the gap between the conduit outlet 344 and the bottom surface 348 of the deflector 346 (although the side walls 337 may not extend into the gap). The side walls 337 extend from behind the body 339 and the deflector 346, along at least a portion of the sides of the body 339 and the deflector 346, and in front of the body 339 and the deflector 346 (off to the sides of the body 339 and the deflector 346). The angle 306 between the side walls 337 is less than 180°, as shown in FIG. 62. The side walls 337 may optionally be a part of the inner walls of the basin structure 322 (as shown in FIGS. 58-59).

The water dispenser 331 and its components may have a variety of different dimensions and relative positions according to the desired configuration and the flow rate of the water 334 through the water dispenser 331. As shown in FIG. 64, the conduit 340 is positioned at an angle 308 relative to the bottom surface 348 of the deflector 346 that may range between an angle greater than 0° and less than 90°. The body 339 defining the conduit 340 is a completely separate part and disconnected from the deflector 346 (i.e., not connected to each other through a tangent surface) such that the conduit outlet 344 is spaced apart from the bottom surface 348 of the deflector 346 by a distance 310 that is greater than zero and that creates a gap between the conduit outlet 344 and the bottom surface 348 of the deflector 346. According to some embodiments, however, the distance 310 may be approximately zero. In order to create the proper flow of water 334, the inside of the conduit 340 has a length 312 that does not have any turns or bends and provides a clean and relatively smooth area with good surface quality for the water 334 to flow along. The length 312 extends between the conduit inlet 342 and the conduit outlet 344. Additionally, the conduit 340 has a certain diameter 314 in order to provide the proper flow of water 334.

For example, for approximately water 334 flowing at approximately 1.5 to 2.3 gpm through the water dispenser 331, the angle 308 is approximately 16 to 20° (and preferably approximately 17°), the distance 310 is approximately 3.58 mm, the length 312 is approximately 93 mm, and the diameter 314 is approximately 7.5 mm. However, if the flow rate of the water 334 decreases, the water dispenser 331 may be configured to have a smaller angle 308 (and vice versa). Additionally, the various dimensions may affect each other. For example, if the diameter 314 is smaller, the length 312 can also be smaller (and vice versa).

As shown in FIGS. 66-68, the air dispensing system 350 is positioned along the top of or above the basin structure 322 to dispense air into the basin structure 322. Accordingly, the air dispensing system 350 dispenses air in different directions into the basin structure 322, as described further in reference to the air dispensing system 350.

The air dispensing system 350 includes at least one air channel 57 configured to direct the air around and into the basin structure 322. For example, the air dispensing system 350 includes two air ducts or channels 357 extending from and diverge away from each other along the back of the handwashing station 320 (i.e., from within a wall or the base 386, as shown in FIG. 57 for example) and around at least a portion of the perimeter of the basin structure 322 (about the top portion of the basin structure 322). Accordingly, the air channels 357 curve or are contoured according to the contour of the basin structure 322 in a substantially C-shape manner. As shown in FIG. 66, each of the air channels 357 includes two air outlets or dispensers: a first air dispenser 351 and a second air dispenser 353 (such that there are two first air dispensers 351 and two second air dispensers 353 in the handwashing station 320). The first air dispenser 351 and the second air dispenser 353 are configured to direct air into the basin structure 322 in different manners and are positioned along different areas of the basin structure 322.

The first air dispensers 351 are positioned toward the back of the basin structure 322 (i.e., toward the base 386) and may include a longitudinal slit or opening that allows air to move from the air channel 357 and into the basin structure 322 (as shown, for example, in FIG. 57).

The second air dispensers 353 are positioned toward the front of the basin structure 322 (i.e., toward the user side 23, relative to the first air dispensers 351) and curve about a portion of the perimeter of the basin structure 322. The second air dispensers 353 each include at least one basin hole 362 and at least one sensor hole 366. As shown in FIGS. 66-68, the second air dispensers 353 include multiple basin holes 362 positioned and curving along a portion of the perimeter of the basin structure 322. The basin holes 362 are positioned directly next to each other. The basin holes 362 are configured to direct the air directly inwardly into the basin structure 322 from the perimeter in a substantially horizontal manner or downward manner into the basin structure 322. In order to direct the air into the basin holes 362, the second air dispensers 353 each include curved ribs 364 positioned between each of the basin holes 362 within the air channel 357, as shown in FIG. 67.

The sensor holes 366 of the second air dispensers 353 are positioned closest to the front of the basin structure 322 (i.e., the user side 23, relative to the basin holes 362) and adjacent to the hand sensors 396 (as described further herein) in order to direct air toward the hand sensors 396. Due to use, the hand sensors 396 may get wet or dirty from liquid, soap, and any residue that has accumulated on the hand sensors 396 as a result of the user using the handwashing station 320. In order to clean the hand sensors 396 and clear off the front surface of the hand sensors 396 (to keep the hand sensors 396 functional and able to accurately sense or detect the presence of the user's hands for activation of the handwashing station 320), the sensor holes 366 are each configured to direct air tangentially across the front (e.g., the front surface) of the hand sensors 396 (while the user's hands are being dried by the air dispensing system 350) in a direction that is substantially tangential to the perimeter of the basin structure 322, as shown in FIG. 67. Accordingly, the air flow from the sensor holes 366 of the second air dispensers 353 of the air dispensing system 350 cleans off water, dirt, and residue from the hand sensors 396 every time the air dispensing system 350 is initiated. Additionally, the sensor holes 366 and the basin holes 362 direct air in two directions that are approximately 90° from each other.

The first air dispenser 351 and the second air dispenser 353 may optionally include any of the various features and configurations of the air dispenser 51 (as described further herein), according to the desired configuration. Additionally, the air channel 357 may optionally include any of the various features and configurations of the air channel 57 (as described further herein), according to the desired configuration.

Occasionally, liquid may not sufficiently drain from the basin structure 322 due to, for example, a clogged or closed drain or a reverse vacuum within the water line in which liquid is reversed through the plumbing, in particular the drain lines. In order to prevent any liquid from damaging the various components of the handwashing station 320 (such as the electronics) and to prevent any liquid from flowing backward into the liquid dispensing system 330 (which could contaminate the water source) or the air dispensing system 350, the handwashing station 320 includes various safety features in the event that liquid is not sufficiently drained from within the basin structure 322. This is particularly important since the water dispensers 331 of the liquid dispensing system 330 are positioned within the basin structure 322 (and therefore below the top of the basin structure 322). Additionally, liquid drainage into the air dispensing system 350 may harm the air pump and/or motor.

Figure 69:
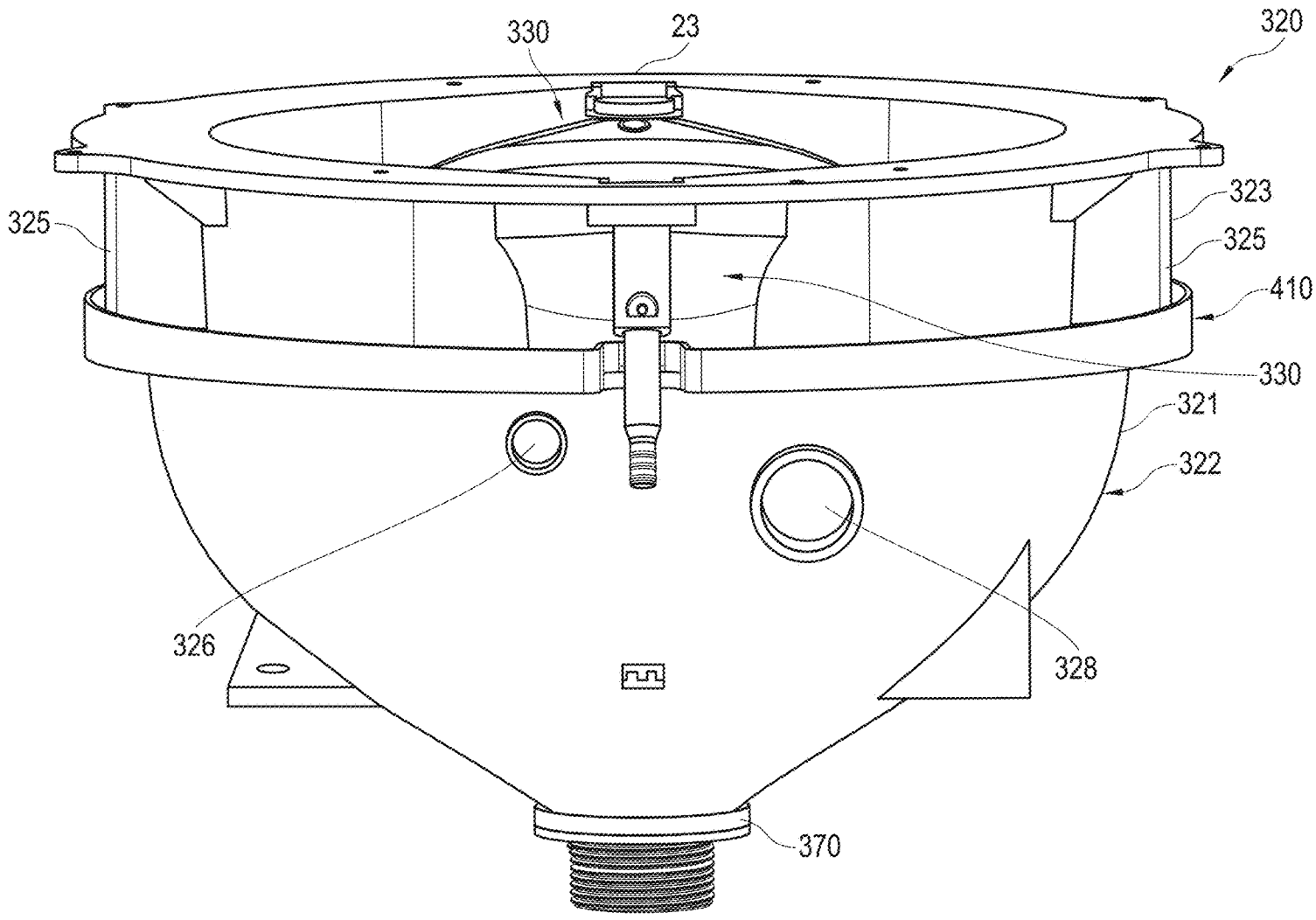
FIG. 69 is a back view of the basin structure of the handwashing station of FIG. 51.

As shown in FIG. 69, the basin structure 322, in particular the lower basin 321 includes an overflow hole 328 to allow liquid to drain out of the basin structure 322 if the liquid level within the basin structure 322 gets too high to prevent the liquid from overflowing or damaging any components. The overflow hole 328 provides a primary way of draining excess or overflow liquid from the basin structure 322 (aside from the drains 370). The overflow hole 328 extends completely through the wall of the lower basin 321 to allow liquid within the basin structure 322 to exit or drain from the basin structure 322 through an alternate route (i.e., alternate to the drains 370). The overflow hole 328 may connect to the plumbing 372 to direct the excess liquid into directly into the plumbing 372 (and thereby circumvent the drains 370).

As further shown in FIG. 69, the basin structure 322, in particular the lower basin 321 includes a sensor hole 326 that fluidly connects to the liquid sensor 327 (as shown in FIG. 55). The sensor hole 326 extends completely through the wall of the lower basin 321 to allow liquid within the basin structure 322 to flow into the sensor hole 326 once the liquid reaches a certain level within the basin structure 322. The sensor hole 326 is positioned higher than (along the vertical direction) the overflow hole 328 such that liquid first drains from the basin structure 322 through the overflow hole 328 and then, if the liquid level continues to rise, the liquid then flows through the sensor hole 326 and into the liquid sensor 327. Both the sensor hole 326 and the overflow hole 328 may be positioned along the top portion of the lower basin 321 that is covered or overlapped by the overlapping rim 323 (i.e., along the gap 402) (as described further herein) in order to obscure the sensor hole 326 and the overflow hole 328 and prevent the sensor hole 326 and the overflow hole 328 from being seen within the basin structure 322 (see, for example, FIGS. 55-56).

When liquid enters into the liquid sensor 327, the liquid sensor 327 shuts down or turns off the entire handwashing station 320 as a safety measure. For example, the liquid entering the liquid sensor 327 may cause a float to be moved upward. Subsequently, the liquid sensor 327 either sends a signal to disconnect electricity to the rest of the handwashing station 320 or to physically disconnect electricity such that the handwashing station 320 stops functioning, which protects the various components of the handwashing station 320, in particular the electrical components.

Figure 71:
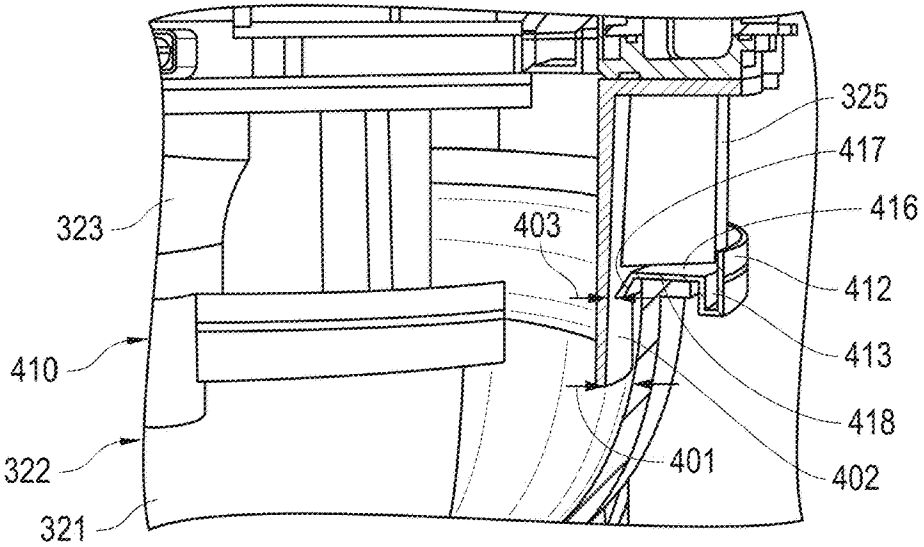
FIG. 71 is an enlarged view of a portion of FIG. 70.
Figure 72:
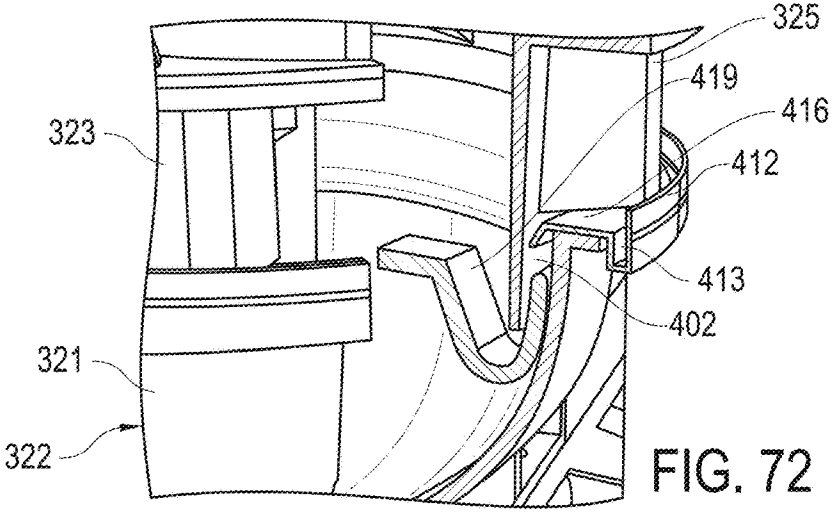
FIG. 72 is an enlarged view of a portion of FIG. 70 with the gap being cleaned.
Figure 70:
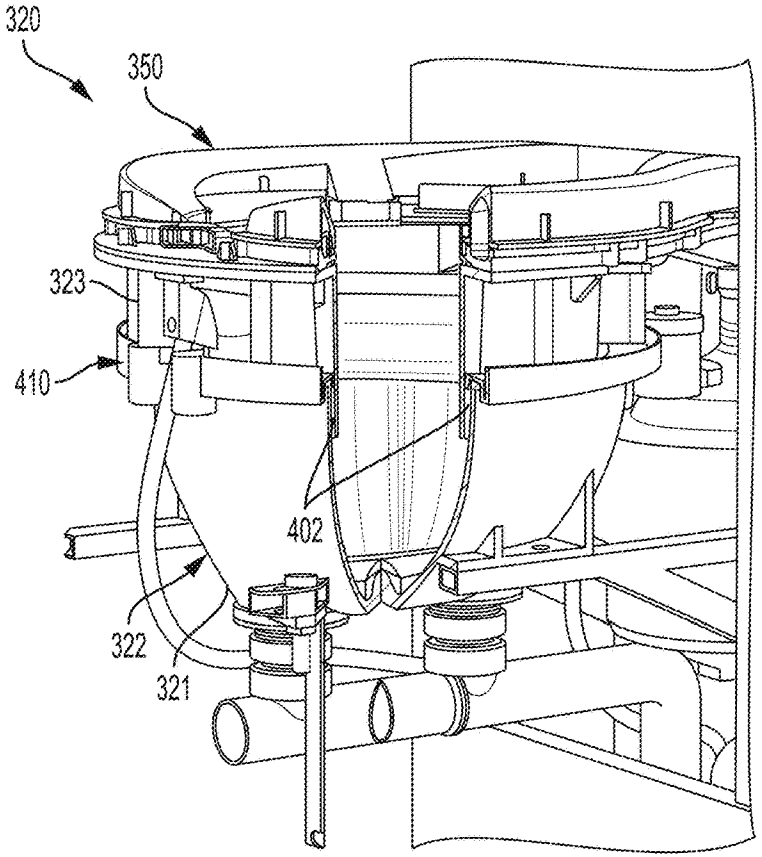
FIG. 70 is a perspective view of the basin structure of FIG. 69 with a portion cut out.

Additionally, as a further safety measure as shown in FIGS. 70-76, the configuration of the basin structure 322 acts as a safety feature in the event that the handwashing station 320 overflows above the overflow hole 328 and the sensor hole 326. More specifically, the basin structure 322 includes the lower basin 321 and the overlapping ring or rim 323 in order to create an additional safety feature. The overlapping rim 323 is positionable on top of and at least partially within the lower basin 321 such that a lower portion of the wall of the overlapping rim 323 overlaps an interior, upper portion of the wall of the lower basin 321, creating or defining an emergency channel or gap 402 between the two walls of the overlapping rim 323 and the lower basin 321 (i.e., between an outer surface of the overlapping rim 323 and an inner surface of the lower basin 321). The gap 402 extends along the joint between the lower basin 321 and the overlapping rim 323. As shown in FIGS. 71-72, the gap 402 creates an opening for liquid to flow (or overflow) through between the overlapping rim 323 and the lower basin 321. Accordingly, excess liquid can flow from within the basin structure 322, through the gap 402 between the overlapping rim 323 and the lower basin 321, and drain out from the basin structure 322. The liquid flowing out of the basin structure 322 through the gap 402 may flow directly onto the floor or any area below the handwashing station 320. As shown in FIG. 72, a cleaning tool 419 with a curved, u-shaped portion may be used to clean within the gap 402 between the overlapping rim 323 and the lower basin 321.

With this configuration of the basin structure 322 (as shown in FIGS. 70-76), the handwashing station 320 does not have to include any vacuum breaker since this configuration allows liquid to be drained, even in the event of a system failure or if the both the drain 370 and the overflow hole 328 cannot drain the excess liquid fast enough. This configuration of the basin structure 322 provides a secondary way of draining excess or overflow liquid from the basin structure 322 (aside from the drains 370).

Figure 74:
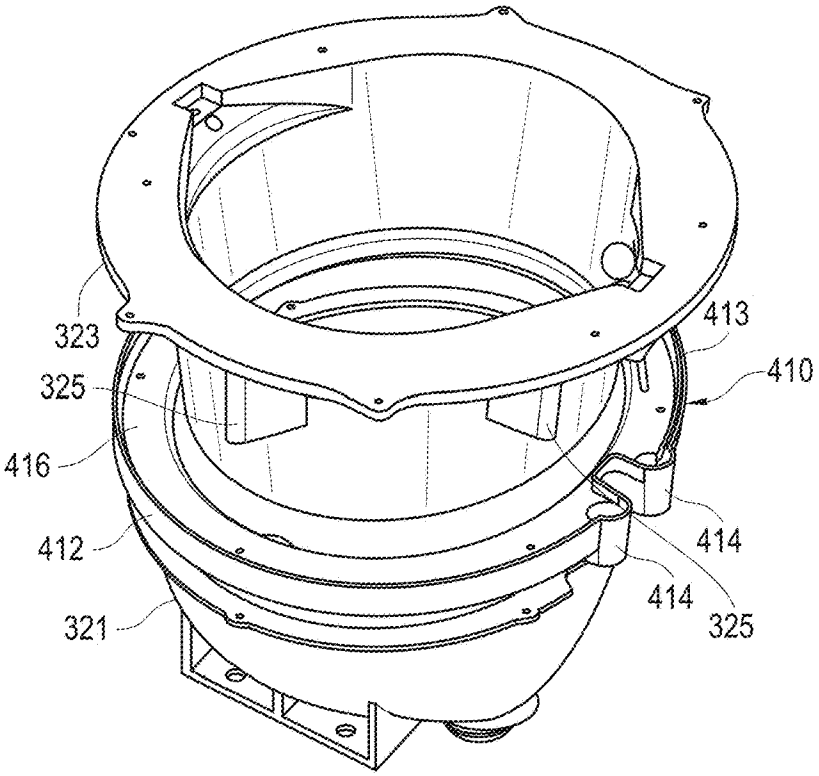
FIG. 74 is an exploded view of the basin structure of FIG. 69.
Figure 73:
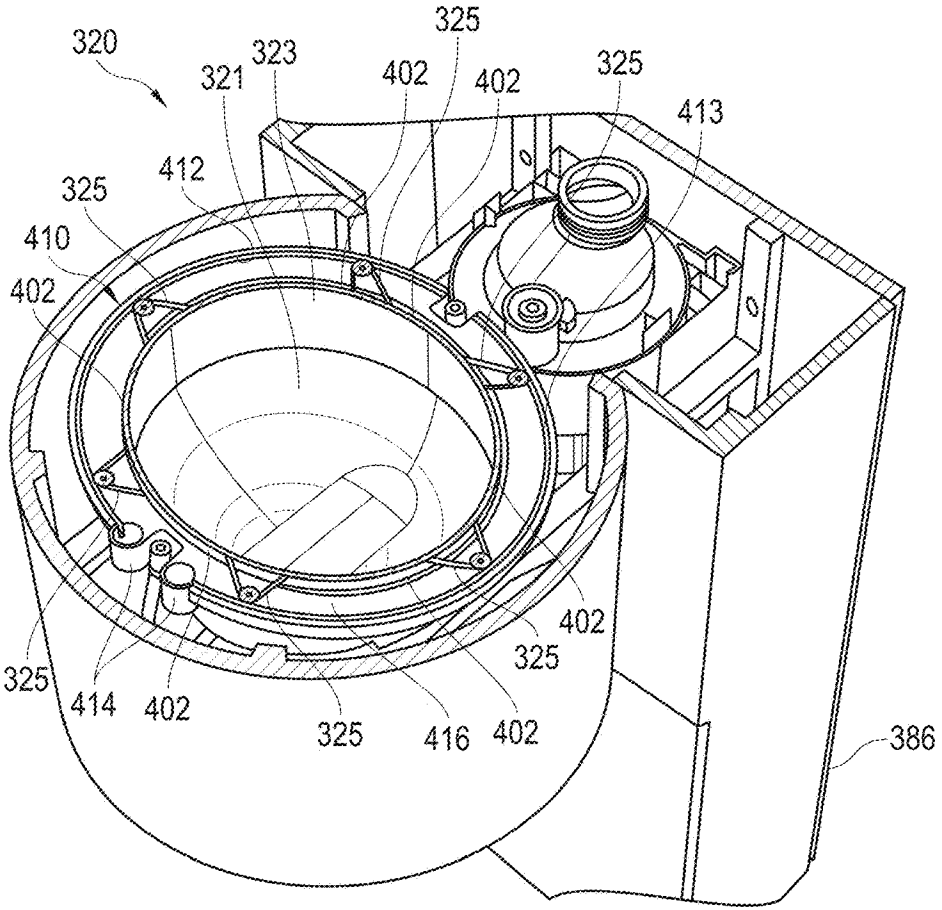
FIG. 73 is a top, cross-sectional view of the basin structure of FIG. 69.
Figure 76:
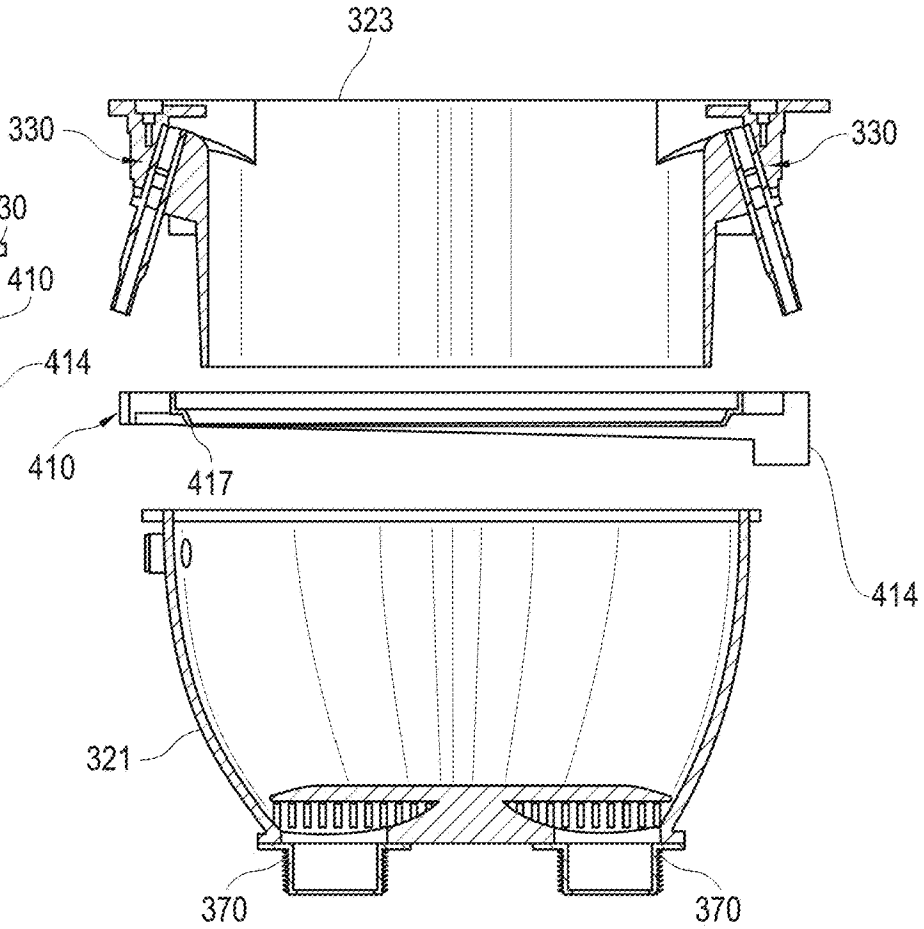
FIG. 76 is a side, cross-sectional, exploded view of the basin structure of FIG. 69.

As shown in FIG. 73, aside from the supports 325 of the overlapping rim 323 (as shown in FIG. 74), the gap 402 extends substantially around the entire inner perimeter of the lower basin 321 (and around the entire outer perimeter of the overlapping rim 323). In order or the overlapping rim 323 to fit at least partially within the lower basin 321, the outer diameter of a lower portion of the overlapping rim 323 is smaller than the inner diameter of an upper portion of the lower basin 321.

Figure 75:
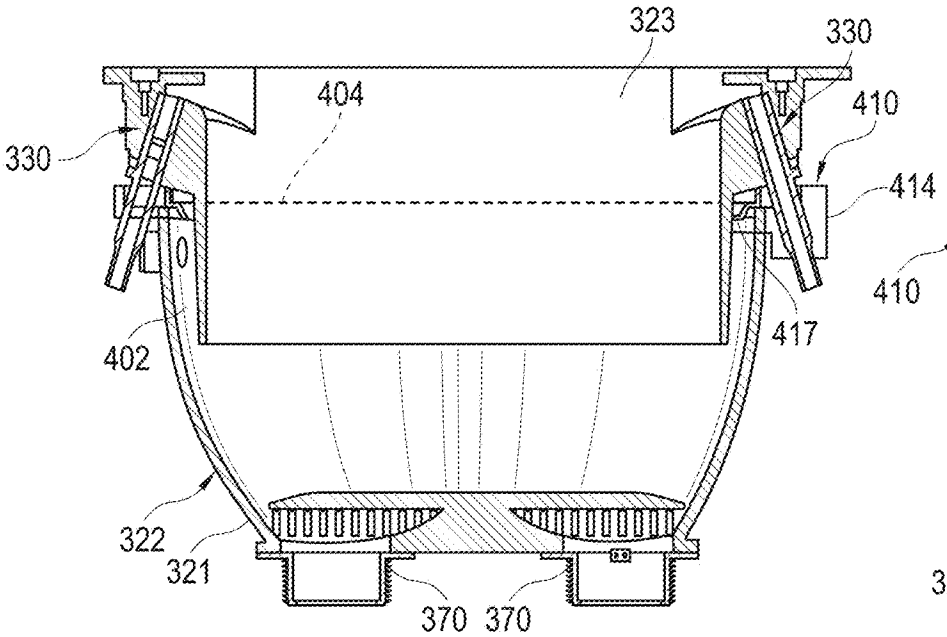
FIG. 75 is a side, cross-sectional view of the basin structure of FIG. 69.

As shown in FIG. 75, due to the configuration of the basin structure 322, the liquid cannot rise or fill above the fill line 404, which corresponds to approximately the top of the lower basin 321 where the excess liquid flows or escapes out of the basin structure 322 through the gap 402. According to one embodiment, the fill line 404 may be approximately 1.5 to 2 inches below the lowest water dispenser 331, which ensures that any excess liquid does not drain through any of the water dispensers 331.

The size of the gap 402 allows the excess liquid in the basin structure 322 to easily and quickly drain from within the basin structure 322. For example only, according to one embodiment, the total area of the two drain 370 is approximately 2.94 inches$^2$ (in$^2$), the area of the overflow hole 328 is approximately 1.23 in$^2$, and the area of the opening provided by the gap 402 (where the width 403 of the gap 402 is approximately 0.1 in$^2$ and the total length of the gap 402 is approximately 34 inches) is approximately 3.43 or 3.44 in$^2$. Additionally, the area of a 1.25 in pipe is approximately 1.23 in$^2$, the maximum flow rate of water is approximately 2.27 gpm, and the water used per cycle is approximately 0.2 gallons. Accordingly, the gap 402 provides a sufficiently large opening in order to sufficiently drain liquid from within the basin structure 322 and prevent any damage.

During normal use, the air from the air dispensing system 350 may carry some liquid from drying the user's hands. Accordingly, the basin structure 322 may further include a middle ring 410, which is another safety features, in order to prevent liquid from escaping out of the basin structure 322 through the gap 402 when the air dispensing system 350 is turned on or running. However, some embodiments of the handwashing station 320 may not include the middle ring 410, depending on the desired configuration.

As shown in FIGS. 70-76, the middle ring 410 is positioned between the lower basin 321 and the overlapping rim 323 and extend around the perimeters of the lower basin 321 and the overlapping rim 323. The middle ring 410 is positioned along and above the top edge of the lower basin 321 and along and beneath the supports 325 of the overlapping rim 323. More specifically, as shown in FIG. 71, the bottom surface 418 of the middle ring 410 is positioned along (and on top of) the top edge of the lower basin 321 and the supports 325 of the overlapping rim 323 are positioned along (and on top of) the top surface 416 of the middle ring 410. The supports 325 of the overlapping rim 323 extend from an outer surface of the overlapping rim 323. Accordingly, the middle ring 410 is positioned along the outer surface of the overlapping rim 323.

The middle ring 410 includes an inner lip 417 that extends downwardly into the lower basin 321 within the gap 402 and along a portion of the inner surface of the lower basin 321. Accordingly, the inner lip 417 extends along a portion of the gap 402, in particular the width of the gap 402. Since the inner lip 417 extends downwardly at an angle, the end of the inner lip 417 is spaced apart from the inner surface of the lower basin 321. Accordingly, the inner lip 417 reduces the size of the gap 402 along a portion of the gap 402 and moves the gap 402 to extend only along the outer surface of the overlapping rim 323, rather than along the inner surface of the lower basin 321. According to one embodiment as shown in FIG. 71, the width 401 of the gap 402 below the inner lip 417 is approximately 0.35 inches and the width 403 of the gap 402 along the end of the inner lip 417 is approximately 0.1 inches. Accordingly, the inner lip 417 forces any fluid flowing through the gap 402 to flow inwardly along the outer surface of the overlapping rim 323. Since the air that is carrying liquid (from the air dispensing system 350) mainly flows along and is pressed against the inner surface of the lower basin 321 (due to the high pressure of the air), the inner lip 417 prevents the majority of the air that is carrying liquid from escaping the basin structure 322 through the gap 402.

As shown in FIGS. 71-74, the middle ring 410 includes a channel 413 that extends around at least a portion of the outer perimeter of the middle ring 410. The channel 413 is positioned lower than the top surface 416 of the middle ring 410 such that fluid flows from the top surface 416 and into the channel 413. The channel 413 leads to and directs liquid to at least one drain hole 414 (as shown in FIGS. 73-74) that extends completely through the middle ring 410. The middle ring 410 may further include an outer lip 412 to prevent liquid from escaping the channel 413 before exiting through the drain holes 414. The outer lip 412 extends along the length of the channel 413 and along the outer side of the channel 413 (such that the channel 413 is positioned between the top surface 416 and the outer lip 412 of the middle ring 410).

Accordingly, when there is excess liquid in the basin structure 322 that needs to be removed, the middle ring 410 captures and drains the excess liquid escaping the basin structure 322 through the gap 402. More specifically, the excess liquid flows up through the gap 402, onto the top surface 416 of the middle ring 410, and into the channel 413. The channel 413 directs the excess liquid to flow around at least a portion of the outer perimeter of the basin structure 322 to the at least one drain hole 414, where the drains or falls through the drain holes 414 and onto, for example, the floor.

Figure 79:
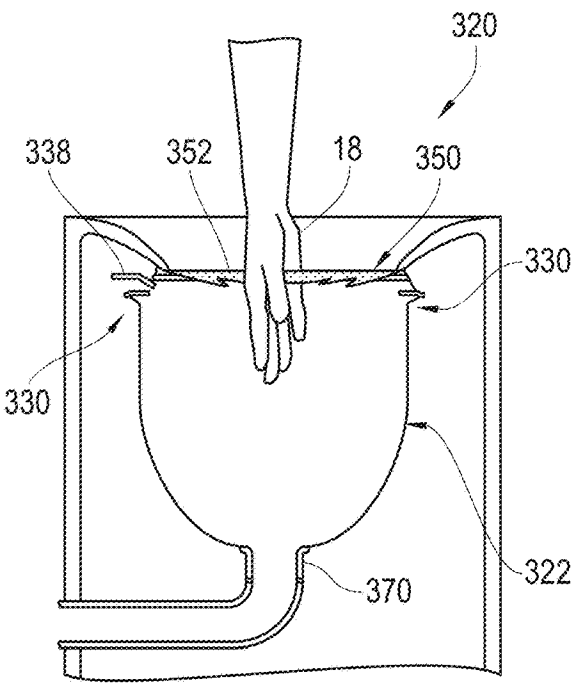
FIG. 79 is a side view of the handwashing station of FIG. 51 dispensing air.
Figure 78:
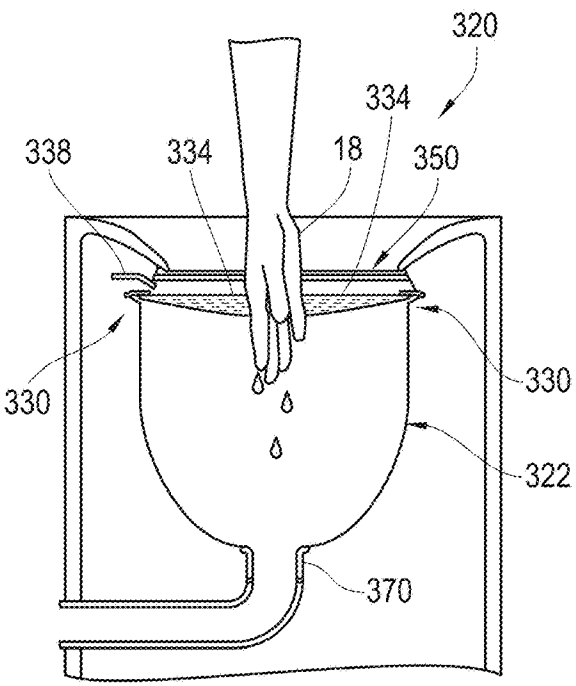
FIG. 78 is a side view of the handwashing station of FIG. 51 dispensing water.

In order to use the handwashing station 320, the handwashing station 320 may include similar steps as those described in reference to the handwashing station 20 and as shown, for example, in FIGS. 17-25. However, as shown in FIGS. 77-79, the handwashing station 320 may include additional or alternative steps that may also optionally be used within the steps for the handwashing station 20. As shown in FIG. 77, when the user inserts their hand 18 into the basin structure 322, the liquid dispensing system 330 is activated and may dispense both soap 336 through the soap dispenser 338 and water 334 through one of the water dispensers 331 at the same time (and through different nozzles or dispensers, as shown), which wets, soaps, and cleans the hand 18. As shown, the soap 336 is dispensed above the water 334 such that the soap 336 rides on top of and is carried by the layer of water 334. The soap dispenser 338 may optionally be positioned on only one side of the basin structure 322, such as the wall side of the basin structure 322.

After a certain period of time has elapsed, the soap dispenser 338 stops dispensing soap 336 and water 334 begins to flow from the other water dispenser 331 such that water 334 is flowing in opposite directions from two water dispensers 331 onto the hand 18, which rinses the hand 18. As shown, the water dispenser 331 may optionally be positioned at approximately the same height within the basin structure 322.

After a certain period of time has elapsed, the water dispensers 331 are turned on and stop dispensing water 334 and the air dispensing system 350 turns on to blow air 352 into the basin structure 322 and onto the hand 18, which dries the hand 18.

According to one embodiment, if the user removes their hand from within the basin structure 322 during the handwashing sequence (i.e., before the handwashing sequence has completed), the handwashing sequence (i.e., the dispensing of the liquid dispensing system 330 and the air dispensing system 350) pauses and stops dispensing liquid and air into the basin structure 322. The time lapse between when the user removed their hand mid-sequence and when a hand is put back into the basin structure 322 determines how the handwashing sequence progresses. For example, if the user puts their hand back into the basin structure 322 after a specified relatively short period of time, the handwashing sequence resumes where it left off, rather than starting over from the beginning. If the user (or a second subsequent user) puts their hand into the basin structure 322 after a specified relatively longer period of time, the handwashing sequence restarts and starts back at the beginning of the handwashing sequence. The handwashing sequence of the handwashing station 320 may optionally include any of the features of the handwashing sequence (120) (as described further herein) (and vice versa), according to the desired configuration.

It is noted that the water 334 and the soap 336, may optionally include any of the various features and configurations of the liquid 32 or liquid 232 or the sanitizing liquid 38 or of the water 34 and the soap 36 (as described further herein), respectively, according to the desired configuration. Additionally, the air 352 may optionally include any of the various features and configurations of the air 52 (as described further herein), respectively, according to the desired configuration.

Figure 80:
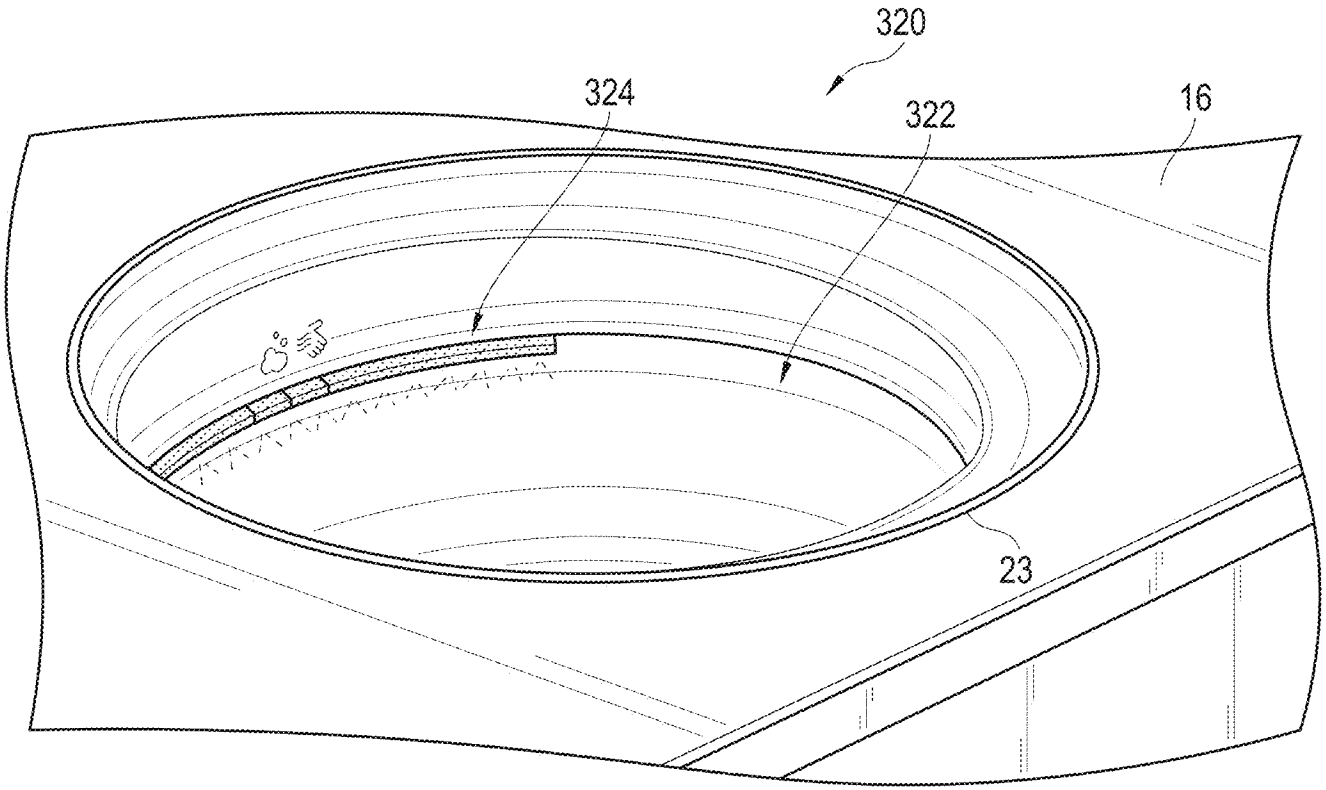
FIG. 80 is a top, perspective view of a portion of the handwashing station of FIG. 51.

According to one embodiment as shown in FIG. 80, the handwashing station 320 includes process indicators 324 that shows a visual indication of the progress of the various steps that the handwashing station 320 progresses through. The process indicators 324 may include a backlight and/or LEDs and may, for example, flash or turn on during various steps, such as when the user puts their hand into the basin structure 322. Since the handwashing station 320 is recessed within a counter 16, the process indicators 324 may also be recessed within the counter 16. According to one embodiment, the process indicators 324 may activate various lights when the user puts their hand into the basin structure 322 to indicate the progress of the handwashing sequence, may flash for a period of time if the user removes their hand from within the basin structure 322, and may resume indicating the progress of the handwashing sequence if the user puts their hand back into the basin structure 322. The process indicators 324 may optionally include any of the various features and configurations of the process indicators 24 (as described further herein), according to the desired configuration.

Figure 81:
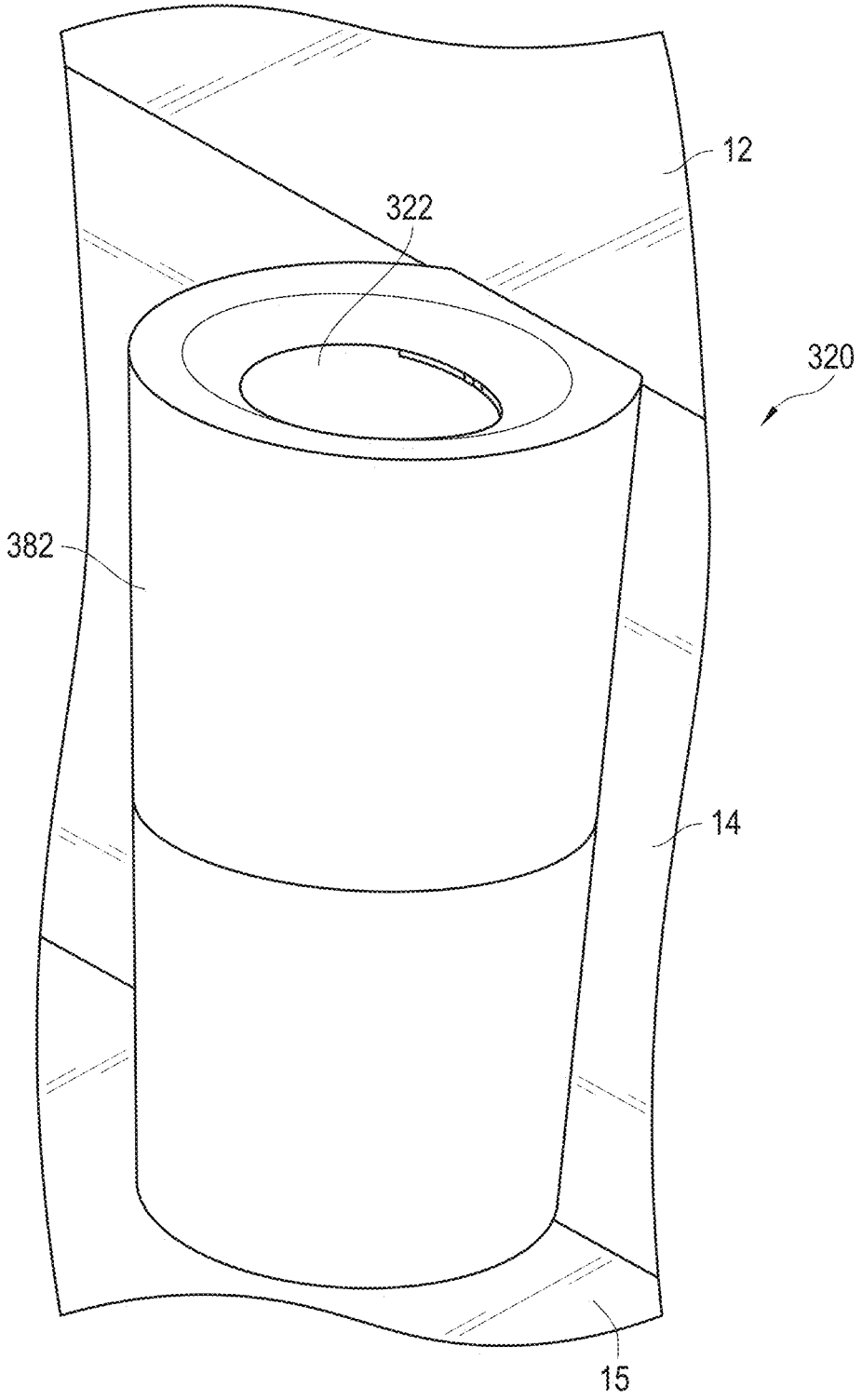
FIG. 81 is a perspective view of another configuration of the handwashing station of FIG. 51.

The handwashing station 320 may be constructed in a variety of different manners according to the desired configuration and look. According to one embodiment, the handwashing station 320 may be constructed as a standalone device that can be used separated from any counter or wall and supports itself completely (see, for example, 51). According to another embodiment as shown in FIG. 80 (as well as FIG. 42), the handwashing station 320 may be fully integrated into various bathroom components in order to maximize space and reduce the cost. For example, the handwashing station 320 may be under-mount into a counter 16. According to another embodiment as shown in FIG. 81, the handwashing station 320 may have an in-wall installation in which the handwashing station 320 is attached to the wall 14 and extends partially within the wall 14 and partially outside of the wall 14.

Figure 83:
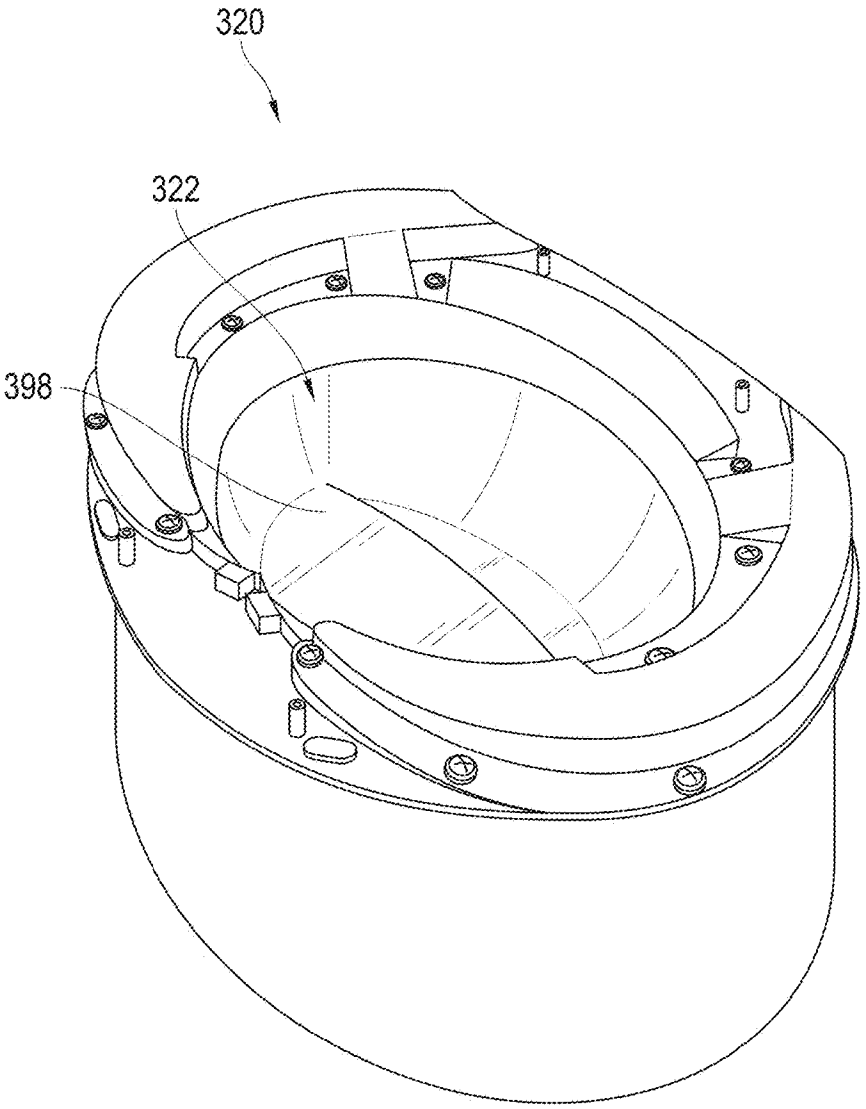
FIG. 83 is a top view of another embodiment of the basin structure of the handwashing station of FIG. 51.
Figure 82:
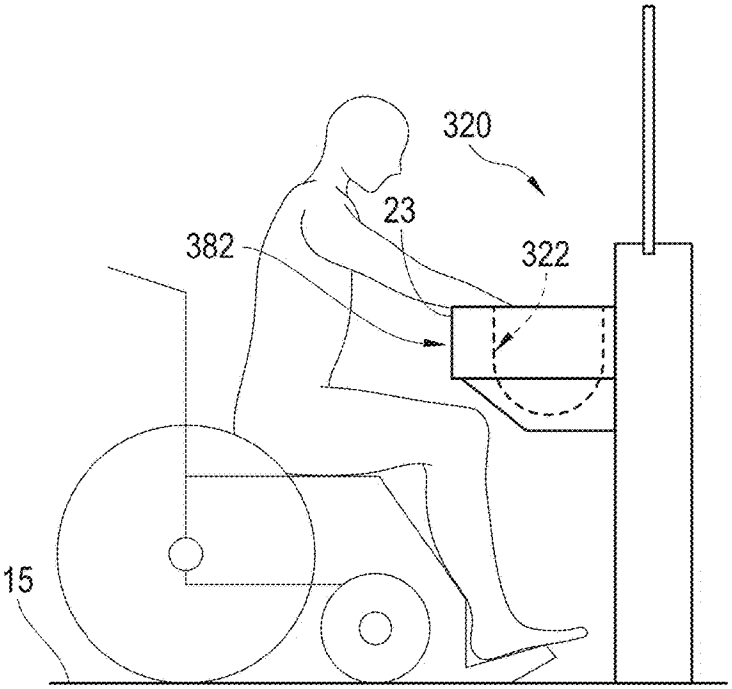
FIG. 82 is a side view of the handwashing station of FIG. 51 being used from a wheelchair.

As shown in FIGS. 82-83, the handwashing station 320 may be Americans with Disabilities Act (ADA) compliant in order to accommodate, for example, users wheelchairs. For example, as shown in FIG. 82, the bottom portion of the exterior components 382 of the handwashing station 320 may be angled such that the front lower portion of the handwashing station 320 that is beneath the basin structure 322 (i.e., the user side 23) is higher than the back lower portion of the handwashing station 320 that is beneath the basin structure 322. This configuration provides room for the user's knees (when seated in a chair or wheelchair) to be positioned at least partially underneath the handwashing station 320 to allow the user to more easily reach the handwashing station 320.

Alternatively or additionally, the inside, front, lower portion of the basin structure 322 may be raised upwards in order to provide additional room beneath the basin structure 322 for the user to move their knees under, as shown in FIG. 83. Accordingly, the basin structure 322 include an inner step 398 that raises a portion of the bottom surface of the basin structure 322 and thus reduces the depth of the basin structure 322.

Due to the configuration of the various handwashing stations described herein, the handwashing stations may produce up to 95% less $CO_2$ and use significantly less energy than other hand dryers and up to approximately 94% less $CO_2$ than paper towels and is significantly cheaper and faster.

According to various embodiments, the various air dispensing systems described herein may use convection to dry the user's hands and/or may use infrared technology to dry the user's hands. Additionally, the various air dispensing systems and the various liquid dispensing systems described herein may be used as stand-alone hand-drying devices and/or stand-alone handwashing devices or may be used with the various handwashing stations as described herein.

It is understood that each of the components of the handwashing stations 20, 220, and 320 can be used together or separately in any number of different combinations. For example, the basin 22 (or the basins 222 or 322) and the liquid dispensing system 30 (or the liquid dispensing systems 230 or 330) may be used together without the air dispensing system 50 (or the air dispensing system 350). Alternatively, the basin 22 (or the basins 222 or 322) and the air dispensing system 50 (or the air dispensing system 350) may be used together without the liquid dispensing system 30 (or the liquid dispensing systems 230 or 330). The liquid dispensing system 30 (or the liquid dispensing systems 230 or 330) and the air dispensing system 50 (or the air dispensing system 350) may be used separately (i.e., as stand-alone devices) if desired.

As utilized herein, the terms "approximately," "about," "substantially," "essentially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the handwashing stations as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, manufacturing processes, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to exemplary embodiments. Other substitutions, modifications, changes and omissions may also be made in the design, operating conditions and arrangement of the various exemplary embodiments without departing from the scope of the present disclosure.

The invention claimed is:

1. A handwashing station comprising:

a basin;

a top surface above the basin;

a liquid dispensing system configured to dispense a liquid into the basin and positioned below the top surface;

an air dispensing system configured to dispense air into the basin and positioned at a top opening of the basin below the top surface;

a sensor hole in the basin; and a liquid sensor configured to detect liquid at the sensor hole, wherein the handwashing station including the liquid dispensing system and the air dispensing system is turned off in response to liquid detected by the liquid sensor.

2. The handwashing station of claim 1, further comprising:

an overflow hole below the sensor hole, wherein the overflow hole drains water from the basin.

3. The handwashing station of claim 2, further comprising:

an overlapping rim configured to obscure the overflow hole and the sensor hole.

4. The handwashing station of claim 3, wherein the overlapping rim and a lower portion of the basin form an emergency channel that leads out of the handwashing station.

5. The handwashing station of claim 4, further comprising:

a middle ring configured to prevent water blown from the air dispensing system from escaping the basin through the emergency channel.

6. The handwashing station of claim 5, further comprising:

a drain channel that extends around at least a portion of an outer perimeter of the middle ring and leads to and directs liquid to at least one drain hole.

7. The handwashing station of claim 1, further comprising:

a body sensor configured to detect a user, wherein the liquid dispensing system or the air dispensing system is initiated in response to detection at the body sensor.

8. The handwashing station of claim 7, wherein the body sensor is configured to detect the hands of the user at the basin.

9. The handwashing station of claim 8, further comprising:

a controller configured to stop a handwashing sequence in response to removal of the hands of the user from the basin.

10. The handwashing station of claim 9, wherein when the hands are removed for a first time period, the controller resumes the handwashing sequence and when the hands are removed for a second time period, the controller restarts the handwashing sequence.

11. A method of providing handwashing in a handwashing station, the method comprising:

activating a liquid dispensing system comprising a liquid dispenser positioned below a circumferential top surface of the handwashing station that defines an opening leading into a basin;

dispensing liquid into the basin with the liquid dispensing system;

activating an air dispensing system at the opening of the basin below the circumferential top surface of the handwashing station;

detecting removal of a user's hands from the basin;

deactivating the liquid dispensing system or the air dispensing system in response to the removal of the user's hands.

12. The method of claim 11, further comprising:

reactivating the air dispensing system when the user's hands are removed for a first time period.

13. The method of claim 11, further comprising:

reactivating the liquid dispensing system when the user's hands are removed for a second time period.

14. The method of claim 11, further comprising:

detecting liquid through a sensor hole in the basin; and turning off the handwashing station in response to the detected liquid.

15. An apparatus comprising:

a basin;

a top surface above the basin;

a sensor configured to generate presence data for a user;

a liquid dispensing system configured to, in response to the presence data, dispense a liquid into the basin and positioned completely below the top surface; and an air dispensing system configured to, in response to a timer, dispense air into the basin and positioned at an opening of the basin completely below the top surface, wherein the liquid dispensing system directs at least a portion of the liquid directly toward a central location within a middle portion of the basin and the air dispensing system directs at least a portion of the air directly toward the same central location within the middle portion of the basin.

16. The apparatus of claim 15, further comprising:

a sensor hole in the basin; and a liquid sensor configured to detect liquid at the sensor hole and turn off the liquid dispensing system or the air dispensing system.

17. The apparatus of claim 16, further comprising:

an overflow hole below the sensor hole, wherein the overflow hole drains water from the basin.

18. The apparatus of claim 16, further comprising:

an overlapping rim configured to obscure the overflow hole and the sensor hole.

19. The apparatus of claim 18, wherein the overlapping rim and a lower portion of the basin form an emergency channel that leads out of the apparatus.

20. The apparatus of claim 19, further comprising:

a middle ring configured to prevent water blown from the air dispensing system from escaping the basin through the emergency channel.

* * * * *